US009968156B2

(12) United States Patent
Huffman et al.

(10) Patent No.: US 9,968,156 B2
(45) Date of Patent: May 15, 2018

(54) METHOD OF MAKING AN ARTICLE OF FOOTWEAR INCLUDING KNITTING A KNITTED COMPONENT OF WARP KNIT CONSTRUCTION FORMING A SEAMLESS BOOTIE WITH TUCKED-IN PORTION

(71) Applicant: NIKE, Inc., Beaverton, OR (US)

(72) Inventors: Julie A. Huffman, Portland, OR (US); Amy Lyttle, Portland, OR (US); Thomas G. Bell, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 496 days.

(21) Appl. No.: 14/292,181

(22) Filed: May 30, 2014

(65) Prior Publication Data

US 2015/0342285 A1 Dec. 3, 2015

(51) Int. Cl.
*A43B 1/04* (2006.01)
*A43B 23/02* (2006.01)
(Continued)

(52) U.S. Cl.
CPC ..... *A43B 1/04* (2013.01); *A43B 23/024* (2013.01); *A43B 23/025* (2013.01);
(Continued)

(58) Field of Classification Search
CPC ..... A43B 1/04; A43B 23/024; A43B 23/0245; A43B 23/043; A43B 23/025; A43B 23/26;
(Continued)

(56) References Cited

U.S. PATENT DOCUMENTS 601,192 A 3/1898 Woodside
1,215,198 A 2/1917 Rothstein
(Continued)

FOREIGN PATENT DOCUMENTS

CN 1067566 A 1/1993
CN 103556384 2/2014
(Continued)

OTHER PUBLICATIONS

International Search Report and Written Opinion dated Apr. 22, 2015 in International Application No. PCT/US2015/015346.
(Continued)

*Primary Examiner* — Danny Worrell
*Assistant Examiner* — Jocelyn Bravo
(74) *Attorney, Agent, or Firm* — Brinks Gilson & Lione

(57) ABSTRACT

An article of footwear incorporates a seamless bootie or textile upper formed from a knitted component removed from a knitted textile element of unitary warp knit construction. The knitted component may include a first knitted component portion in the form of a seamless bootie and a second knitted component portion associated with the first knitted component portion. In some embodiments the second knitted component portion may be tucked-in or folded into a pocket of first knitted component portion, such as a knitted dynamic fit component portion or a knitted tongue component portion. In some embodiments the second kitted component portion may be wrapped around at least part of the first knitted component portion.

11 Claims, 27 Drawing Sheets

(51) Int. Cl.

| | |
|---|---|
| ***A43B 23/26*** | (2006.01) |
| ***D04B 1/22*** | (2006.01) |
| ***A43B 23/04*** | (2006.01) |
| ***D04B 21/20*** | (2006.01) |

(52) U.S. Cl.
CPC ..... *A43B 23/0245* (2013.01); *A43B 23/042* (2013.01); *A43B 23/26* (2013.01); *D04B 1/22* (2013.01); *D04B 21/207* (2013.01); *D10B 2401/10* (2013.01); *D10B 2403/03* (2013.01); *D10B 2501/043* (2013.01)

(58) Field of Classification Search
CPC ..... D04B 21/207; D04B 1/22; D04B 1/108; D10B 2401/10; D10B 2403/03; D10B 2501/043
USPC ..... 66/170, 178 R, 185
See application file for complete search history.

(56) References Cited

U.S. PATENT DOCUMENTS 1,597,934 A 8/1926 Stimpson
1,888,172 A 11/1932 Joha
1,902,780 A 3/1933 Holden et al.
1,910,251 A 5/1933 Joha
2,001,293 A 5/1935 Wilson
2,047,724 A 7/1936 Zuckerman
2,147,197 A 2/1939 Glidden
2,314,098 A 3/1943 McDonald
2,330,199 A 9/1943 Basch
2,343,390 A 3/1944 Ushakoff
2,400,692 A 5/1946 Herbert
2,440,393 A 4/1948 Clark
2,569,764 A 10/1951 Jonas
2,586,045 A 2/1952 Hoza
2,608,078 A 8/1952 Anderson
2,641,004 A 6/1953 Whiting et al.
2,675,631 A 4/1954 Doughty
2,994,322 A 8/1961 Cullen et al.
3,058,241 A * 10/1962 Rigsby ..... A43B 3/26 36/11
3,583,081 A 6/1971 Hayashi
3,694,940 A 10/1972 Stohr
3,704,474 A 12/1972 Winkler
3,766,566 A 10/1973 Tadakoro
3,778,856 A 12/1973 Christie et al.
3,952,427 A 4/1976 Von den Benken et al.
3,972,086 A 8/1976 Belli et al.
3,985,003 A * 10/1976 Reed ..... D04B 1/24 2/115
4,027,402 A 6/1977 Liu et al.
4,031,586 A 6/1977 Von den Benken et al.
4,132,016 A * 1/1979 Vaccari ..... A43B 19/00 36/10
4,211,806 A 7/1980 Civardi et al.
4,232,458 A 11/1980 Bartels
4,255,949 A 3/1981 Thorneburg
4,258,480 A 3/1981 Famolare, Jr.
4,317,292 A 3/1982 Melton
4,373,361 A 2/1983 Thorneburg
4,447,967 A 5/1984 Zaino
4,465,448 A 8/1984 Aldridge
4,607,439 A 8/1986 Harada
4,737,396 A 4/1988 Kamat
4,750,339 A 6/1988 Simpson et al.
4,756,098 A 7/1988 Boggia
4,785,558 A 11/1988 Shiomura
4,813,158 A 3/1989 Brown
5,031,423 A 7/1991 Ikenaga
5,095,720 A 3/1992 Tibbals, Jr.
5,117,567 A 6/1992 Berger
5,152,025 A 10/1992 Hirmas
5,192,601 A 3/1993 Neisler
5,345,638 A * 9/1994 Nishida ..... A41H 3/08 12/146 C
5,353,524 A 10/1994 Brier
5,371,957 A 12/1994 Gaudio
5,461,884 A 10/1995 McCartney et al.
5,511,323 A 4/1996 Dahlgren
5,572,860 A 11/1996 Mitsumoto et al.
5,575,090 A 11/1996 Condini
5,623,840 A 4/1997 Roell
5,729,918 A 3/1998 Smets
5,735,145 A 4/1998 Pernick
5,746,013 A 5/1998 Fay, Sr.
5,765,296 A 6/1998 Ludemann et al.
5,884,419 A 3/1999 Davidowitz et al.
5,996,189 A 12/1999 Wang
6,029,376 A 2/2000 Cass
6,032,387 A 3/2000 Johnson
6,052,921 A 4/2000 Oreck
6,088,936 A 7/2000 Bahl
6,151,802 A 11/2000 Reynolds
6,170,175 B1 1/2001 Funk
6,308,438 B1 10/2001 Throneburg et al.
6,333,105 B1 12/2001 Tanaka et al.
6,401,364 B1 6/2002 Burt
6,558,784 B1 * 5/2003 Norton ..... A43B 5/002 12/146 C
6,588,237 B2 7/2003 Cole et al.
6,754,983 B2 6/2004 Hatfield et al.
6,910,288 B2 6/2005 Dua
6,922,917 B2 8/2005 Kerns et al.
6,931,762 B1 8/2005 Dua
D517,297 S 3/2006 Jones et al.
7,051,460 B2 5/2006 Orei et al.
7,056,402 B2 6/2006 Koerwien et al.
7,347,011 B2 2/2008 Dua et al.
7,441,348 B1 10/2008 Dawson
7,543,397 B2 6/2009 Kilgore et al.
7,568,298 B2 8/2009 Kerns
7,682,219 B2 3/2010 Falla
8,490,299 B2 7/2013 Dua et al.
2002/0078599 A1 6/2002 Delgorgue et al.
2002/0148258 A1 10/2002 Cole et al.
2003/0126762 A1 7/2003 Tseng
2003/0191427 A1 10/2003 Jay et al.
2004/0118018 A1 6/2004 Dua
2004/0181972 A1 9/2004 Csorba
2005/0081402 A1 * 4/2005 Orei ..... A43B 1/00 36/45
2005/0115284 A1 6/2005 Dua
2005/0193592 A1 9/2005 Dua et al.
2005/0273988 A1 12/2005 Christy
2005/0284000 A1 12/2005 Kerns
2006/0059715 A1 3/2006 Aveni
2006/0162187 A1 7/2006 Byrnes et al.
2007/0022627 A1 2/2007 Sokolowski et al.
2007/0180730 A1 8/2007 Greene et al.
2007/0294920 A1 12/2007 Baychar
2008/0017294 A1 1/2008 Bailey et al.
2008/0078102 A1 4/2008 Kilgore et al.
2008/0110048 A1 5/2008 Dua et al.
2008/0189830 A1 8/2008 Egglesfield
2008/0313939 A1 12/2008 Ardill
2009/0068908 A1 3/2009 Hinchcliff
2010/0017974 A1 * 1/2010 RongBo ..... A43B 9/02 12/145
2010/0051132 A1 3/2010 Glenn
2010/0154256 A1 6/2010 Dua
2010/0170651 A1 7/2010 Scherb et al.
2011/0030244 A1 2/2011 Motawi et al.
2011/0078921 A1 4/2011 Greene et al.
2012/0233882 A1 9/2012 Huffa et al.
2012/0240429 A1 9/2012 Sokolowski et al.
2012/0255201 A1 * 10/2012 Little ..... A43B 1/04 36/84
2013/0160323 A1 6/2013 Hsiao

(56) References Cited

U.S. PATENT DOCUMENTS

| | | | | |
|---|---|---|---|---|
| 2013/0269209 | A1* | 10/2013 | Lang | A43B 23/0205 36/45 |
| 2013/0269212 | A1* | 10/2013 | Little | A43B 1/04 36/84 |

FOREIGN PATENT DOCUMENTS

| | | | |
|---|---|---|---|
| CN | 203608898 | U | 5/2014 |
| DE | 870963 | C | 3/1953 |
| DE | 1084173 | | 6/1960 |
| DE | 19738433 | | 4/1998 |
| DE | 19728848 | | 1/1999 |
| EP | 0279950 | A2 | 8/1988 |
| EP | 0448714 | | 7/1996 |
| EP | 0728860 | | 8/1996 |
| EP | 0758693 | | 2/1997 |
| EP | 0898002 | A2 | 2/1999 |
| EP | 1233091 | | 8/2002 |
| EP | 1437057 | A1 | 7/2004 |
| EP | 1563752 | A1 | 8/2005 |
| EP | 1602762 | A1 | 12/2005 |
| EP | 1972706 | A1 | 9/2008 |
| EP | 2805638 | | 11/2014 |
| FR | 2171172 | | 9/1973 |
| GB | 538865 | | 8/1941 |
| GB | 2018837 | A | 10/1979 |
| GB | 1603487 | | 11/1981 |
| JP | H06113905 | | 4/1994 |
| JP | H08109553 | | 4/1996 |
| JP | H11302943 | | 11/1999 |
| JP | 2014-512911 | | 5/2014 |
| NL | 7304678 | | 10/1974 |
| WO | 9003744 | | 4/1990 |
| WO | 0032861 | | 6/2000 |
| WO | 0231247 | | 4/2002 |
| WO | WO 2012/166244 | | 12/2012 |
| WO | 2013108506 | | 7/2013 |
| WO | 2014050289 | | 4/2014 |

OTHER PUBLICATIONS

International Search Report and Written Opinion dated Apr. 29, 2015 in International Application No. PCT/US2015/015340.

International Search Report and Written Opinion dated Jun. 16, 2015 in International Application No. PCT/US2015/015343.

Office Action and translation for corresponding ROC (Taiwan) Patent Application No. 104203808 dated Nov. 26, 2015, 3 pages.

Declaration of Dr. Edward C. Frederick from the U.S. Patent and Trademark Office Inter Partes Review of U.S. Pat. No. 7,347,011 (178 pp).

David J. Spencer, Knitting Technology: A Comprehensive Handbook and Practical Guide (Third ed., Woodhead Publishing Ltd. 2001) (413 pp).

Excerpt of Hannelore Eberle et al., Clothing Technology (Third English ed., Beuth-Verlag GmnH 2002) (book cover and back; pp. 2-3, 83).

International Search Report and Written Opinion in connection with PCT/US2009/056795 dated Apr. 20, 2010.

International Search Report and Written Opinion in connection with PCT/US2012/028576 dated Oct. 1, 2012.

International Search Report and Written Opinion in connection with PCT/US2012/028559 dated Oct. 19, 2012.

International Search Report and Written Opinion in connection with PCT/US2012/028534 dated Oct. 17, 2012.

International Preliminary Report on Patentability in connection with PCT/US2012/028534 dated Sep. 17, 2013.

International Preliminary Report on Patentability in connection with PCT/US2012/028576 dated Sep. 17, 2013.

International Preliminary Report on Patentability and Written Opinion for corresponding PCT/US2015/015343, dated Dec. 6, 2016, 8 pages.

Office Action and translation of relevant portions for corresponding Chinese Patent Application No. 2015102905667 dated Oct. 28, 2015, 9 pages.

Office Action and English translation for ROC (Taiwan) Patent Application No. 104108201, dated Jun. 12, 2017, 5 pages.

Office Action and English translation for Japanese Application No. 2017-515666, dated Feb. 1, 2018, 5 pages.

* cited by examiner

METHOD OF MAKING AN ARTICLE OF FOOTWEAR INCLUDING KNITTING A KNITTED COMPONENT OF WARP KNIT CONSTRUCTION FORMING A SEAMLESS BOOTIE WITH TUCKED-IN PORTION

BACKGROUND

The present embodiments relate generally to methods of making articles of footwear and in particular to methods of knitting a knitted component of warp knit construction for forming a seamless bootie or textile upper.

Articles of athletic footwear generally include two primary elements, an upper and a sole structure. An upper generally provides a covering for a foot that securely receives and positions the foot with respect to the sole structure. The upper may have a configuration that protects the foot. The upper may have a construction that provides ventilation to an interior of the upper, thereby facilitating cooling of the foot and/or removing perspiration from the foot. The sole structure may be secured to a lower surface of the upper and may be generally positioned between the foot and a ground surface during use of the article of footwear. The sole structure may be configured for attenuating impact and other ground surface reaction forces and absorbing energy, i.e., providing cushioning to the foot during use of the article of footwear. The sole structure may provide traction relative to a ground surface. The sole structure may help to control foot motion during use of the article of footwear. The upper and the sole structure may cooperate to provide a comfortable structure that may be suited for a wide variety of ambulatory activities, such as walking and running.

The upper may form a void on the interior of an article of footwear for receiving a foot. The void may have a general size and/or shape of the foot. The upper may have an opening that provides access to the void, such as an ankle opening. The upper may extend over an instep and toe areas of the foot, along medial and lateral sides of the foot, and/or around a heel area of the foot. The upper may include a fastening or closure system, such as a strap or lacing system, that selectively adjusts a size of the opening (e.g., an ankle opening). Such structure enables the wearer to modify certain dimensions of the upper, particularly girth, to accommodate different feet with varying proportions. The upper may include a tongue associated with an opening and/or closure system. For example, a tongue may be disposed between a lacing system and a foot to enhance the comfort of the article of footwear. The upper may include a heel counter to limit movement of the foot in the heel region.

Materials selected for the upper may vary significantly. Textile materials often form at least a portion of the exterior surface and interior surface of the upper. A textile may be defined as any manufacture made from fibers, filaments, or yarns characterized by flexibility, fineness, and a high ratio of length to thickness. Textiles generally fall into one of two categories. A first category includes textiles produced directly from a web or mat of filaments or fibers by randomly interlocking the filaments or fibers to construct non-woven fabrics and felts. A second category includes textiles formed through a mechanical manipulation of yarn, such as a woven or knit fabric.

SUMMARY

In one aspect, a method of making an article of footwear includes knitting a knitted textile element of unitary warp knit construction having a first knit layer, a second knit layer that overlays the first layer, that is continuous with the first knit layer at a first common edge of the knitted textile element, and that extends along a direction of the knitted textile element, an interlayer knit stitch line that interconnects the first knit layer and the second knit layer at a distance from the common edge, and at least one knitted indicating portion located along the common edge, the common edge and the interlayer knit stitch line collectively defining an outline of a knitted component. The method further includes removing the knitted component from the knitted textile element, and separating the knitted component along the at least one knitted indicating portion to create an opening in the knitted component.

In another aspect, a method of knitting a knitted textile element including a knitted component for use in an article of footwear includes knitting a knitted textile element of unitary warp knit construction having a first knit layer, a second knit layer that overlays the first knit layer and is continuous with the first knit layer at a first common edge of the knitted textile element, and an interlayer knit stitch line that interconnects the first knit layer and the second knit layer, the common edge and the interlayer knit stitch line collectively defining an outline of a knitted component, and knitting at least one knitted indicating portion located along the common edge of the knitted textile element, the at least one knitted indicating portion being configured to indicate a separating line for creating an opening in the knitted component.

In another aspect, an article of footwear includes a knitted component of unitary warp knit construction. The knitted component includes a first knit layer that forms one of a medial side and a lateral side of a seamless bootie, a second knit layer that forms the other one of the medial side and the lateral side of the seamless bootie and is continuous with the first knit layer across a continuous upper forefoot portion of the seamless bootie, an interlayer knit stitch line that interconnects the first knit layer and the second knit layer, the interlayer knit stitch line seamlessly connecting the medial side and the lateral side of the seamless bootie and extending generally along a central line of a heel portion, a bottom portion, and a front toe portion of the seamless bootie, and at least one knitted indicating portion collectively indicating at least one separating line of the knitted component and configured to define an opening in the knitted component that provides access to a void between the first knit layer and the second knit layer, the opening being located between the continuous upper forefoot portion and the heel portion of the seamless bootie.

In another aspect, a method of making an article of footwear includes knitting a knitted textile element of unitary warp knit construction having a first knit layer, a second knit layer that overlays the first knit layer and is continuous with the first knit layer along a common edge of a common opening in the first knit layer and the second knit layer, the common edge of the common opening extending in a direction of knitting process, a first interlayer knit stitch line that interconnects the first knit layer and the second knit layer, the common edge of the common opening and the first interlayer knit stitch line collectively defining an outline of a first knitted component portion of a knitted component, and a second knitted component portion of the knitted component that is seamlessly connected to the first knitted component portion by a first continuous portion of the first knit layer adjacent the common opening and a second continuous portion of the second knit layer adjacent the common opening, a second interlayer knit stitch line that interconnects the first knit layer and the second knit layer at a location spaced apart from the first continuous portion of the first knit layer and the second continuous portion of the second continuous layer, the second interlayer knit stitch line defining an outline of the second knitted component portion, and the first knitted component portion and the second knitted component portion collectively forming the knitted component. The method further includes removing the knitted component from the knitted textile element, and folding the second knitted component portion into an internal pocket formed between the first knit layer and the second knit layer of the first knitted component portion.

In another aspect, a method of making an article of footwear includes knitting a knitted textile element of unitary warp knit construction having a first knit layer, a second knit layer that overlays the first knit layer and is continuous with the first knit layer along a common edge of the knitted textile element that extends along a direction of knitting process, an interlayer knit stitch line that interconnects the first knit layer and the second knit layer, at least one first knitted indicating portion located along the common edge of the common knit layer, the common edge and the interlayer knit stitch line defining an outline of a first knitted component portion of a knitted component, the first knitted component portion being configured to form a seamless bootie, and a second knitted component portion seamlessly associated with the first knitted component portion at the interlayer knit stitch line, the first knitted component portion and the second knitted component portion collectively forming the knitted component. The method further includes removing the knitted component from the knitted textile element, separating the knitted component along the at least one knitted indicating portion to create an opening in the knitted component, and wrapping the second knitted component portion around at least a portion of the first knitted component portion.

Other aspects, systems, methods, features, and advantages of embodiments will be, or will become, apparent to one of ordinary skill in the art upon examination of the following figures and detailed description. It is intended that all such additional aspects, systems, methods, features, and advantages be included within this description and this summary, be within the scope of the invention, and be protected by the following claims.

BRIEF DESCRIPTION OF THE DRAWINGS

The embodiments can be better understood with reference to the following drawings and description. Components in the figures are not necessarily drawn to scale, emphasis instead being placed upon illustrating structural and functional principles of the embodiments. Like reference numerals in the figures designate corresponding parts throughout the different views, and the initial digit or digits of each reference numeral indicates the figure number of the first figure in which the part is identified in the figures.

DETAILED DESCRIPTION

Figure 1:
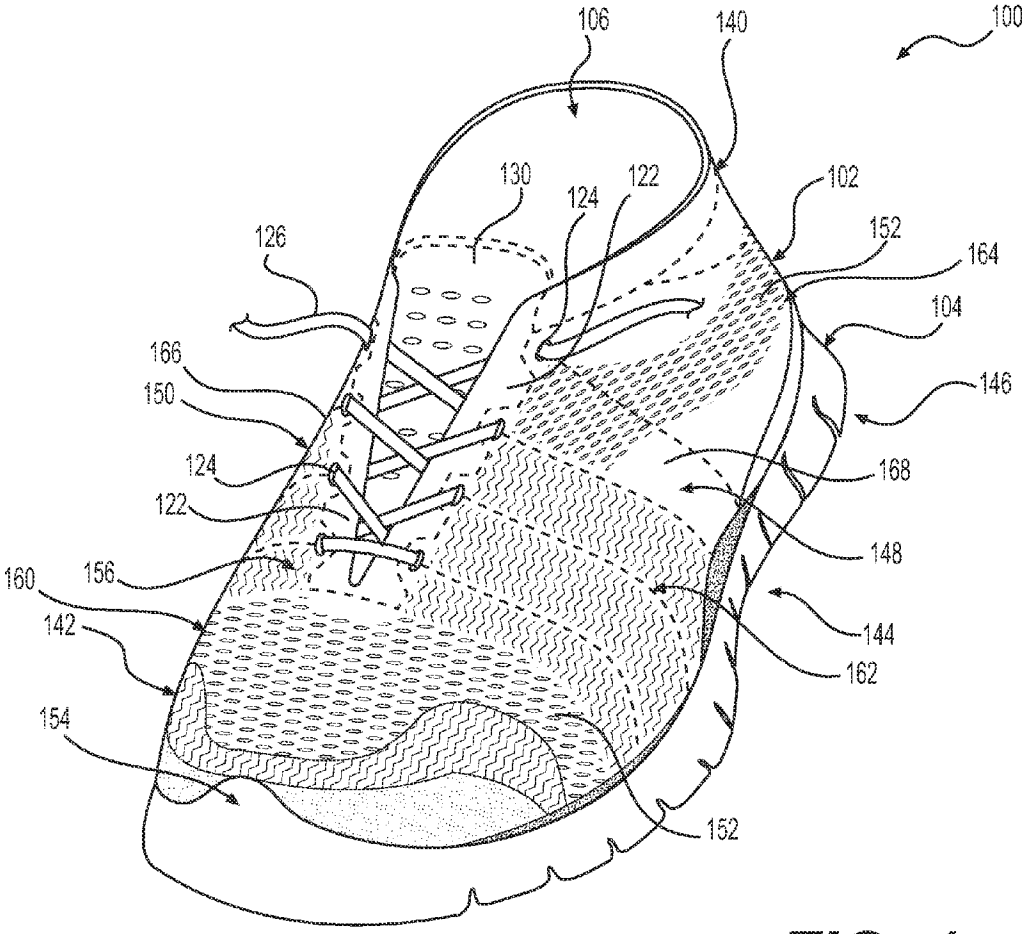
FIG. 1 is a schematic isometric view of an embodiment of an article of footwear incorporating a seamless bootie or textile upper.

The present detailed description generally describes embodiments of methods of making an article of footwear and articles of footwear made by such methods. In each embodiment the method generally includes knitting a knitted textile element of unitary warp knit construction having a first knit layer and a second knit layer that overlays the first knit layer. In each embodiment the method generally includes knitting a knitted textile element including a knitted component configured to form a seamless knitted bootie or textile upper of an article of footwear. In each embodiment the first knit layer and the second knit layer form a single continuous layer across a forefoot portion of the knitted bootie or textile upper and the seamless bootie or textile upper includes an interlayer knit stitch line that seamlessly connects the first knit layer and the second knit layer. A first section of this detailed description generally describes embodiments of methods for knitting a knitted textile element including a knitted component configured to form a seamless bootie or textile upper for an article of footwear. A second section of this detailed description generally describes embodiments of methods for knitting a knitted textile element including a knitted component having tucked-in portions. Specifically, the second section generally describes embodiments of methods for knitting a knitted textile element including a knitted component that includes a first knitted component portion that is configured to form a seamless bootie or textile upper and a second knitted component portion that is configured to be tucked-in or folded into an interior pocket of the seamless bootie or textile upper (i.e., the first knitted component portion), where the interior pocket is formed by the first knit layer and the second knit layer of the knitted textile element, and where the tucked-in portion (i.e., the second knitted component portion) is seamlessly associated with the first knit layer and the second knit layer of the seamless bootie or textile upper (i.e., the first knitted component portion) at an opening of the seamless bootie or textile upper that is configured to receive a foot. A third section of this detailed description generally describes embodiments of methods for knitting a knitted textile element including a knitted component having wrap-around portions. Specifically, the third section generally describes embodiments of methods for knitting a knitted textile element including a knitted component that includes a first knitted component portion that is configured to form a seamless bootie or textile upper and a second knitted component portion that is configured to be wrapped around at least a portion of the seamless bootie or textile upper (i.e., the first knitted component portion), where the wrap-around portion (i.e., the second knitted component portion) is seamlessly associated with the first knit layer and/or the second knit layer of the first knitted component portion at the interlayer knit stitch line of the first knitted component portion.

Seamless Bootie or Textile Upper Article of Footwear Configurations

This section generally describes embodiments of methods for knitting a knitted textile element including a knitted component that is configured to form a seamless bootie or textile upper for an article of footwear.

FIG. 1 is an isometric top front view of an embodiment of an article of footwear 100, also referred to as article 100. In some embodiments, article 100 may take the form of an athletic shoe or sports related footwear including, but not limited to: hiking boots, soccer shoes, football shoes, sneakers, running shoes, cross-training shoes, rugby shoes, basketball shoes, baseball shoes, as well as other kinds of athletic shoes or footwear. In some embodiments, article 100 may take the form of various kinds of non-sports related footwear including, but not limited to: slippers, sandals, high heeled footwear, loafers, as well as any other kind of footwear and/or apparel.

As shown in FIG. 1, in some embodiments article 100 may include an upper 102 and an optional sole structure 104. Sole structure 104 may be secured to upper 102 and extend between the foot and a ground surface when article 100 is worn. In some embodiments, sole structure 104 may be configured to provide traction for article 100. In some embodiments, sole structure 104 may be configured to absorb or attenuate impact or other ground reaction forces when compressed between the foot and the ground surface during walking, running, or other ambulatory activities.

The configuration of sole structure 104 may vary significantly in different embodiments to include a variety of known or newly developed sole structures and/or components. For example, sole structure 104 variously may include an outsole, a midsole, and/or an insole. In some cases, one or more of these components may be optional. In some cases, sole structure 104 itself may be optional. In some cases, the configuration of sole structure 104 may be selected to be suitable for one or more type of ground surface on which sole structure 104 may be used. Example ground surfaces may include, but are not limited to: natural turf, synthetic turf, dirt, sand, gravel, snow, ice, as well as other surfaces.

Upper 102 may be configured to receive and cover a foot. In some embodiments, upper 102 may include an opening 106 that provides entry to an interior of upper 102. For example, as shown in FIG. 1, in some embodiments opening 106 may be an ankle opening.

In some embodiments, upper 102 may include a fastening or closure structure or other provisions for tightening or otherwise adjusting fit characteristics (e.g., girth) of upper 102. For example, in some embodiments upper 102 may include tensioning members, such as lacing members 122 and eyelets 124 for receiving one or more lace or other tensioning member (such as a cable) 126. In this manner, a size of opening 106, and a corresponding girth of upper 102 may be adjusted to customize a fit of upper 102 and article of footwear 100. In some embodiments, lacing members 122 of the closure structure may provide reinforcing edge structure and form an opening having a V-shaped configuration, a U-shaped configuration, or another configuration. In some embodiments, as shown in FIG. 1, a closure structure having a V-shaped configuration may provide improved performance characteristics, such as comfort and fit. For example, in some cases a V-shaped closure configuration may enable tighter closure across a forefoot and/or instep region of upper 102 and article of footwear 100 without causing buckling in the forefoot region of the upper that may result from tightening a closure structure having a square or U-shaped configuration. In other embodiments, a closure system may provide reinforced edge structure at a terminal portion adjacent the forefoot region of upper 102. Those skilled in the art readily will be able to select a shape and configuration of a closure system suitable for desired fit and performance characteristics of upper 102 and article of footwear 100.

In some embodiments, upper 102 may include a tongue 130 (illustrated in phantom in FIG. 1). Tongue 130 may be disposed between a fastening or closure structure and a foot to facilitate comfort and fit. For example, tongue 130 may be disposed between lacing members 122 and a foot—between eyelets 124 and a foot—or between lacing 126 and a foot received in the interior of upper 102. It will be appreciated that a tongue may be optional in some embodiments.

In some embodiments, upper 102 may be substantially formed by a unitary knitted component 140 in the form of a seamless bootie that may extend through each of a forefoot region 142, a midfoot region 144, and a heel region 146, and along both a lateral side 148 and a medial side 150. This is in contrast to many known footwear uppers that are formed from multiple material elements (e.g., textiles, polymer foam, polymer sheets, leather, synthetic leather) that are joined through stitching or bonding, for example. In some embodiments, knitted component 140 may also include tongue 130. Knitted component 140 may form portions of both an exposed exterior surface and an opposite interior surface of upper 102. As such, knitted component 140 may define at least a portion of the void within upper 102. Knitted component 140 also extends under the foot. In some embodiments, article of footwear 100 may include a sole structure, and a portion of knitted component 140 may extend under the foot. In this construction, the knitted component may replace or function as a sock liner.

As described in further detail below, knitted component 140, which may form a substantial majority of upper 102, generally comprises a knit material, such as from a knitted textile element. As such, in some embodiments upper 102 may be substantially flexible and lightweight relative to some other known upper materials. Although some embodiments disclosed herein may illustrate an upper comprised entirely of a knit material, other embodiments of an upper may be only partially comprised of a knit material (or textile material).

In some embodiments, upper 102 may include one or more holes, apertures, perforations, openings, gaps, slots, or other such structures, hereafter generally referred to as holes. Upper 102 may include various groups of holes arranged in various configurations and in various locations, collectively referred to herein as plurality of holes 152. However, in some embodiments such holes may be optional. In some embodiments some holes may extend through the entire thickness of upper 102, while other holes may extend only partially through the thickness of upper 102. The particular number, sizes, shapes, alignment, and configurations of holes within plurality of holes 152 may vary from one embodiment to another. A specific configuration of plurality of holes 152 may be selected to achieve desired performance characteristics of upper 102, such as general or localized breathability of upper 102, and/or a general or localized stretching or pliability characteristic of upper 102. For example, larger numbers and/or larger sizes of holes may provide a greater localized or general pliability and stretching of a fabric. Alternatively, different patterns of holes, such as in'-line, staggered, or offset patterns, may provide different localized and/or general pliability, stretching, and/or ventilation characteristics. A specific configuration of plurality of holes 152 also may be selected to provide aesthetic appeal.

For purpose of reference, upper 102 and/or article of footwear 100 generally may be divided into a forefoot portion 160, a midfoot portion 162, and a heel portion 164. Forefoot portion 160 generally may be associated with a toe box for the toes and joints connecting the metatarsals with the phalanges. Midfoot portion 162 generally may be associated with the instep and/or arch of a foot. Heel portion 164 generally may be associated with the heel of a foot, including the calcaneus bone. Upper 102 also generally may include a lateral side portion 166 and a medial side portion 168. Lateral side portion 166 and medial side portion 168 may be opposing sides of upper 102. One or both of lateral side 166 and medial side 168 may extend through forefoot portion 160, midfoot portion 162, and heel portion 164. Some embodiments further may include a front toe portion 154 as well as a vamp or instep portion 156.

As used in this description, the terms forefoot portion or region, midfoot portion or region, heel portion or region, toe portion or region, and instep portion or region are only intended for purposes of description and are not intended to demarcate precise portions or boundaries of upper 102. Likewise, the terms lateral side (or lateral portion) and medial side (or medial portion) are intended to represent generally two sides of an article, rather than precisely demarcating upper 102 into two halves.

As noted above, upper 102 may be at least partially formed from a knitted component 140. Knitted component 140 may be removed from a knitted textile element that includes an approximately flat, two dimensional, layered construction that is configured to be separated (e.g., cut open) and formed or shaped to extend around the foot. As depicted in FIG. 1, in some embodiments knitted component 140 forms both an exposed exterior or outer side (or outer surface) of upper 102, facing away from the foot, and an interior or inner side (or inner surface) of upper 102 facing inward toward the foot.

As discussed in further detail below, knitted component 140 may be formed of unitary warp knit construction as a part of a larger knitted textile element. In this case, knitted component 140 may be removed from the larger knitted textile element and various features of knitted component 140 may be manipulated and/or treated to form a desired shape of upper 102.

In some embodiments, a single knitted textile element may include multiple knitted components, which may be removed to form separate components. For example, first and second knitted components of a single knitted textile element may correspond to a matching pair of left and right seamless booties or textile uppers for articles of footwear. Alternatively, first and second knitted components of a single knitted textile element may correspond to a seamless bootie or textile upper and an associated tongue or other accessory for an article of footwear. It will be appreciated that a knitted textile element may include addition numbers and/or kinds of knitted components.

Knitted component 140 may impart a variety of features or performance characteristics to upper 102. Knitted component 140 may provide a variety of advantages over some known upper configurations. As noted above, known footwear uppers may be formed from multiple material elements (e.g., textiles, polymer foam, polymer sheets, leather, synthetic leather) that are joined at one or more seams through stitching or bonding, for example. As the number and type of material elements incorporated into an upper increases, the time and expense associated with transporting, stocking, cutting, and joining the material elements may also increase. Waste material from cutting and stitching processes also may accumulate to a greater degree as the number and type of material elements incorporated into the upper increases. Uppers having a greater number of material elements may be more difficult to recycle than uppers formed from fewer types and numbers of material elements. Decreasing the number of material elements utilized in making the upper, therefore, may decrease waste while increasing manufacturing efficiency and recyclability of the upper. To this end, in some embodiments knitted component 140 may form a substantial portion of upper 102, thereby increasing manufacturing efficiency, decreasing waste, and simplifying recyclability.

Embodiments of upper 102 also may utilize one or more reinforced portions. As used in this disclosure, the term reinforced portion refers to any portion of an upper that incorporates any additional material(s) within one or more layers of knitted component 140. A reinforced portion may comprise separated layers of knitted component 140 that are filled with a reinforcing material, such as an insert member. An insert member may be selected based on a desired performance characteristic of the upper, such as leather or plastic for rigidity, or foam rubber for cushioning. An insert member may be located in a particular region of an upper to provide a localized or general performance characteristic to the region or upper. A reinforced portion may impart increased strength and/or reinforcement for the upper, and/or increased cushioning and comfort, depending on the insert material used. For example, in some embodiments a tongue 130 may include a two layer knitted component having an insert member (or reinforcing portion) that is a foam material inserted between two layers of the knitted component. In some embodiments a toe or heel region may include an insert member (or reinforcing portion) in the form of a toe or heel cap that is a rigid material inserted between layers of the knitted component or between a layer and a strap or other knitted structure of the knitted component.

Knitted component 140 may be formed of unitary warp knit construction using a warp knitting machine and a warp knitting process. In some embodiments, a flat warp knitting machine may be used to form a knitted component of unitary warp knit construction. In some embodiments, knitted component 140 may be formed as a tubular textile of unitary knit construction using a warp knitting machine having two sets of needles.

As used herein and in the claims, a knitted component is defined as being formed of "unitary knit construction" when formed as a one-piece element through a knitting process. That is, the knitting process substantially forms the various features and structures of a knitted component without the need for significant additional manufacturing steps or processes. A unitary knit construction may be used to form a knitted component having structures or elements that include one or more courses or wales of yarn or other knit material that are joined such that the structures or elements include at least one course or wale in common (i.e., sharing a common yarn) and/or include courses or wales that are substantially continuous between each of the structures or elements. With this arrangement, a one-piece element of unitary knit construction is provided. In embodiments where a warp knitting process is used to form a knitted component, the knitted component may be formed of unitary warp knit construction and may have structures or elements that include one or more wales of yarn or other knit material that are joined such that the structures or elements include at least one wale in common (i.e., sharing a common yarn) and/or include wales that are substantially continuous between each of the structures or elements.

As used in this disclosure, yarn is generally defined as an assembly having a substantial length and relatively small cross-section that is formed of at least one filament or a plurality of fibers. A filament may have an indefinite length and may be used alone or in combination with one or more other filaments to produce a yarn suitable for use in textiles. Modern filaments include a plurality of synthetic materials such as rayon, nylon, polyester, and polyacrylic, with silk being the primary, naturally-occurring exception. Fibers may have a relatively short length and require spinning or twisting processes to produce a yarn of suitable length for use in textiles. Examples of fibers include cotton and wool. Yarn may be formed of a single filament, which is conventionally referred to as a monofilament yarn, or a plurality of individual filaments grouped together. Yarn may include separate filaments formed of different materials. Yarn may include filaments that are each formed of two or more different materials. Similar concepts apply to yarns formed from a plurality of fibers. Accordingly, yarns may have a variety of configurations that generally conform to the definition provided above. Those skilled in the art will be able to select one or more known or later developed yarn(s) suitable for a desired application based on characteristics of the yarn and a desired performance characteristic of the knitted component 140.

Knitted component 140 may incorporate various types of yarn that impart different properties to separate areas of upper 102 and/or tongue 130. That is, one portion of knitted component 140 may be formed from a first type of yarn that imparts a first set of properties, and another portion of knitted component 140 may be formed from a second type of yarn that imparts a second set of properties. In this configuration, properties may vary throughout upper 102 and/or tongue 130 by selecting specific yarns for different portions of knitted component 140. The properties that a particular type of yarn will impart to a portion of knitted component 140 partially depends upon the materials that form the various filaments and fibers within the yarn. Cotton, for example, provides a soft hand, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is a durable and abrasion-resistant material with relatively high strength. Polyester is a hydrophobic material that also provides relatively high durability.

In addition to materials, other aspects of the yarn(s) selected for knitted component 140 may affect the properties of upper 102 and/or tongue 130. For example, a yarn forming knitted component 140 may be a monofilament yarn or a multifilament yarn. The yarn may include separate filaments that are each formed of different materials. The yarn may include filaments that are each formed of two or more different materials, such as a bicomponent yarn with filaments having a sheath-core configuration or two halves formed of different materials. Different degrees of twist and crimping, as well as different deniers, may also affect properties of upper 102 and/or tongue 130. Accordingly, both the materials forming the yarn(s) and other aspects of the yarn(s) may be selected to impart a variety of properties to separate areas of upper 102 and/or tongue 130.

Generally, a textile may be formed from one or more yarns that are mechanically-manipulated through either an interweaving, intertwining and twisting, or interlooping process, for example. Interweaving is the intersection of two yarns that cross and interweave at right angles to each other. Yarns utilized in interweaving are conventionally referred to as warp and weft. Intertwining and twisting encompasses procedures such as braiding and knotting where yarns intertwine with each other to form a textile. Interlooping involves the formation of a plurality of columns of intermeshed loops, with knitting being a common method of interlooping. A textile element may, therefore, be formed from one of these processes for manufacturing a textile. In some embodiments, a knitted textile element may be formed using a knitting process.

A variety of mechanical processes have been developed to manufacture a textile through knitting. In general, mechanical processes may be classified as either warp knitting or weft knitting. As used in this description, warp knitting refers to a type of knitting method in which a yarn zigzags along the length of the textile, i.e., following adjacent columns or wales of knitting, rather than along a single row or course. For comparison, as used in this description weft knitting refers to knitting across the width of the textile. Various specific sub-types of warp knitting that may be utilized to manufacture a textile include tricot, raschel, and double needle-bar raschel (which further includes jacquard double needle-bar raschel).

In some embodiments, a knitted textile element may be manufactured using a warp knitting process. Thus, in some embodiments a knitted component 140 included in a knitted textile element of warp knit construction may comprise a warp knit material (e.g., knitted component 140 may be a warp knitted component). Using a warp knitted textile element may help reduce the tendency of periphery or exposed edges of knitted component 140 to unravel as a result of knitted component 140 being removed or otherwise separated, e.g., cut out, from a knitted textile element. In an exemplary embodiment, a knitted textile element may be formed of unitary knit construction through a warp knitting process and may include one or more knitted components, including one or more uppers and/or tongues, formed together on the same knitted textile element.

In some embodiments, a knitted textile element may be manufactured using different yarns to form one side and another side. For example, in some embodiments a knitted textile element may be manufactured using different yarns to form an exposed outer side and an inner side. By using distinct yarns on the exposed outer side and the inner side, a knitted textile element can be manufactured to have different knitting configurations on the exposed outer side and the inner side. For example, in some cases a particular configuration of yarns on the exposed outer side may be different from the configuration of yarns on the inner side. These differences can include, but are not limited to, one or more of: differences in knitting patterns, differences in knitted structures, differences in types of yarn used, differences in colors of yarns used, and/or differences in material properties of yarns used (e.g., different materials selected to provide a softer interior or inner side and a durable exposed outer side).

In some embodiments, a knitting configuration for an outer side may be provided to impart a greater degree of durability, strength, and/or wear or abrasion resistance to the exposed outer side of a knitted component 140. For example, a yarn having a heavier denier or being made of a stronger or more durable material may be used for the knitting configuration on the exposed outer side to provide a greater degree of durability, strength, and/or wear or abrasion resistance. Similarly, in some embodiments, a knitting configuration for an inner side may be provided to impart a greater degree of comfort or softness so as to serve as an interior lining of the upper 102. For example, a yarn having a lighter denier or being made of a material that is soft to the touch may be used for the knitting configuration on the interior or inner side to provide a greater degree of comfort or softness. With a desired selection of knitting configurations for each of an exposed outer side and an inner side of a knitted component, desired characteristics may be selectively provided to the upper.

Figure 2:
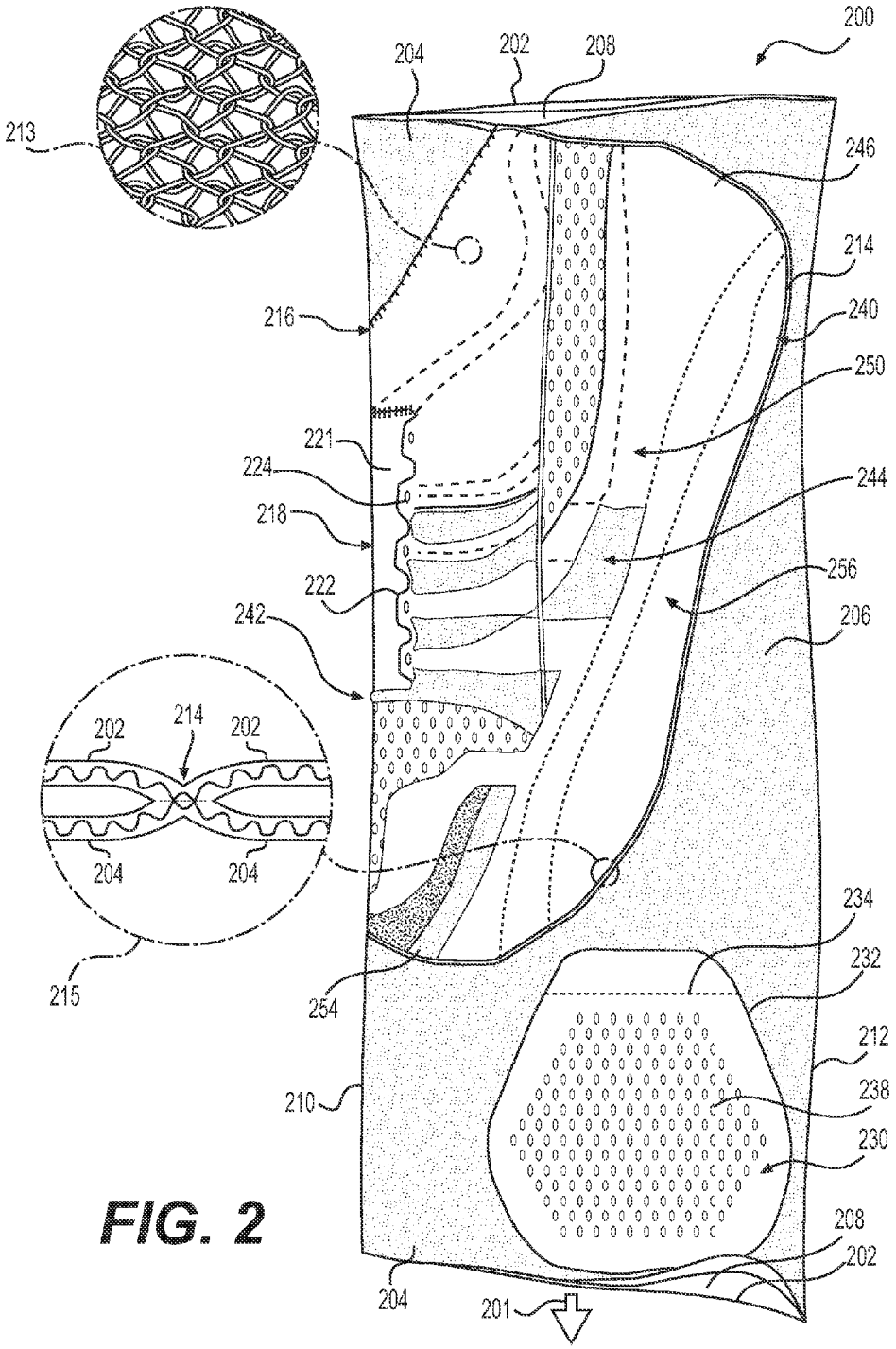
FIG. 2 is a schematic plan view of an embodiment of a knitted textile element including knitted components, pre-removal, in which features of a warp knit stitch and interlayer warp knit stitch line of the knitted textile element are shown in detail.
Figures 3, 4, 5, 6:
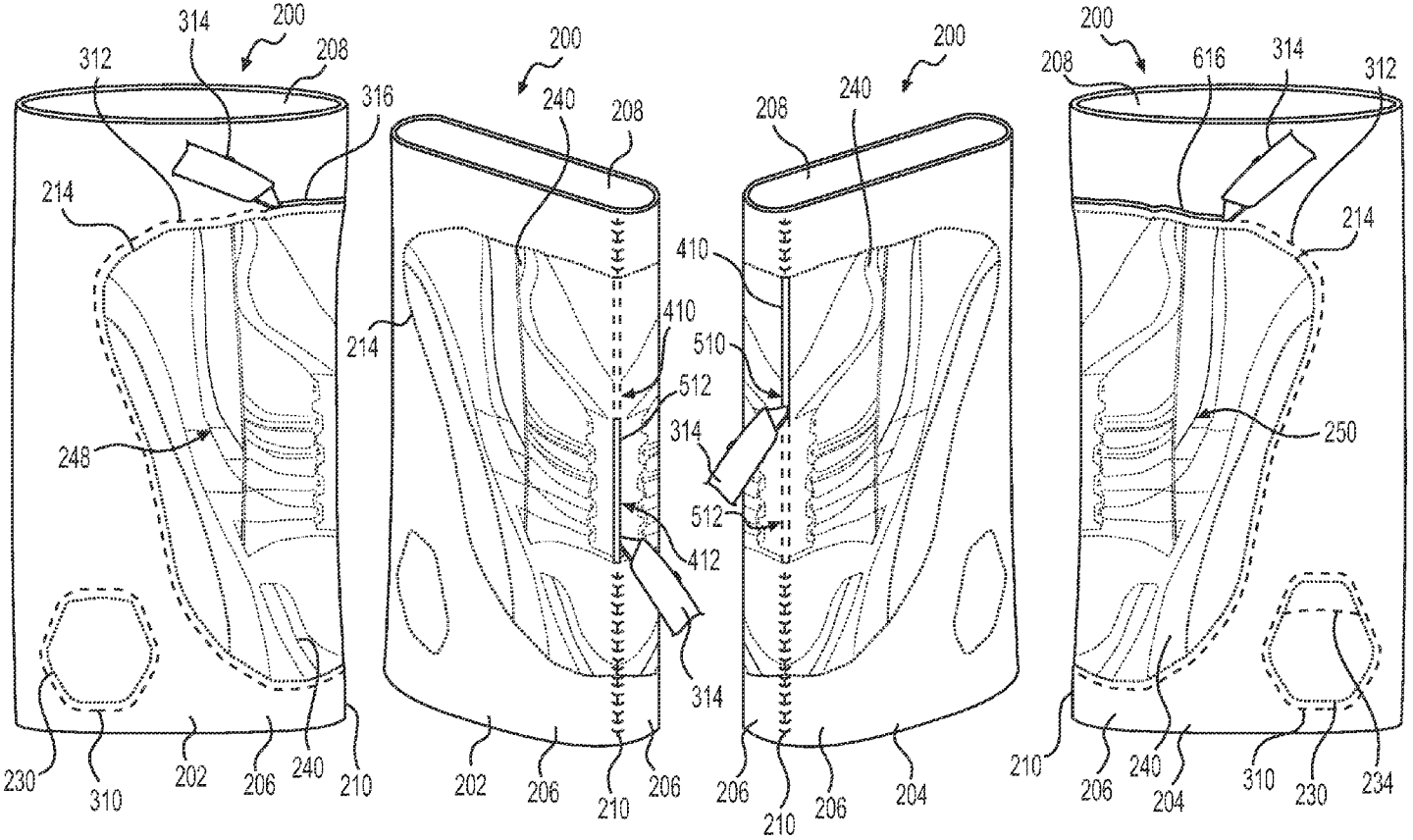
FIG. 3 schematically illustrates the knitted textile element of FIG. 2 in a medial isometric view.
FIG. 4 schematically illustrates the knitted textile element of FIG. 2 in a medial isometric edge view.
FIG. 5 schematically illustrates the knitted textile element of FIG. 2 in a lateral isometric edge view.
FIG. 6 schematically illustrates the knitted textile element of FIG. 2 in a lateral isometric view.

FIGS. 2 to 6 illustrate schematic views of an embodiment of a knitted textile element including knitted components in a pre-removal state or condition. FIG. 2 is a schematic plan view of an embodiment of a knitted textile element 200 including knitted components 230 and 240, pre-removal, in which features of a warp knit stitch 213 and an interlayer warp knit stitch line 214 of the knitted textile element are schematically shown in enlarged detail views 213 and 215, respectively. FIGS. 3 to 6 schematically illustrate knitted textile element 200 in rotational sequence from a medial isometric view to a lateral isometric view, where FIG. 3 is a medial isometric view, FIG. 4 is a medial isometric edge view, FIG. 5 is a lateral isometric edge view, and FIG. 6 is a lateral isometric view. It will be appreciated that FIGS. 3 to 6 are schematic views intended for illustrating certain features of the knitted textile element. FIGS. 2 to 6 illustrate knitted textile element 200 as a continuous knit layer (e.g., a tubular knitted textile element) to facilitate illustration and discussion of certain features, such as features along a common edge of a two-layer knitted textile element (FIGS. 4 and 5), and certain processes that may be used in some embodiments. In some embodiments, however, knitted textile element 200 may not have a general tubular configuration.

Knitted textile element 200 may be a knitting product of a warp knitting machine and warp knitting process. Knitted textile element 200 may be a generally flat, two-dimensional structure that includes a first layer 202 and a second layer 204 that overlays the first layer 202. In some embodiments, knitted textile element 200 may be formed as a tubular textile using a warp knitting machine having two sets of needles. In some embodiments, knitted textile element 200 may be warp knitted in a single knitting process that progresses in a feed direction of arrow 201. In some embodiments, knitted textile element 200 is of unitary warp knit configuration.

In the tubular configuration of FIGS. 2 to 6, first layer 202 and second layer 204 have a common, continuous first surface 206 that initially is exposed as a result of the warp knitting process, and a common second surface 208 that initially is not exposed as a result of the warp knitting process. In particular, exposed first surface 206 of first layer 202 and exposed first surface 206 of second layer 204 are continuous around an outside surface of common edge 210 of tubular knitted textile element 200. Likewise, initially non-exposed second surface 208 of first layer 202 and initially non-exposed second surface 208 of second layer 204 are continuous around an inside or interior side surface of common edge 210. As shown in FIGS. 2 to 6, in some embodiments initially exposed first surface 206 and initially non-exposed surface 208 also may be continuous around a second common edge 212 opposite common edge 210. In some embodiments, initially exposed first surface 206 and initially non-exposed surface 208 may be dis-continuous at second edge 212. It will be appreciated that the term common edge as used in this description refers to a generally continuous layer that transitions between opposite sides along a line or fold, for example by being turned back or folded back onto itself, that serves as a shared boundary or perimeter between the opposite sides to form the common edge, and that does not indicate a discontinuous surface or contour between the opposite sides.

Knitted textile element 200 includes an interlayer knit stitch line between the first layer 202 and second layer 204. For example, as shown in FIG. 2, in some embodiments knitted textile element 200 may include an interlayer knit stitch line 214 located at a periphery of knitted component 240, and an interlayer knit stitch line 232 located at a periphery of knitted component 230. FIG. 2 includes an enlarged schematic view 215 of interlayer knit stitch line 214 between first knit layer 202 and second knit layer 204 at a forefoot portion of knitted component 240. As shown at 215, interlayer knit stitch line 214 includes interlayer knitting stitches between first knit layer 202 and second knit layer 204, where at least one yarn of first knit layer 202 is interlooped with at least one yarn of second knit layer 204 at an interface of first knit layer 202 and second knit layer 204. In some embodiments, multiple yarns of first knit layer 202 and/or multiple yarns of second knit layer 204 may be interlooped at interlayer knit stitch line 214.

Knitted textile element 200 is a textile material from which knitted components 230 and 240 may be removed. Knitted components 230 and 240 may be removed by any known or later developed removal method. For example, knitted components 230 and 240 may be removed or separated by cutting, stamping, or any other method for separating the knitted component from the larger knitted textile element 200 or any excess material of knitted textile element 200. In some embodiments, knitted components 230 and 240 may be removed by separating the knitted components 230 and 240 from textile element 200 using a cutting process or other separating process along interlayer knit stitch line 214. It will be appreciated that, since first knit layer 202 and second knit layer 204 are interconnected along interlayer knit stitch line 214 and interlayer knit stitch line 232 using a warp knitting process, separating knitted textile element 200 along interlayer knit stitch lines 214 and 232 may not cause unravelling of knitted components 230 and 240 along a separated or cut edge.

FIGS. 3 to 6 illustrate a process for removing or separating knitted components 230 and 240 from knitted textile element 200 using optional knitted indicating portions. In some embodiments, knitted components 230 and 240 may be removed or separated from knitted textile element 200 using one or more optional knitted indicating portions. FIG. 3 illustrates a knitted indicating portion 310 provided around an outer periphery or outline of knitted component 230 corresponding to a tongue. FIG. 3 illustrates a knitted indicating portion 312 provided around an outer periphery or outline of knitted component 240 corresponding to a seamless bootie or textile upper, such as knitted component 140 of upper 102 shown in FIG. 1.

Knitted component 230 may be removed or separated from knitted textile element 200 by separating knitted textile element 200 along knitted indicating portion 310. Knitted component 240 may be removed or separated from knitted textile element 200 by separating knitted textile element 200 along knitted indicating portion 312. It will be appreciated that, since first knit layer 202 and second knit layer 204 are interconnected along interlayer knit stitch line 214 and interlayer knit stitch line 232 using a warp knitting process, separating knitted textile element 200 along knitted indicating portions 310 and 312 may not cause unravelling of knitted components 230 and 240 along the separated or cut edge. Moreover, providing knitted indicating portions 310 and 312 along an outer periphery of knitted components 230 and 240 may provide a controlled spacing between interlayer knit stitch lines 214 and 323 and respective separated or cut edges along knitted indicating portions 310 and 312. It will be appreciated that this controlled spacing may further assist in preventing any unravelling of knitted components 230 and 240 along their peripheral edges.

FIGS. 3 to 6 illustrate process for removing or separating knitted components from knitted textile element using a cutting tool 314, such as a knife. FIG. 3 illustrates a process of separating knitted component 240 from knitted textile element 200 by cutting first knit layer 202 of knitted textile element 200 along knitted indicating portion 312 to form separation or cut line 316. Similarly, FIG. 6 illustrates a process of separating knitted component 240 from textile element 200 by cutting second knit layer 204 of knitted textile element 200 along knitted indicating portion 312 to form separation or cut line 616. Since first knit layer 202 and second knit layer 204 are interconnected along interlayer knit stitch line 214, it will be appreciated that in some embodiments first knit layer 202 and second knit layer 204 may be separated or cut in a single simultaneous separating or cutting process.

FIGS. 4 and 5 illustrate processes for separating portions of knitted component 240 to form an opening in knitted component 240. FIG. 4 illustrates a knitted indicating portion 410 (illustrated as double dashed lines) located along common edge 210, and FIG. 5 illustrates a process of separating knitted component 240 along knitted indicating portion 410 using a cutting process to form separation or cut line 510, corresponding to an ankle opening of knitted component 240. Similarly, FIG. 5 illustrates a knitted indicating portion 512 (illustrated as double dashed lines), and FIG. 4 illustrates a process of separating knitted component 240 along knitted indicating portion 512 using a cutting process to form a separation or cut line 412 corresponding to an opening of a closure system. In some embodiments, as shown in FIGS. 4 and 5, knitted indicating portion 410 and/or knitted indicating portion 412 may be substantially formed along straight lines. In some embodiments, knitted indicating portion 410 and/or knitted indicating portion 412 may not be formed along a straight line, but may have regular or non-regular geometric configurations. For example, in some embodiments knitted indicating portion 410 may be a contoured curved line configured to provide a contoured ankle opening. In some embodiments, knitted indicating portion 412 may be a line having a scalloped configuration outlining a series of lacing members. In some embodiments, knitted indicating portion 410 and knitted indicating portion 412 may be continuous, and in some embodiments knitted component 240 may be separated along knitted indicating portions 410 and 412 in a single continuous cutting process or other separating process. In some embodiments, knitted indicating portion 412 may be optional (i.e., no closure structure). Those skilled in the art readily will appreciate various configurations for knitted indicating portions suitable for forming a desired ankle opening and any optional closure structure for a desired upper configuration.

In the configuration of FIGS. 2 to 6, knitted textile element 200 (and, accordingly, knitted components 230 and 240) has a generally flat, two-layer, two-dimensional configuration that comprises one or more yarns knitted together. In some embodiments, knitted textile element 200 may have a generally tubular configuration. In some embodiments, knitted textile element 200 may have an open or discontinuous configuration along a second common edge 212 of knitted textile element 200. In some embodiments, e.g., as disclosed in FIGS. 23 and 24 below, first layer 202 and second layer 204 may have a generally continuous interlayer knitting stitching over at least a portion of an area or region outside a periphery or outline of a knitted component.

Knitted component 240 may include various portions that correspond to portions or regions of a seamless bootie or textile upper 102 as shown in FIG. 1. For example, knitted component 240 may include a forefoot portion 242, a midfoot portion 244, and a heel portion 246 that may correspond to forefoot portion 142, midfoot portion 144, and heel portion 146, respectively, of knitted component 140 of upper 102 in FIG. 1. Likewise, for example, lateral side portion 248 may correspond to lateral side 148 of knitted component 140 of upper 102, and medial side portion 250 may correspond to medial side 150 of knitted component 140 of upper 102.

Figure 7:
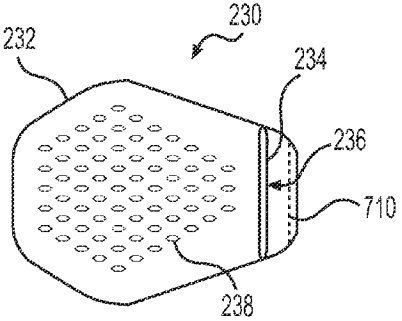
FIG. 7 is a schematic plan view of a knitted component, post removal, of FIG. 2 for a tongue.

FIG. 7 is a schematic plan view of knitted component 230 of FIG. 2, post removal, corresponding to a tongue. Knitted component 230 is of unitary warp knit construction. In some embodiments, knitted component 230 may include a first knit layer 202, a second knit layer 204, and an interlayer knit stitch line 232 that defines a perimeter or outline of knitted component 230. Because knitted component 230 is of unitary warp knit construction defined at its perimeter by interlayer knit stitch line 232, knitted component 230 may have a stable knit construction that will not unravel at its perimeter edges when separated and removed from knitted textile element 200. Knitted component 230 may include a knitted indicating portion 234 indicating a separating line for creating an opening 236 in knitted component 230. In this manner, a void or pocket may be formed in an interior of knitted component 230. In some embodiments, knitted component 230 optionally may be turned inside out through opening 236. In this case an initially exposed external surface 206 of knitted component 230 may be interchanged with an initially non-exposed interior surface 208 of knitted component 230. In some embodiments, initially exposed surface 206 may have a different finish and/or aesthetic characteristic than initially non-exposed surface 208. In either case, an optional insert member (not shown), e.g., made of a foam material, may be inserted through opening 236 into an internal void or pocket formed between the first knit layer 202 and the second knit layer 204 of knitted component 230, to modify a cushioning characteristic of the tongue. Knitted component 230 may be provided with plurality of holes 238. In some embodiments, plurality of holes 238 may be provided in first knit layer 202 and in second knit layer 204. In some embodiments, plurality of holes 238 may be optionally provided in either first knit layer 202 or second knit layer 204. Plurality of holes 238 may be formed by knitting process or by separating knitted component 230, e.g., at knitted indicating portions corresponding to plurality of holes 238. It will be appreciated that plurality of holes 238 may provide improved general and/or local ventilation characteristic. Plurality of holes 238 also may provide a desired aesthetic characteristic.

Figure 8:
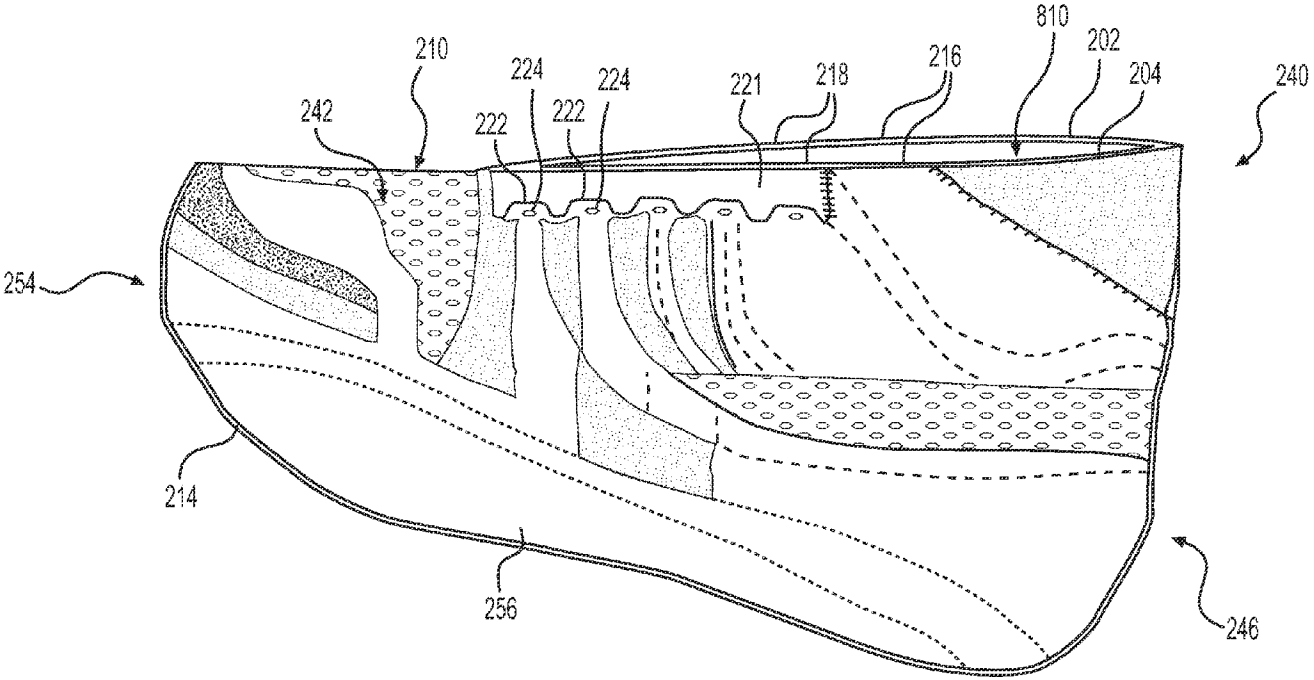
FIG. 8 is a schematic plan view of a knitted component, post removal, of FIG. 2 for an upper in the form of a seamless bootie.

FIG. 8 is a schematic plan view of a knitted component 240 of FIG. 2, post removal, corresponding to a seamless bootie or textile upper of an article of footwear. For example, in some embodiments knitted component 240 may correspond to knitted component 140 of upper 102 in FIG. 1. Knitted component 240 is of unitary warp knit construction. Knitted component 240 generally includes first knit layer 202 forming a medial side of knitted component 240 and second knit layer 204 forming a lateral side of knitted component 240. First knit layer 202 and second knit layer 204 of knitted component 240 are continuous across forefoot portion 242, including common edge portion 210. Knitted component 240 includes an interlayer knit stitch line 214 that interconnects first knit layer 202 and second knit layer 204 along a peripheral portion of knitted component 240. In some embodiments, as shown in FIGS. 2 and 8, interlayer knit stitch line 214 may extend around a front toe portion 254 of knitted component 240, across a bottom portion 256 of knitted component 240, and around heel portion 246 of knitted component 240.

Knitted component 240 may have an ankle opening 810 that is defined by edges 216, corresponding to knitted indicating portion 410 and separation line 510, and a closure structure 221 that is defined by edges 218, corresponding to knitted indicating portion 412 and separation line 512. In some embodiments, closure structure 221 may include lacing members 222 and eyelet holes 224. Lacing members 222 may include reinforced structure of knitted component 240 produced by a knitting configuration or yarn selected to provide a strong, durable textile characteristic. A specific configuration of closure structure 221, e.g., including lacing members 222 and eyelet holes 224, may be provided by selecting a knitting configuration of knitted component 240. For example, in some embodiments an eyelet hole 224 may be formed by selecting a knitting configuration of knitted component 240 including a knitted hole having a desired size and shape. Alternatively, in some embodiments a knitting configuration for an eyelet hole 224 may include a knitted indicating portion that indicates a location for separating knitted component 240 to form eyelet hole 224.

In some embodiments, knitted component 240 as removed or separated from knitted textile element 200 may be directly manipulated or stretched to form a seamless bootie or textile upper in its final form. In some embodiments, however, prior to being manipulated or stretched to form a final seamless bootie or textile upper, knitted component 240 may be inverted, or turned inside-out, to present an alternative finish surface for the seamless bootie or textile upper.

FIGS. 9 to 13 schematically illustrate an optional inversion process for a knitted component 240 of FIG. 8 (i.e., for turning knitted component 240 inside-out post removal). Because knitted component 240 is formed of a unitary warp knit construction, including an exposed peripheral edge that is defined in part by separating (e.g., cutting) along interlayer knit stitch line 214, knitted component 240 generally provides a stable knit construction that will not unravel at the separated peripheral edge. Nevertheless, in some embodiments knitted component 240 may be inverted to interchange the initially exposed exterior surface 206 of the first and second layers 202 and 204 and the initially non-exposed interior surface 208 to present a clean (i.e., unseparated or uncut) portion of the interlayer knit stitch line 214 as an exterior peripheral surface of knitted component 240. As noted above, in some embodiments the initially exposed exterior surface 206 and the initially non-exposed interior surface 208 may have different finishes or other characteristics. Inverting knitted component 240 enables presentation of an initially non-exposed interior surface 208 as a final exposed external surface of knitted component 240 (and resulting article of footwear 100).

Figure 9:
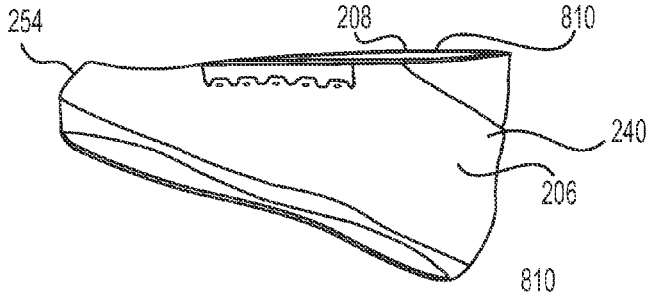
FIG. 9 illustrates a knitted component of FIG. 8 in an initial post removal state.

FIG. 9 illustrates knitted component 240 in an initial post removal state. For purposes of distinguishing the two surface in this description, in FIGS. 9-13 initially exposed exterior surface 206 is shown without substantial shading and initially non-exposed internal surface 208 is shown with substantial shading. In some embodiments, initially exposed external surface 206 and initially non-exposed internal surface 208 may have same or similar characteristics. In some embodiments, initially exposed external surface 206 and initially non-exposed internal surface 208 may have substantially different characteristics.

Figure 10:
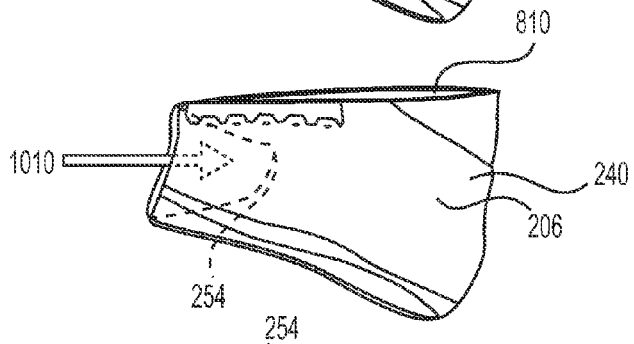
FIG. 10 illustrates the knitted component of FIG. 9 with a toe portion inverted into an internal void of the knitted component.

FIG. 10 illustrates knitted component 240 with front toe portion 254 inverted, i.e., front toe portion 254 is shown in phantom to schematically illustrate that front toe portion 254 is pushed into an internal void or space between first knit layer 202 and second knit layer 204 of knitted component 240, as indicated by arrow 1010.

Figure 11:
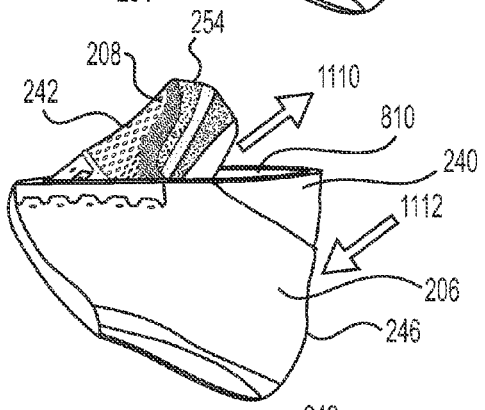
FIG. 11 illustrates the knitted component of FIG. 10 with an inverted toe portion protruding through an ankle opening.

FIG. 11 illustrates knitted component 240 with an inverted front toe portion 254 being pulled through ankle opening 810, as indicated by arrow 1110, and heel portion 246 being pushed forward over front toe portion 254, as indicated by arrow 1112.

Figure 12:
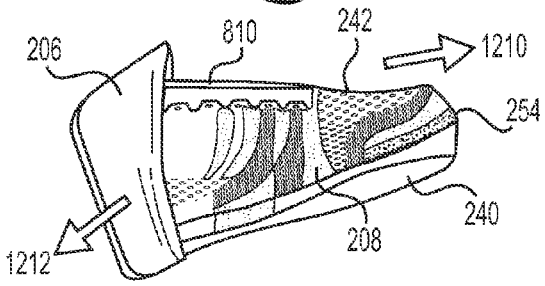
FIG. 12 illustrates the knitted component of FIG. 11 with inverted toe and instep portions protruding through the ankle opening.

FIG. 12 illustrates knitted component 240 with front toe and forefoot portions 244, 254 protruding through, and being pulled through ankle opening 810, as indicated by arrow 1210, and heel portion 246 being pushed down over front toe portion 254 and forefoot portion 244, as indicated by arrow 1212. In FIG. 12, the inversion process is substantially complete.

Figure 13:
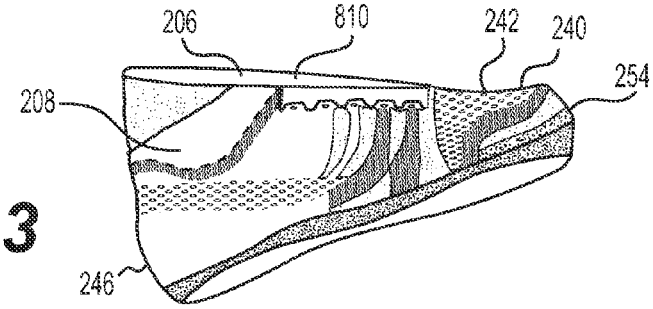
FIG. 13 illustrates the knitted component of FIGS. 9 to 12 fully inverted or turned inside-out.

FIG. 13 illustrates knitted component 240 fully inverted, i.e., turned inside-out from its initially removed or separated state. As schematically illustrated by multiple shading in FIGS. 9 to 13, knitted component 240 may have substantially different finish and aesthetic characteristics on the initially exposed external surface (final internal surface) 206 and the initially non-exposed internal surface (final exposed outside surface) 208. In some embodiments, different shading may represent different knitting stitches, such as a loose or tight knitting configuration. In some embodiments, different shading may represent different size or shape of holes, such as large or small knitted holes. In some embodiments, different shading may represent different aesthetic characteristics. In some embodiments, different shading may represent different knitting stitches corresponding to different knitted indicating portions. In some embodiments, different shading may represent different yarn material(s). In some embodiments, different shading may represent different yarn or textile fabric treatment(s), such as yarns treated with a substance that enables material memory and untreated yarns. Those skilled in the art readily will appreciate that, in this manner, any desired surface characteristics may be indicated and provided on either an exposed external surface or an internal surface.

Figures 14, 15, 16:
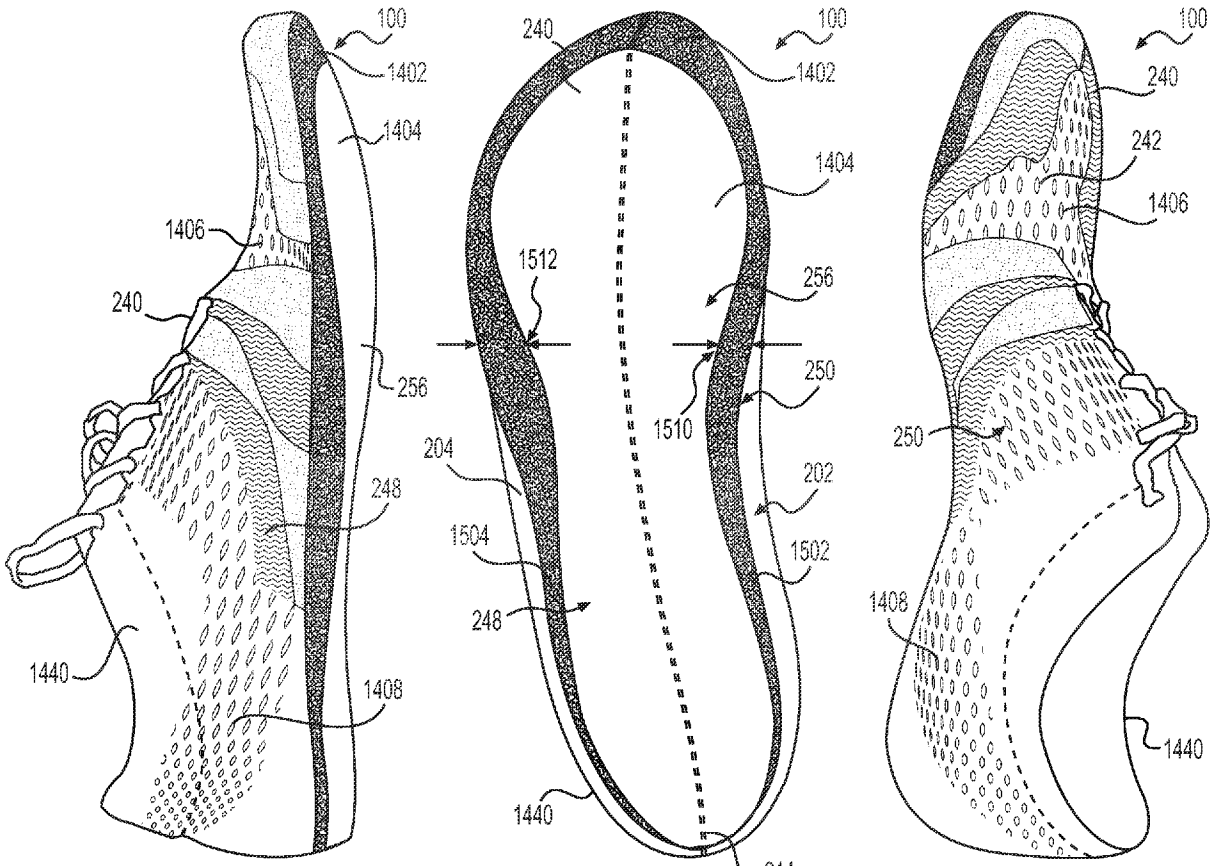
FIG. 14 schematically illustrates an embodiment of an article of footwear in the form of a seamless bootie or textile upper formed from a knitted component of FIG. 8 in a lateral isometric view.
FIG. 15 schematically illustrates an embodiment of an article of footwear in the form of a seamless bootie or textile upper formed from a knitted component of FIG. 8 in a bottom isometric plan view.
FIG. 16 schematically illustrates an embodiment of an article of footwear in the form of a seamless bootie or textile upper formed from a knitted component of FIG. 8 in a medial isometric view.
Figure 17:
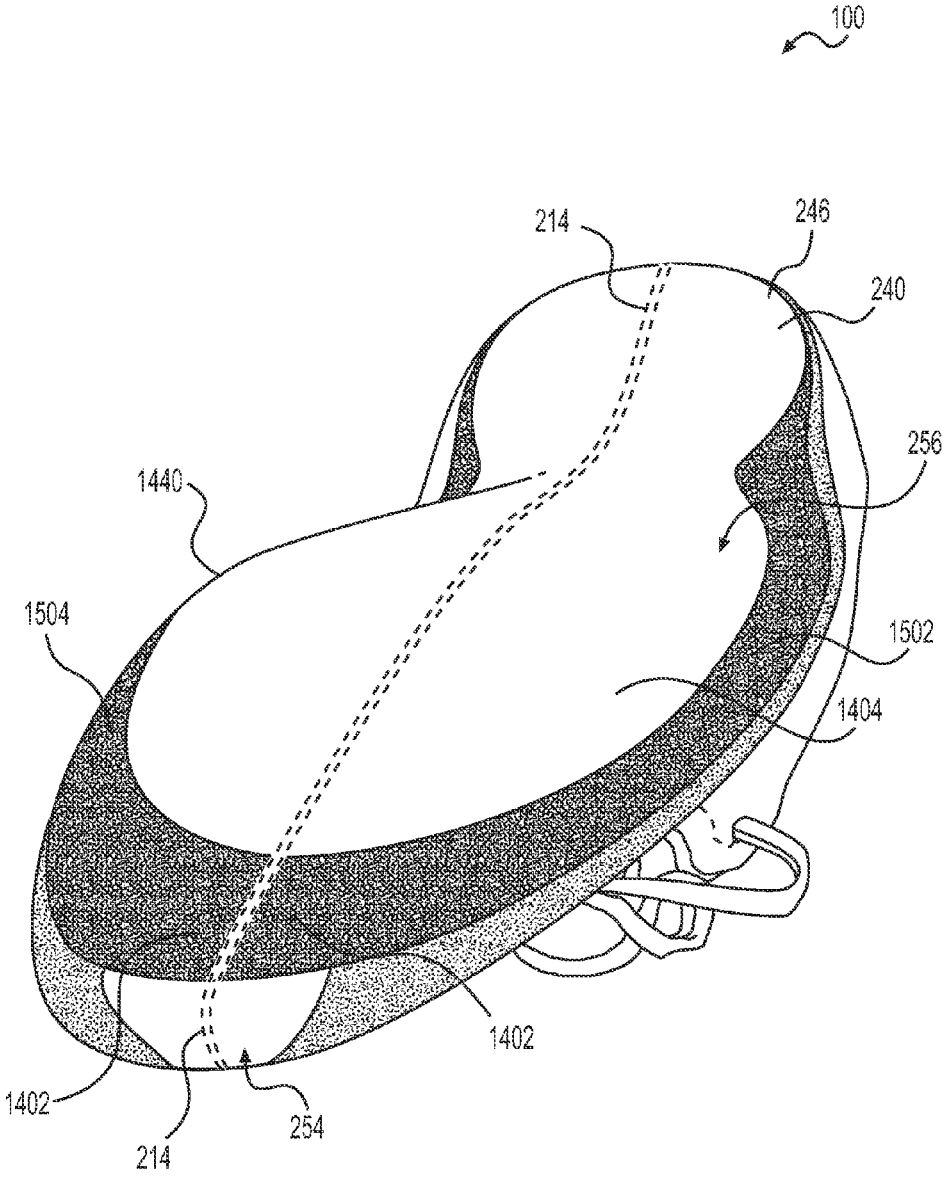
FIG. 17 is a schematic isometric bottom front view of an embodiment of an article of footwear in the form of a seamless bootie or textile upper formed from a knitted component of FIG. 8.
Figure 18:
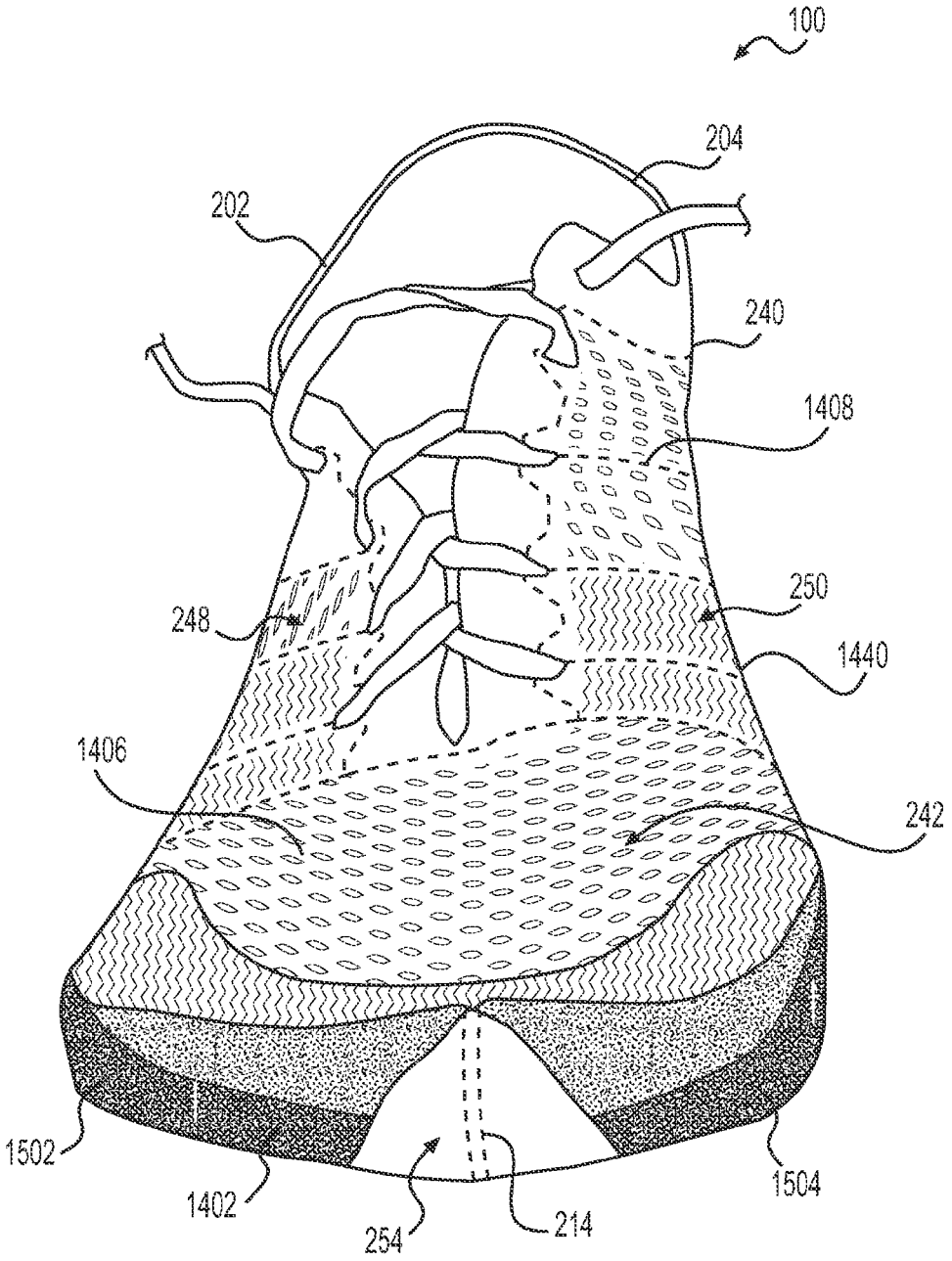
FIG. 18 is a schematic isometric top front view of an embodiment of an article of footwear in the form of a seamless bootie or textile upper formed from a knitted component of FIG. 8.

FIGS. 14 to 18 schematically illustrate an embodiment of an article of footwear 100 in the form of a seamless bootie or textile upper 1440. In some embodiments, seamless bootie or textile upper 1440 may correspond to knitted 140 of FIG. 1 or knitted component 240 of FIGS. 2 and 8. FIGS. 14 to 16 illustrate a seamless bootie or textile upper 1440 in rotational sequence from a medial isometric view (FIG. 14), to a bottom isometric plan view (FIG. 15), to a lateral isometric view (FIG. 16); FIG. 17 is a schematic isometric bottom front view of the textile upper; and FIG. 18 is a schematic isometric top front view of the textile upper.

In some embodiments, knitted component 240 may be manipulated to form seamless bootie or textile upper 1440 having a desired configuration, at least including size and shape. In some embodiments, one or more portions of knitted component 240 may be stretched to form seamless bootie or textile upper 1440 having a desired configuration, at least including size and shape. In some embodiments, knitted component 240 may be stretched over a last corresponding to a seamless bootie or textile upper 1440 having a desired size and shape generally corresponding to either a particular foot or a standard foot size. For example, the last may have a desired length, width, girth, and/or volume.

Knitted component 240 may include one or more portions or zones having knitting stitches or a knitting configuration selected to enable the portion to stretch to a desired configuration for seamless bootie or textile upper 1440. For example, in some embodiments a portion or zone of knitted component 240 may be provided with plurality of holes in a stretch zone. In some embodiments, knitted component 240 may include a portion or zone that has loose knitting stitches or a loose knitting configuration to form a stretch zone. In some embodiments, a stretch zone of knitted component 240 may be configured to stretch more than other portions of knitted component 240, i.e., relatively more than other portions of knitted component 240, to facilitate forming the knitted component 240 into seamless bootie or textile upper 1440 having a desired size and shape. In some embodiments, a bottom portion 256 may be a stretch zone.

In FIGS. 14 to 18, knitted component 240 may be provided with a stretch zone 1402 (shown in dark shading). In some embodiments, stretch zone 1402 may be configured to stretch more than some other portions of knitted component 240, such as zone 1404 corresponding to a central bottom portion of seamless bootie or textile upper 1440, while stretching less than some other portions or zones of knitted component 240, such as portions or zones corresponding to plurality of holes 1406 and 1408. For example, corresponding portions 1502 and 1504 (shown with dark shading) of first knit layer 202 and second knit layer 204 of knitted component 240, respectively, may be provided so as to form generally continuous annular stretch zone 1402 around a perimeter of the central bottom portion 256 of knitted component 240. This configuration may facilitate knitted component 240 being stretched to form an asymmetric configuration having a generally symmetrical central bottom portion 256, e.g., having a first material characteristic, and an asymmetrical peripheral base or bottom portion (e.g., stretch zone 1402), having a second material characteristic. In some embodiments, central base portion 256 and peripheral stretch zone 1402 together may generally correspond to a size and shape of a foot, i.e., a foot print, and/or a shape of a sole. The second material characteristic may be different than the first material characteristic (e.g., in addition to a different degree of stretching). It will be appreciated that with this construction a knitted component 240 may be stretched in different ways to achieve one of at least two different possible desired final configurations for seamless bootie or textile upper 1440. For example, knitted component 240 could be stretched to form either a right article of footwear or a matching left article of footwear by controlling a relative amount of stretching of various portions of stretch zone 1402. Alternatively, knitted component 240 could be stretched to form an article of footwear having any one of a narrow, medium, or wide finished width by controlling an amount of stretching of stretch zone 1402. It further will be appreciated that this construction and configuration, including a central base portion 256 and a peripheral stretch zone 1402, may facilitate bonding of seamless bootie or textile upper 1440 to a sole structure having a similar right vs. left foot configuration, and/or a particular size or width.

In some embodiments, knitted component 240 may be treated with a substance for facilitating or enabling material memory upon stretching knitted component 240 to a desired size and shape. For example, in some embodiments, one or more yarns made of a material having inherent material memory may be used in a knitting process for knitting knitted component 240. In some embodiments, one or more yarns of knitted component 240 may be pre-treated with a substance for enabling material memory prior to the knitting process. In some embodiments, at least one portion of a knitted textile element 200 corresponding to at least one portion of knitted component 240 may be pre-treated with a substance for enabling material memory prior to removing knitted component 240 from knitted textile element 200. In some embodiments, portions of knitted component 240 may be treated with a substance for enabling material memory prior to stretching knitted component 240 over a last. In some embodiments, at least a portion of seamless bootie or textile upper 1440 may be treated with a substance for enabling material memory during or after stretching on a last. Examples of substances for enabling material memory include, but are not limited to a thermoplastic polyurethane (TPU) coating, TPU-based coatings, and/or other solutions incorporating TPU. Those skilled in the art readily will be able to select treated yarns, substances, and treatment protocols for facilitating or enabling material memory suitable for achieving a seamless bootie or textile upper 1440 for a desired application.

In some embodiments, knitted component 240 may be heat treated to enable forming the knitted component. For example, knitted component 240 may be heat treated in association with stretching over a last. In some embodiments, knitted component 240 may be heat treated prior to stretching over a last. In some embodiments, knitted component 240 may be heat treated while stretched over a last. In some embodiments, knitted component 240 may be heat treated after removal from a last. In some embodiments, one or more of these heat treatments may be used together. In each case, heat treating a knitted component 240 may facilitate forming the knitted component by stretching one or more portions of knitted component 240 to a desired size, shape, or configuration.

In some embodiments, knitted component 240 may be treated with a substance for facilitating or enabling material memory and heat treated to facilitate forming seamless bootie or textile upper 1440 with a desired size and shape, with material memory.

As shown in FIGS. 15 and 17, after forming by manipulating and/or stretching, a width 1510 of a portion of stretch zone 1502 on a medial side of seamless bootie or textile upper 1440 may be different than a width 1512 of a corresponding portion of the stretch zone 1504 on a lateral side of the seamless bootie or textile upper 1440.

As shown in FIGS. 15 and 17, after forming by manipulating and/or stretching knitted textile 240, a location of interlayer knit stitch line 214 between first knit layer 202 and second knit layer 204 of knitted component 240 may become asymmetrical with respect to medial and lateral sides 248 and 250 of seamless bootie or textile upper 1440. For example, as shown in bottom plan view in FIG. 15, interlayer knit stitch line 214 may have a gentle S-shaped curve that generally follows a contour of the central bottom portion 256 of seamless bootie or textile upper 1440.

As shown in FIGS. 16 and 18, because knitted component 240 is of unitary warp knit construction, with a continuous layer at forefoot portion 242, seamless bootie or textile upper 1440 may have continuous knitting stitch and/or knitting configuration, presenting an aesthetically pleasing appearance at forefoot portion 242. For example, as shown in FIGS. 16 and 18, knitted component 240 may have plurality of holes 1406 having a continuous hole pattern across an entirety of forefoot portion 242, such as a plurality of continuous, parallel, in-line arrays of holes.

As shown in FIGS. 17 and 18, after forming by manipulating and/or stretching knitted component 240, a location of interlayer knit stitch line 214 may extend at least partly around (wrap around) a front toe portion 254 of seamless bootie or textile upper 1440. In some embodiments, knitted component 240 may be inverted (i.e., turned inside-out) so that interlayer knit stitch line 214 is substantially hidden on an interior surface of seamless bootie or textile upper 1440. In some embodiments, however, knitted component 240 may not be inverted and interlayer knit stitch line 214 may be present on an exposed exterior surface at front toe portion 254 of seamless bootie or textile upper 1440. In this case, interlayer knit stitch line 214 still presents a substantially continuous and stable knitted surface at front toe portion 254 of seamless bootie or textile upper 1440. In some embodiments, at least a portion of exposed interlayer knit stitch line 214 at front toe portion 254 may be covered by a sole structure or other finishing treatment.

Seamless bootie or textile upper 1440 may provide an article of footwear 100 without substantial further modification or manufacture. In some embodiments, seamless bootie 1440 may form an article of footwear 100 without any further modification or manufacture. In some embodiments, seamless bootie or textile upper 1440 may form an article of footwear by applying a finishing treatment or process to at least a portion of the bootie. In some embodiments, a finishing treatment may be applied to a bottom surface portion of the bootie to provide durability and/or traction. Examples of such applied or finishing treatment may include, but are not limited to, applying a layer of grip material or direct injection of a grip material, such as a rubber. It will be appreciated that providing seamless bootie or textile upper 1440 with a finishing treatment or process also may provide reinforcing properties to interlayer knit stitch line 214. In some embodiments, providing seamless bootie or textile upper 1440 with a finishing treatment may inject or infuse bonding agent between yarns of first knit layer 202 and second knit layer 204 at interlayer knit stitch line 214 to bind or bond exposed yarn ends or otherwise loose yarn(s) at interlayer knit stitch line 214. Such seamless bootie or textile upper 1440 may form an article of footwear suitable for various activities such as wrestling, dance, aerobic exercise, rock wall climbing, or other activities that use light weight footwear having no separate sole structure assembly.

Figure 19:
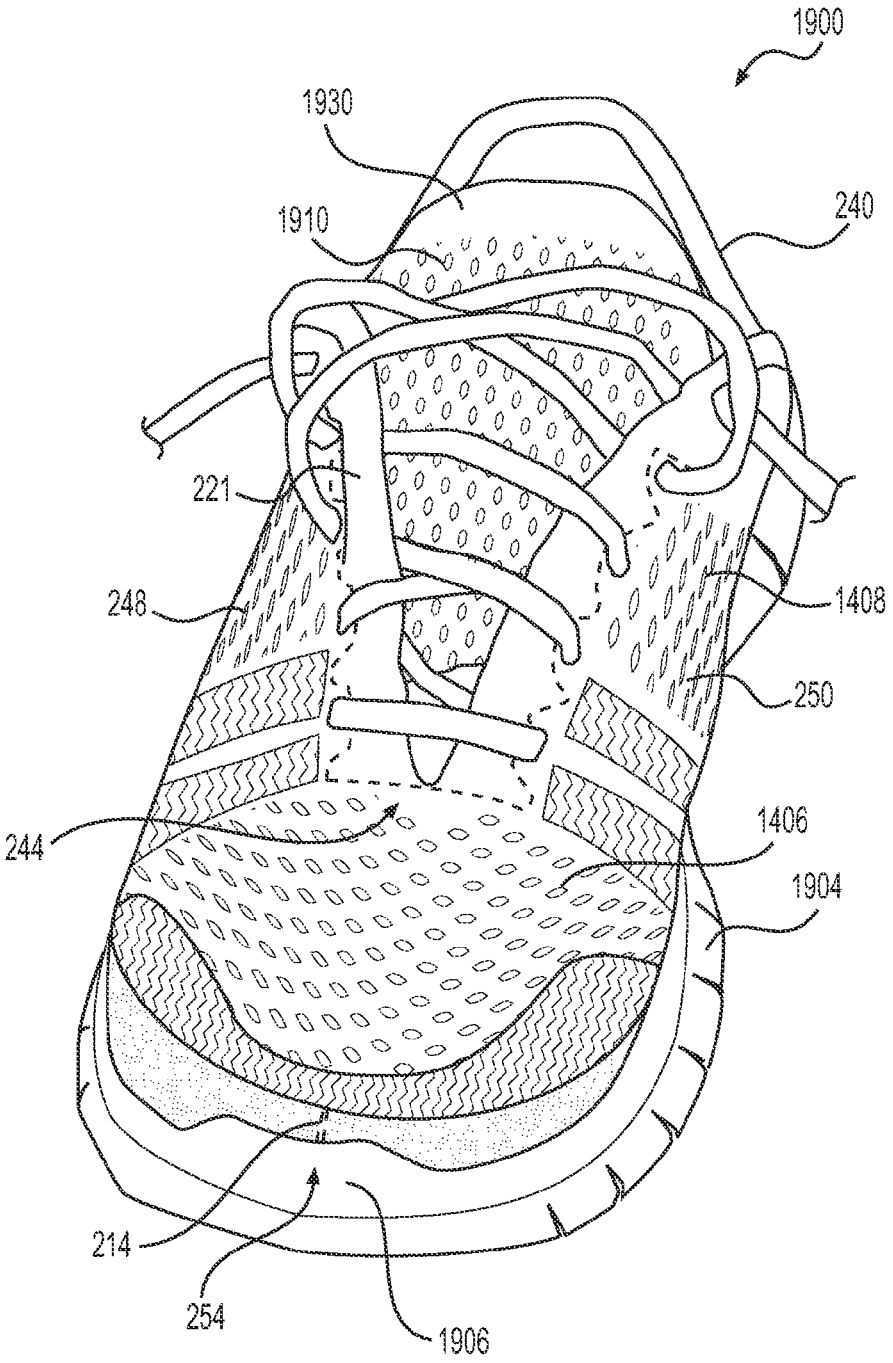
FIG. 19 is a schematic isometric top front view of an embodiment of an article of footwear incorporating a seamless bootie or textile upper of FIGS. 14 to 18 associated with an optional sole structure.
Figure 20:
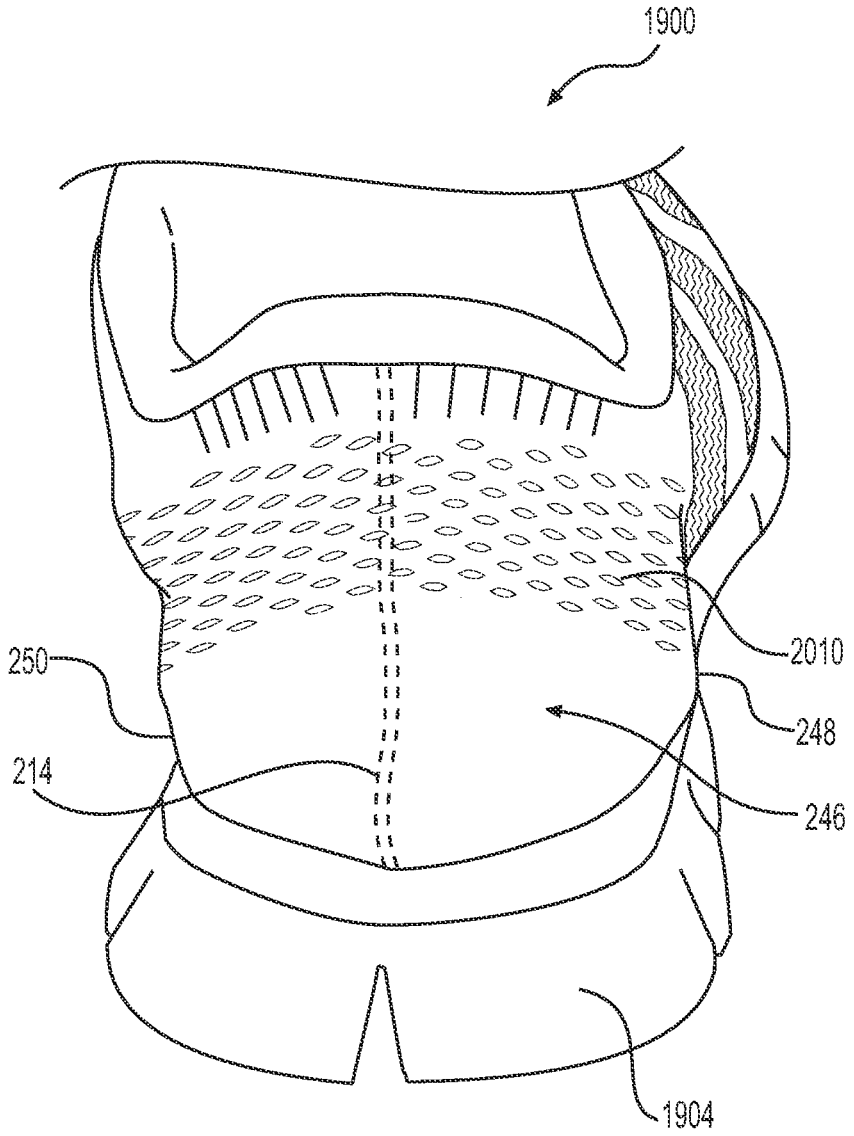
FIG. 20 is a schematic isometric rear view of the article of footwear of FIG. 19.

In some embodiments, seamless bootie or textile upper 1440 may form an article of footwear by adding one or more accessories, such as a tongue or insert member. FIG. 19 is a schematic isometric top front view of an embodiment of an article of footwear 1900 incorporating a seamless bootie or textile upper 1440 of FIGS. 14 to 18, an optional tongue 1930, and an optional sole structure 1904. FIG. 20 is a schematic isometric rear view of article of footwear 1900 of FIG. 19.

Tongue 1930 may be formed from a knitted component. For example, tongue 1930 may correspond to knitted component 230, as shown in FIGS. 2 and 7. As shown in FIG. 19, tongue 1930 may be disposed within an interior space of seamless bootie or textile upper 1440. Tongue 1930 may be configured to be located between a closure structure 221 of seamless bootie or textile upper 1440 and a wearer's foot. Tongue 1930 may be associated with closing region 221 by attaching a front edge of tongue 1930 to seamless bootie or textile upper 1440 adjacent forefoot portion 242 of knitted component 240. Tongue 1930 may include plurality of holes 1910. Tongue 1930 may include an insert member (not shown), such as foam material, disposed between first and second knit layers. Tongue 1930 may be attached to seamless bootie or textile upper 1440 by any suitable known or later developed attaching method, such as by adhesive, thermal bonding, stitching, or other attaching mechanism.

Sole structure 1904 may be any suitable known or later developed sole structure. In some embodiments, as shown in FIG. 19, sole structure 1904 may include front toe portion 1906 that covers at least a portion of interlayer knit stitch line 214 (illustrated in phantom as double dashed lines for purposes of description) located at front toe portion 254 of seamless bootie or textile upper 1440. In some embodiments, sole structure 1904 may wrap around at least part of front toe portion 254 and cover substantially all or an entirety of interlayer knit stitch line 214 at front toe portion 254 (see, e.g., FIG. 1). Sole structure 1904 may be associated with seamless bootie or textile upper 1440 by any suitable known or later developed attaching method, such as by adhesive or other bonding method. It will be appreciated that attaching seamless bootie or textile upper 1440 to sole structure 1904 may provide reinforcing properties to interlayer knit stitch line 214. In some embodiments, attaching by adhesive or other bonding method may infuse adhesive or bonding agent between yarns of first knit layer 202 and second knit layer 204 at interlayer knit stitch line 214 to bind or bond any exposed ends or otherwise loose yarn(s) at interlayer knit stitch line 214.

As shown in FIG. 20, interlayer knit stitch line 214 (shown in double dashed phantom lines for purposes of description) of knitted component 240 generally may be located along a central line between a medial side 250 and a lateral side 248 of knitted component 240 of seamless bootie or textile upper 1440. It will be appreciated that, because knitted component 240 is of unitary warp knit construction, including interlayer knit stitch line 214, knitted component 240 may present a substantially continuous knitting stitch and/or knitting configuration across heel portion 246 of seamless bootie or textile upper 1440. In some embodiments, knitted component 240 may include plurality of holes 2010 having a hole pattern that is substantially continuous across an entirety of heel portion 246. For example, as shown in FIG. 20, plurality of holes 2010 may include a plurality of substantially continuous, parallel, in-line arrays of holes across an entirety of heel portion 246, including interlayer knit stitch line 214. It will be appreciated that this construction may provide a pleasing aesthetic characteristic.

Figure 21:
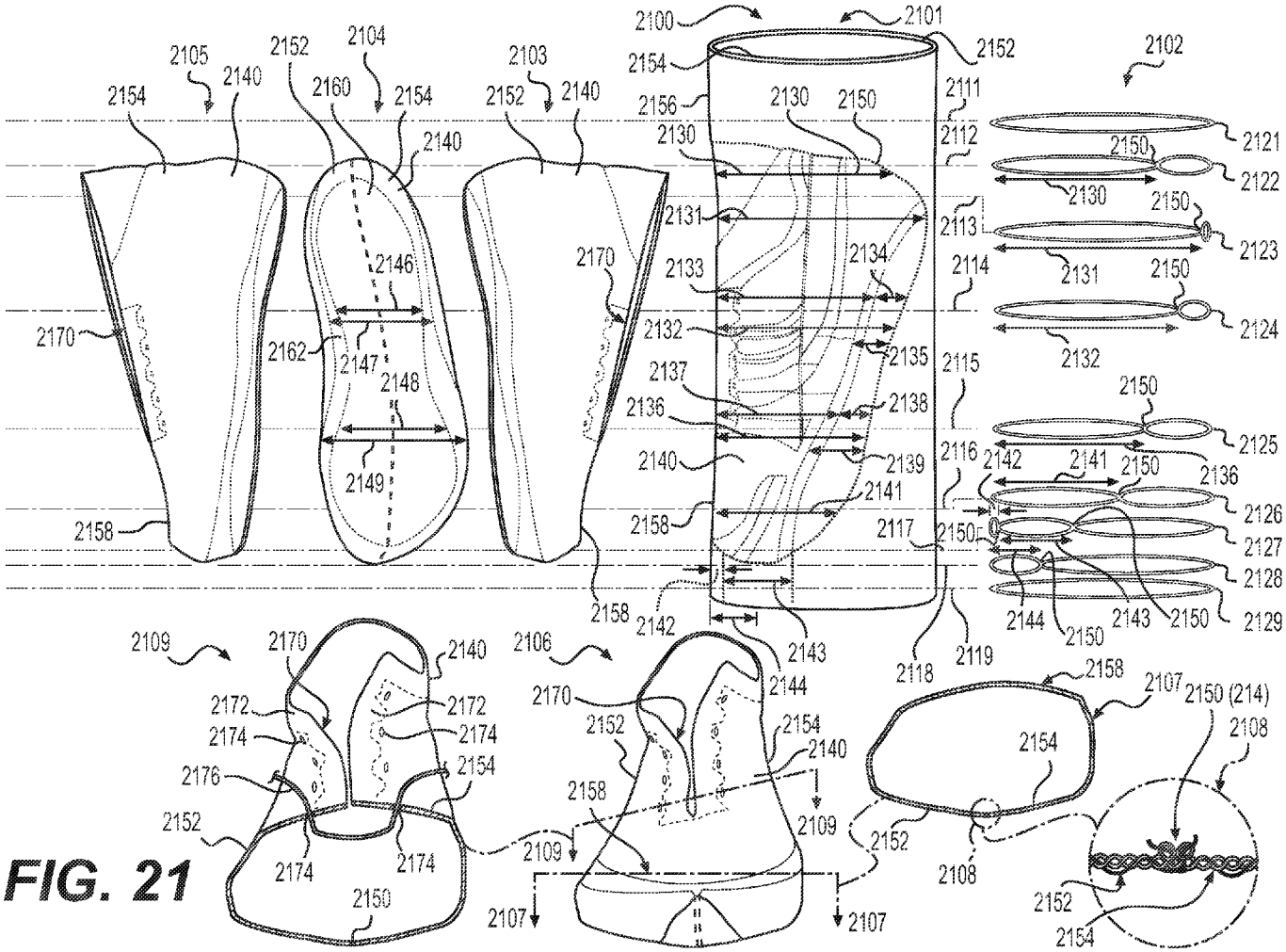
FIG. 21 schematically maps features of an embodiment of a knitted component of a knitted textile element of FIG. 2, pre-removal, to a seamless bootie or textile upper formed from the knitted component.

FIG. 21 schematically maps features of an embodiment of a knitted component 2140 of a knitted textile element 2100, pre-removal, to a seamless bootie or textile upper formed from knitted component 2140 post removal. In some embodiments, knitted textile element 2100 may correspond to knitted textile element 200 of FIG. 2, and knitted component 2140 may correspond to knitted component 240 of FIGS. 2 and 8 and/or knitted component 140 of FIG. 1.

In FIG. 21, reference number 2101 identifies a figure of knitted textile element 2100 (hereafter referred to as reference figure 2101) and includes a sequence of section lines 2111-2119 that schematically map various features and characteristics of knitted component 2140 of knitted textile element 2100 across corresponding figures at reference numbers 2102, 2103, 2104, and 2105 (hereafter referred to as reference figures 2102, 2103, 2104, and 2105). Reference figure 2102 illustrates a sequence of cross-sectional views 2121 to 2129 associated with knitted component 2140 of knitted textile element 2100 taken along section lines 2111 to 2119; reference figure 2103 illustrates a medial side view of knitted component 2140; reference figure 2104 illustrates a bottom plan view of knitted component 2140; and reference figure 2105 illustrates a lateral side view of knitted component 2140. Reference number 2106 is a figure that illustrates a front isometric view of knitted component 2140 (hereafter reference figure 2106); reference number 2107 is a figure that illustrates a cross-sectional view of forefoot portion 2158 taken along section line 2107-2107 of reference figure 2106 (hereafter reference figure 2107); reference number 2108 is an exploded detail view schematically illustrating an interlayer knit stitch line 2150 of knitted component 2140 of reference figure 2107 (hereafter reference figure 2108); and reference number 2109 is a figure that illustrates a cross-sectional view of forefoot portion 2158 of the knitted component 2140 taken along section line 2109-2109 of reference figure 2106 (hereafter reference figure 2109).

Section line 2111 passes through knitted textile element 2100 above knitted component 2140, outside a peripheral boundary of knitted component 2140 defined by interlayer knit layer 2150. Accordingly, mapping section line 2111 in reference figure 2101 to reference figure 2102 presents a cross-section of knitted component 2100 in the form of a tubular structure 2121 having no physical features associated with knitted component 2140. Likewise, reference figures 2103, 2104, and 2105 present no physical features associated with knitted component 2140 along section line 2111.

Section line 2112 passes through a rear heel portion of knitted component 2140. Mapping section line 2112 in reference figure 2101 to reference figure 2102 presents a cross-section of knitted textile element 2100 in the form of a generally flattened tubular structure 2122 having a single node where interlayer knit stitch line 2150 interconnects first knit layer 2152 and second knit layer 2154 at a distance 2130 from common side edge 2156 of knitted textile element 2100 (see, e.g., common side edge 210 in FIGS. 2 to 6).

Section line 2113 passes through a base of the heel portion of knitted component 2140. Mapping section line 2113 in reference figure 2101 to reference figure 2102 presents a cross-section of knitted textile element 2100 in the form of a generally flattened tubular structure 2123 having a single node where interlayer knit stitch line 2150 interconnects first knit layer 2152 and second knit layer 2154 at a distance 2131 from continuous common side edge 2156 of textile element 2100.

Section line 2114 passes through a midfoot portion of knitted component 2140 at an end of closure system 2170 proximate the ankle opening. Mapping section line 2114 in reference figure 2101 to reference figure 2102 presents a cross-section of knitted textile element 2100 in the form of a generally flattened tubular structure 2124 having a single node where interlayer knit stitch line 2150 interconnects first knit layer 2152 and second knit layer 2154 at a distance 2132 from common side edge 2156 of textile element 2100.

Mapping reference figure 2101 to reference figure 2104, illustrating a bottom view of a seamless bootie or textile upper formed from knitted component 2140, it will be appreciated that along section line 2114 a distance 2133 from common edge 2156 of knitted component 2140 to an edge of central bottom portion 2160 and a distance 2134 from the edge of the central bottom portion 2160 to the interlayer knit stitch line 2150 corresponds to the distance 2132 from the common edge 2156 to the interlayer knit stitch line 2150 (distance 2133+distance 2134=distance 2132), and a distance 2146, corresponding to a width of central bottom portion 2160 along section line 2114, equals two times the distance 2134 (distance 2146=2×distance 2134). Similarly, a distance 2147, corresponding to a width of central bottom portion 2160 and peripheral bottom portion 2162 of knitted component 2140 along section line 2114, equals two times the distance 2135 between an edge of peripheral bottom portion 2162 and the interlayer knit stitch line 2150 along section line 2114 (distance 2147=2× distance 2135).

Section line 2115 passes through a midfoot portion of knitted component 2140 at an end of closure system 2170 proximate to forefoot portion 2158. Mapping section line 2115 in reference figure 2101 to reference figure 2102 presents a cross-section of knitted textile element 2100 in the form of a flattened tubular structure 2125 having a single node where interlayer knit stitch line 2150 interconnects first knit layer 2152 and second knit layer 2154 at a distance 2136 from common side edge 2156 of textile element 2100. Mapping reference figure 2101 to reference figure 2104 along section line 2115, it will be appreciated that a distance 2137 from common edge 2156 of knitted component 2140 to an edge of central bottom portion 2160 and a distance 2138 from the edge of central bottom portion 2156 to the interlayer knit stitch line 2150 corresponds to the distance 2136 from common edge 2156 to interlayer knit stitch line 2150 (distance 2137+distance 2138=distance 2136), and a distance 2148, corresponding to a width of the central bottom portion 2160 along section line 2115, equals two times the distance 2138 along section line 2115. Similarly, a distance 2149, corresponding to a width of central bottom portion 2160 and peripheral bottom portion 2162 along section line 2115 equals two times the distance 2139 between an edge of peripheral bottom portion 2162 and the interlayer knit stitch line 2150 along section line 2115 (distance 2149=2×distance 2139).

Section line 2116 passes through forefoot portion 2158 of knitted component 2140. Mapping section line 2116 in reference figure 2101 to reference figure 2102 presents a cross-section of knitted textile element 2100 in the form of a flattened tubular structure 2126 having a single node where interlayer knit stitch line 2150 interconnects first knit layer 2152 and second knit layer 2154 at a distance 2141 from common side edge 2156 of textile element 2100.

Section line 2117 also passes through forefoot portion 2158 of knitted component 2140. Mapping section line 2117 in reference figure 2101 to reference figure 2102 presents a cross-section of knitted textile element 2100 in the form of a tubular structure 2127 having a first node where interlayer knit stitch line 2150 interconnects first knit layer 2152 and second knit layer 2154 at a distance 2142 from common side edge 2156 of textile element 2100, and a second node where interlayer knit stitch line 2150 interconnects first knit layer 2152 and second knit layer 2154 at a distance 2143 from the first node of textile element 2100 along section line 2117.

Section line 2118 touches and extends tangentially with a front edge of forefoot portion 2158 of knitted component 2140. Mapping section line 2118 in reference figure 2101 to reference figure 2102 presents a cross-section of knitted textile element 2100 in the form of a flattened tubular structure 2128 having a single node where interlayer knit stitch line 2150 interconnects first knit layer 2152 and second knit layer 2154 at a distance 2144 from common edge 2156 of textile element 2100.

Section line 2119 passes through knitted textile element 2100 below knitted component 2140, outside a peripheral boundary of knitted component 2140 defined by interlayer knit stitch line 2150. Accordingly, mapping section line 2119 in reference figure 2101 to reference figure 2102 presents a cross-section of knitted textile element 2100 in the form of a flattened tubular structure 2129 having no physical features associated with knitted component 2140. Likewise, reference figures 2103, 2104, and 2105 present no physical features associated with knitted component 2100 and section line 2119.

It will be appreciated that dimensions of knitted textile element 2100 and knitted component 2140 may be selected to provide desired configuration (size and shape), custom fit, and performance characteristics in a seamless bootie or textile upper formed from knitted component 2140.

For example, it will be appreciated that distance 2131 corresponds to a greatest width of knitted textile component 2140, and that distance 2131 thus represents a minimum width of knitted textile element 2100 sufficient to define and make knitted component 2140. Accordingly, in some embodiments a width of knitted textile element 2100 may be selected to substantially equal distance 2131 to minimize an amount material and cost required for making knitted textile element 2100 and knitted component 2140.

Selecting dimensions 2132, 2133, 2134, and 2135 (e.g., at an end of closure system 2170 proximate the ankle opening of knitted component 2140) and dimensions 2136, 2137, 2138, and 2139 (e.g., at an end of closure system 2170 proximate forefoot portion 2158) may provide a desired size and/or custom fit of a seamless bootie or textile upper formed from knitted component 2140. A desired custom fit of the seamless bootie further may be facilitated by selecting a configuration of closure system 2170. For example, providing a V-shaped closure structure 2170 (see, e.g., FIG. 1) with such selected dimensions at an end of closure structure 2170 proximate forefoot portion 2158 may provide a desired size and/or custom fit at that location (e.g., girth), and facilitate further custom fit by facilitating precise tightening tolerances of a lacing system of closure system 2170.

Selecting similar dimensions at other locations of knitted component 2141, such as along section lines 2111 to 2119, similarly may provide a desired sizing and/or custom fit of knitted component 2141 at such locations. For example, selecting dimensions 2141, 2142, and 2143 at forefoot portion 2158 may provide a toe box having a desired sizing and/or custom fit.

Those skilled in the art readily will be able to select dimensions for knitted component 2140 suitable to provide desired sizing and/or a custom fit of a seamless bootie or textile upper formed from knitted component 2140.

Reference figures 2106 to 2109 illustrate further features of a seamless bootie or textile upper formed from knitted component 2140. Reference figure 2106 is a front perspective view of a seamless bootie or textile upper formed from knitted component 2140.

Reference figure 2107 illustrates a cross-section of forefoot portion 2158 taken along section line 2107-2107 in reference figure 2106. In some embodiments, as shown in reference figure 2107, first knit layer 2152 and second knit layer 2154 form a single continuous generally annular (tubular) knitted layer at forefoot portion 2158. In particular, as shown in reference figure 2108, which is an enlarged detail view at interlayer knit stitch line 2150, first knit layer 2152 and second knit layer 2154 provide a continuous knitted layer at interlayer knit stitch line 2150. As shown in reference figure 2108, interlayer knit stitch line 2150 includes at least one yarn of first knit layer 2152 interlooped with at least one yarn of second knit layer 2154. This continuous knitted structure at interlayer knit stitch line 2150 may help prevent unravelling of knitted component 2140 at interlayer knit stitch line 2150. As schematically illustrated in reference figure 2108, post separation or removal of knitted component 2140 from knitted textile element 2100 along interlayer knit stitch line 2150, a small amount of terminal yarn ends resulting from a separating process may be exposed at interlayer knit stitch line 2150. In some embodiments, where knitted component 2140 is inverted prior to forming a seamless bootie or textile upper, exposed yarn ends at interlayer knit stitch line 2150 may be located on an interior side of the seamless bootie or textile upper (as shown in reference figure 2108). In some embodiments, where knitted component 2140 is not inverted prior to forming a seamless bootie or textile upper, exposed yarn ends at interlayer knit stitch line 2150 may be located on an exterior side of the seamless bootie or textile upper.

Reference figure 2109 illustrates a cross-section of a seamless bootie or textile upper taken along section line 2109-2109 in reference figure 2106. In some embodiments, as shown in reference figure 2106, the seamless bootie or textile upper may include a closure system 2170 formed in knitted component 2140 by a separating process, such as shown in FIGS. 3-6. In some embodiments, closure system 2170 may include closure members 2172, eyelets 2174, and lacing 2176. In some embodiments, as shown in reference figure 2109, first knit layer 2152 and second knit layer 2154 form a single continuous knitted layer, where one end of first knit layer 2152 terminates as a knitted closure member 2172 on one side of closure structure 2170, and one end of second knit layer 2154 terminates as a knitted lacing member 2172 on an opposing side of closure structure 2170.

Figure 22:
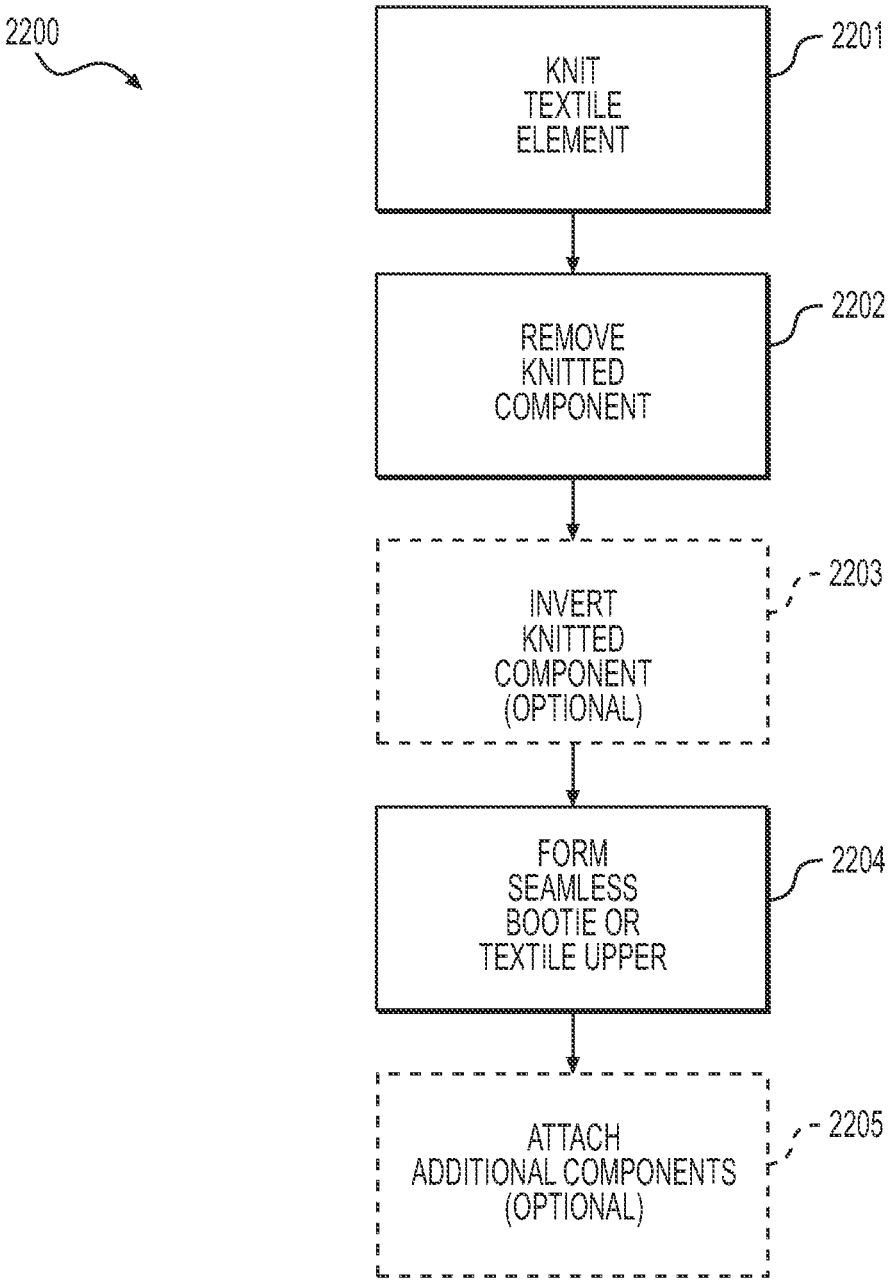
FIG. 22 is a flow chart including processes for making an article of footwear using a knitting method.

FIG. 22 illustrates a process flow chart 2200 including processes for making an article of footwear using a knitting method according to features of FIGS. 2 to 21. Process 2201 includes knitting a knitted textile element of a unitary warp knit construction. Process 2202 includes removing a knitted component from the knitted textile element. Optional process 2203 includes inverting the knitted component, i.e., turning the knitted component inside out. Process 2204 includes forming the knitted component into a seamless bootie or textile upper for an article of footwear. And optional process 2205 includes associating the seamless bootie or textile upper with one or more additional components, such as a sole structure, a tongue, or an overlay component. Option process 2205 also may include applying a finishing treatment, such as applying a grip material to a bottom surface of a seamless bootie. Those skilled in the art readily will be able to select desired processes for achieving an article of footwear consistent with this description of embodiments.

Figure 23:
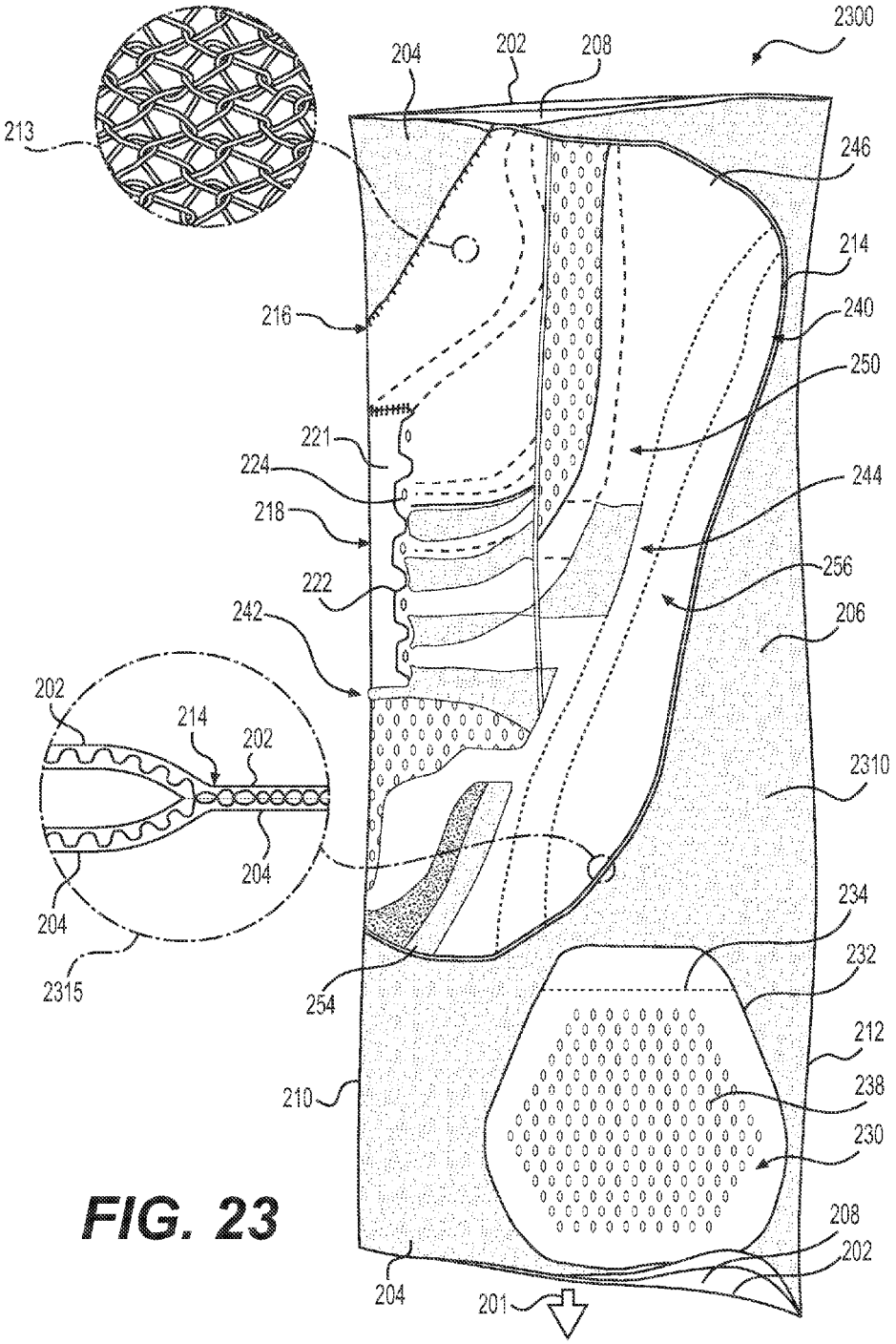
FIG. 23 is a schematic plan view of another embodiment of a knitted textile element including knitted components, pre-removal, in which features of a warp knit stitch and interlayer warp knit stitch line of the knitted textile element are shown in detail.

FIG. 23 is a schematic plan view of another embodiment of a knitted textile element including knitted components, pre-removal, in which features of a warp knit stitch and interlayer knit stitch line of the knitted textile element are shown in detail. FIG. 23 is substantially similar to FIG. 2. Accordingly, the description of features in FIG. 2 is incorporated by reference herein, and this description will be directed to features that may be different in FIG. 23.

FIG. 23 illustrates a knitted textile element 2300 of unitary warp knit configuration including a first knit layer 202 and a second knit layer 204 that overlays first knit layer 202 and that is continuous with first knit layer 202 along common edge 210. In some embodiments, knitted textile element 2300 may include a knitted component 230, corresponding to a tongue, and a knitted component 240, corresponding to a seamless bootie or textile upper. Knitted component 230 and knitted component 240 generally may include features corresponding to knitted component 230 and knitted component 240 as illustrated in FIG. 2 and described above. In FIG. 23, knitted textile element 2300 may include an interlayer knit stitch line 214 interconnecting first knit layer 202 and second knit layer 204 at a peripheral portion of knitted component 240, and an interlayer knit stitch line 232 interconnecting first knit layer 202 and second knit layer 204 at a peripheral portion of knitted component 240.

In some embodiments, however, as shown in FIG. 23, first knit layer 202 and second knit layer 204 of knitted textile element 2300 may be interconnected throughout an interlayer knitted portion 2310 outside a peripheral portion of knitted components 230 and 240 (illustrated by common continuous shading in FIG. 23). For purposes of description, FIG. 23 includes enlarged element 2315 schematically illustrating in cross-section a knitting configuration of knitted textile element 2300 including interlayer knit stitch line 214 and interlayer knitted portion 2310. As schematically illustrated in element 2315, first knit layer 202 and second knit layer 204 may be interconnected throughout interlayer knitted portion 2310 by a plurality of common knitting stitches in which at least one yarn of first knit layer 202 is interlooped with at least one yarn of second knit layer 204. In some embodiments, a plurality of common interlayer knitting stitches may include a series of individual interlayer knitting stitches using different yarns. In some embodiments, a plurality of common interlayer knitting stitches may include a series of interlayer knitting stitches using a common yarn. In some embodiments, as shown at element 2315, interlayer knitted portion 2310 may be contiguous with interlayer knit stitch line 214 between first knit layer 202 and second knit layer 204. In some embodiments, interlayer knitted portion 2310 may be continuous with interlayer knit stitch line 214 between first knit layer 202 and second knit layer 204. In some embodiments, interlayer knitted portion 2310 may include interlayer knit stitch line 214.

It will be appreciated that, in some embodiments knitted textile element 2300, including interlayer knitted portion 2310, may provide improved dimensional stability for knitted components 230 and 240, pre-removal. In some embodiments, textile element 2300 including interlayer knitted portion 2310 may facilitate improved handling during manufacturing processes. In some embodiments, textile element 2300 including interlayer knitted portion 2310 may facilitate removal of knitted components 230 and 240 using a single separation process for both first knit layer 202 and second knit layer 204, that is, a single process for separating a knitted component from first knit layer 202 and second knit layer 204.

Figure 24:
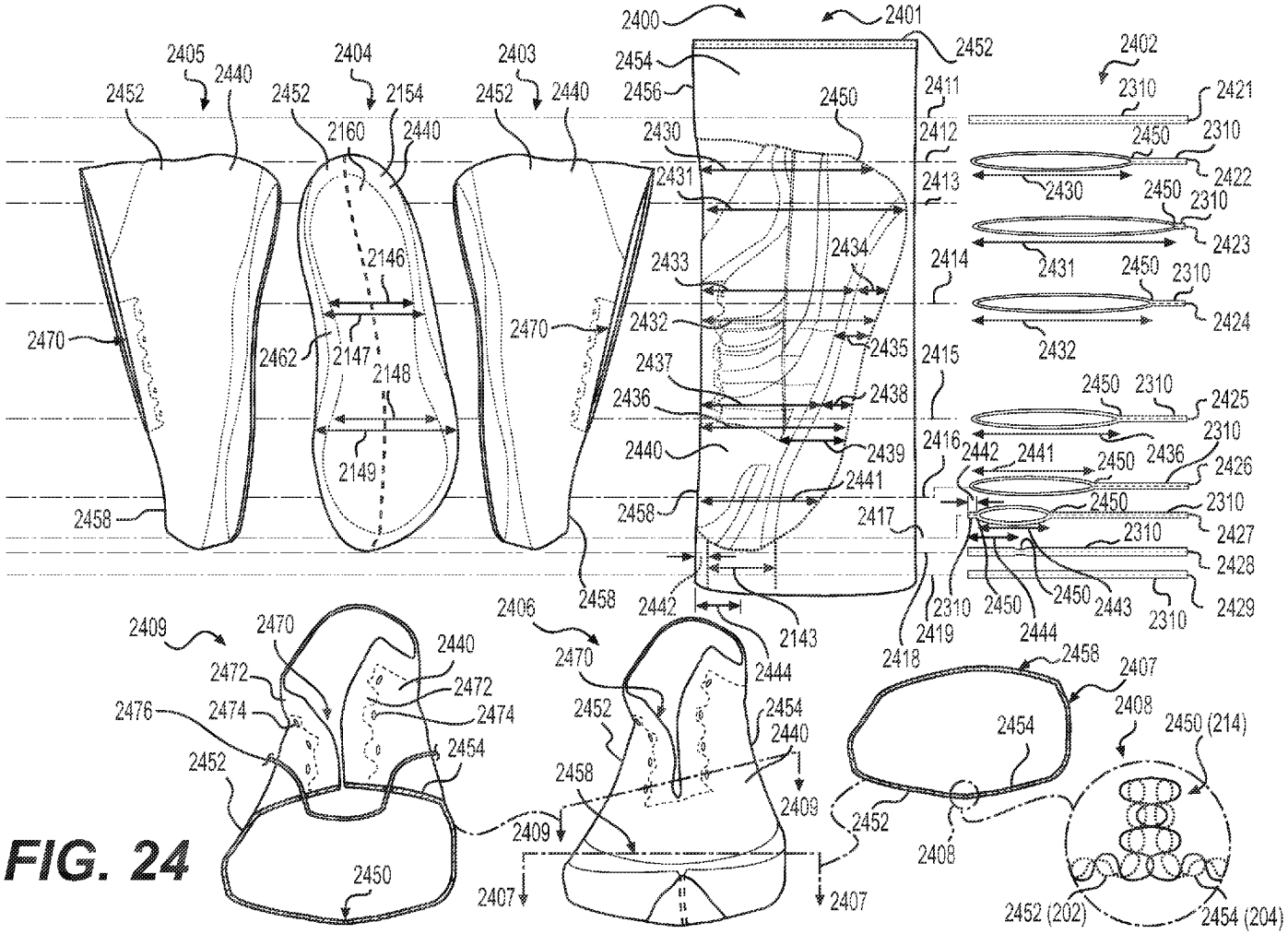
FIG. 24 schematically maps features of another embodiment of a knitted component of a knitted textile element of FIG. 23, pre-removal, to a seamless bootie or textile upper formed from the knitted component.

FIG. 24 schematically maps features of an embodiment of a knitted component 2440 of a knitted textile element 2400, pre-removal, to a seamless bootie or textile upper formed from the knitted component 2440. FIG. 24 is substantially similar to FIG. 21. In some embodiments, textile element 2400 may correspond to textile element 2300 of FIG. 23, and knitted component 2440 may correspond to knitted component 2140 of FIG. 21. Accordingly, description of features previously described in connection with FIGS. 21 and 23 will not be repeated, and this description will be directed to features that may be different in FIG. 24.

In FIG. 24, features relating to knitted component 2440 are substantially similar to features of knitted component 2140 in FIG. 21. Reference figures 2401 to 2409 are substantially similar to reference figures 2101 to 2109. Section lines 2411 to 2419 in FIG. 24 correspond to section lines 2111 to 2119 in FIG. 21.

Section line 2411 passes through knitted textile element 2400 above knitted component 2440, outside a peripheral boundary of knitted component 2440 defined by interlayer knit layer 2450. In some embodiments, this construction may correspond to interlayer knitted portion 2310 in FIG. 23. Accordingly, mapping section line 2411 in reference figure 2401 to reference figure 2402 presents a cross-section of knitted component 2400 in the form of a flat two-layer structure 2421. First knit layer 2452 and second knit layer 2454 may be interconnected by a plurality of common interlayer knitting stitches and have no features associated with knitted component 2440. Likewise, reference figures 2403, 2404, and 2405 present no physical features associated with knitted component 2440 along section line 2411.

Section line 2412 passes through a rear heel portion of knitted component 2440. Mapping section line 2412 in reference figure 2401 to reference figure 2402 presents a cross-section of knitted textile element 2400 in the form of a generally flat two-layer structure 2422. Similar to the embodiment of FIG. 21, first knit layer 2452 and second knit layer 2454 have a common side edge 2456 and form a void between first knit layer 2452 and second knit layer 2454 from common side edge 2456 to a single node where interlayer knit stitch line 2450 interconnects first knit layer 2452 and second knit layer 2454 at a distance 2430 from common side edge 2456 of knitted textile element 2400 (see, e.g., common side edge 210 in FIGS. 2 to 6). First knit layer 2452 and second knit layer 2454 are interconnected by a plurality of common interlayer knit stitches outside interlayer knit stitch 2450 (see, e.g., interlayer knitted portion 2310 in FIG. 23).

Section line 2413 passes through a base of the heel portion of knitted component 2440. Mapping section line 2413 in reference figure 2401 to reference figure 2402 presents a cross-section of knitted textile element 2400 in the form of a generally flat two-layer knitted structure 2423. Similar to the embodiment of FIG. 21, first knit layer 2452 and second knit layer 2454 have a common side edge 2456 and form a void between first knit layer 2452 and second knit layer 2454 from common side edge 2456 to a single node where interlayer knit stitch line 2450 interconnects first knit layer 2452 and second knit layer 2454 at a distance 2431 from common side edge 2456 of knitted textile element 2400.

First knit layer 2452 and second knit layer 2454 are interconnected by a plurality of common interlayer knit stitches outside interlayer knit stitch 2450 (see, e.g., interlayer knitted portion 2310 in FIG. 23).

Section line 2414 passes through a midfoot portion of knitted component 2440 at an end of closure system 2470 proximate the ankle opening. Mapping section line 2414 in reference figure 2401 to reference figure 2402 presents a cross-section of knitted textile element 2400 in the form of a generally flat two-layer structure 2424. Similar to the embodiment of FIG. 21, first knit layer 2452 and second knit layer 2454 have a common side edge 2456 and form a void between first knit layer 2452 and second knit layer 2454 from common side edge 2456 to a single node where interlayer knit stitch line 2450 interconnects first knit layer 2452 and second knit layer 2454 at a distance 2432 from common side edge 2456 of knitted textile element 2400. First knit layer 2452 and second knit layer 2454 are interconnected by a plurality of common interlayer knit stitches outside interlayer knit stitch 2450 (see, e.g., interlayer knitted portion 2310 in FIG. 23).

Section line 2415 passes through a midfoot portion of knitted component 2440 at an end of closure system 2470 proximate to forefoot portion 2458. Mapping section line 2415 in reference figure 2401 to reference figure 2402 presents a cross-section of knitted textile element 2400 in the form of a generally flat two-layer structure 2425. Similar to the embodiment of FIG. 21, first knit layer 2452 and second knit layer 2454 have a common side edge 2456 and form a void between first knit layer 2452 and second knit layer 2454 from common side edge 2456 to a single node where interlayer knit stitch line 2450 interconnects first knit layer 2452 and second knit layer 2454 at a distance 2436 from common side edge 2456 of knitted textile element 2400. First knit layer 2452 and second knit layer 2454 are interconnected by a plurality of common interlayer knit stitches outside interlayer knit stitch 2450 (see, e.g., interlayer knitted portion 2310 in FIG. 23).

Section line 2416 passes through forefoot portion 2458 of knitted component 2440. Mapping section line 2416 in reference figure 2401 to reference figure 2402 presents a cross-section of knitted textile element 2400 in the form of a generally flat two-layer structure 2426. Similar to the embodiment of FIG. 21, first knit layer 2452 and second knit layer 2454 have a common side edge 2456 and form a void between first knit layer 2452 and second knit layer 2454 from common side edge 2456 to a single node where interlayer knit stitch line 2450 interconnects first knit layer 2452 and second knit layer 2454 at a distance 2441 from common side edge 2456 of knitted textile element 2400. First knit layer 2452 and second knit layer 2454 are interconnected by a plurality of common interlayer knit stitches outside interlayer knit stitch 2450 (see, e.g., interlayer knitted portion 2310 in FIG. 23).

Section line 2417 also passes through forefoot portion 2458 of knitted component 2440. Mapping section line 2413 in reference figure 2401 to reference figure 2402 presents a cross-section of knitted textile element 2400 in the form of a generally flat two-layer structure 2427. Structure 2427 has two nodes where interlayer knit stitch line 2450 interconnects first knit layer 2452 and second knit layer 2454 at a distance 2442 from common side edge 2456 of textile element 2100, and at a distance 2443 from the first node of textile element 2100 along section line 2417. First knit layer 2452 and second knit layer 2454 are interconnected by a plurality of common interlayer knit stitches outside interlayer knit stitch 2450 (see, e.g., interlayer knitted portion 2310 in FIG. 23).

Section line 2418 touches a front edge of forefoot portion 2458 of knitted component 2440. Mapping section line 2418 in reference figure 2401 to reference figure 2402 presents a cross-section of knitted textile element 2400 in the form of a generally flat two-layer structure 2428. Similar to the embodiment of FIG. 21, first knit layer 2452 and second knit layer 2454 have a common side edge 2456 and a node where interlayer knit stitch line 2450 interconnects first knit layer 2452 and second knit layer 2454 at a distance 2444 from common side edge 2456 of knitted textile element 2400 (illustrated as a 'pinch' in two-layer structure 2428). First knit layer 2452 and second knit layer 2454 are interconnected by a plurality of common interlayer knit stitches outside interlayer knit stitch 2450 (see, e.g., interlayer knitted portion 2310 in FIG. 23).

Section line 2419 passes through knitted textile element 2400 below knitted component 2440, outside a peripheral boundary of knitted component 2440 defined by interlayer knit layer 2450. Accordingly, mapping section line 2419 in reference figure 2401 to reference figure 2402 presents a cross-section of knitted textile element 2400 in the form of a flat two-layer structure 2429 having no features associated with knitted component 2440. Likewise, reference figures 2403, 2404, and 2405 present no features associated with knitted component 2400 and section line 2419.

It will be appreciated that dimensions of knitted textile element 2400 and knitted component 2440 may be selected to provide desired sizing and/or custom fit and performance characteristics in a seamless bootie or textile upper formed from knitted component 2440 as described above with respect to knitted component 2100 in FIG. 21. Those skilled in the art readily will be able to select dimensions for knitted component 2440 to provide a desired sizing and/or custom fit of a seamless bootie or textile upper formed from knitted component 2440.

Reference figures 2406 to 2409 illustrate further features of a seamless bootie or textile upper formed from knitted component 2440. Reference figure 2406 is a front perspective view of a seamless bootie or textile upper formed from knitted component 2440.

Reference figure 2407 illustrates a cross-section of forefoot portion 2458 taken along section line 2407-2407 in reference figure 2406. In some embodiments, as shown in reference figure 2407, first knit layer 2452 and second knit layer 2454 form a single continuous generally annular (tubular) knitted layer at forefoot portion 2458. In particular, as shown in reference figure 2408, which is an enlarged detail view at interlayer knit stitch line 2450, first knit layer 2452 and second knit layer 2454 provide a continuous knitted layer at interlayer knit stitch line 2450. As shown in reference figure 2408, interlayer knit stitch line 2450 includes at least one yarn of first knit layer 2452 interlooped with at least one yarn of second knit layer 2454. Moreover, as shown in figure 2408, it will be appreciated that in some embodiments interlayer knit stitch line 2450 may be separated at contiguous interlayer knitted portion 2310. This continuous knitted structure at interlayer knit stitch line 2450 and interlayer knitted portion 2310 may help prevent unravelling of knitted component 2440 at interlayer knit stitch line 2450. As schematically illustrated in reference figure 2408, post separation or removal of knitted component 2440 from knitted textile element 2400 along interlayer knit stitch line 2450 at interlayer knitted portion 2310, a small amount of terminal yarn ends resulting from a separating process may be exposed at interlayer knit stitch line 2450. In some embodiments, where knitted component 2440 is inverted (i.e., turned inside-out) prior to forming a seamless bootie or textile upper, exposed yarn ends at interlayer knit stitch line 2450 may be located on an interior side of the seamless bootie or textile upper (as shown in reference figure 2408). In some embodiments, where knitted component 2440 is not inverted prior to forming a seamless bootie or textile upper, exposed yarn ends at interlayer knit stitch line 2450 may be located on an exterior side of the seamless bootie or textile upper.

Reference figure 2409 illustrates a cross-section of a seamless bootie or textile upper taken along section line 2409-2409 in reference figure 2406. In some embodiments, as shown in reference figure 2406, the seamless bootie or textile upper may include a closure system 2470 formed in knitted component 2440 by a separating process. In some embodiments, closure system 2470 may include lacing members 2472, eyelets 2474, and lacing 2476. In some embodiments, as shown in reference figure 2409, first knit layer 2452 and second knit layer 2454 form a single continuous knitted layer, where one end of first knit layer 2452 terminates as a knitted closure member 2472 on one side of closure structure 2470, and one end of second knit layer 2454 terminates as a knitted closure member 2472 on an opposing side of closure structure 2170.

Seamless Bootie with Tucked-in Portions Article of Footwear Configurations

This section of the detailed description generally describes embodiments of methods for knitting a knitted textile element including a knitted component having tucked-in portions for incorporating into a textile upper for an article of footwear. Specifically, this section generally describes embodiments of methods for knitting a knitted textile element including a first knitted component portion that is configured to form a seamless bootie or textile upper and a second knitted component portion that is configured to be tucked-in or folded into an interior pocket of the seamless bootie or textile upper (i.e., the first knitted component portion), where the interior pocket is formed by the first knit layer and the second knit layer of the knitted textile element, and where the tucked-in portion (i.e., the second knitted component portion) is seamlessly associated with the first knit layer and the second knit layer of the seamless bootie or textile upper (i.e., the first knitted component portion) at an opening of the seamless bootie or textile upper that is configured to receive a foot. In some embodiments a tucked-in portion may form a dynamic fit structure of the article of footwear. In some embodiments a tucked-in portion may form a closure structure of the article of footwear, such as a gusseted tongue. In some embodiments, a tucked-in portion may include a pocket formed by the first knit layer and/or the second knit layer for receiving an insert member. In some embodiments, a tucked-in portion may cooperate with one of the first knit layer and the second knit layer of the seamless bootie or textile upper (i.e., the first knitted component portion) to form a pocket for receiving an insert member. For example, in some embodiments an insert member may include a toe cup at a forefoot portion of the article, a heel cup at a heel portion of the article, an arch support at an instep portion of the article, a padded layer for a tongue, and/or another insert member.

FIGS. 25 to 35 illustrate embodiments of a seamless bootie or textile upper including tucked in portions. Embodiments illustrated in FIGS. 25 to 35 are similar in that each includes a seamless bootie or textile upper of unitary warp knit construction, including a tucked-in portion that is continuous with the bootie at a closure structure of the bootie. In some embodiments, the tucked-in portions may provide a dynamic fit structure. In some embodiments, the tucked-in portions may provide a gusseted tongue structure.

Dynamic Fit Features

Figure 25:
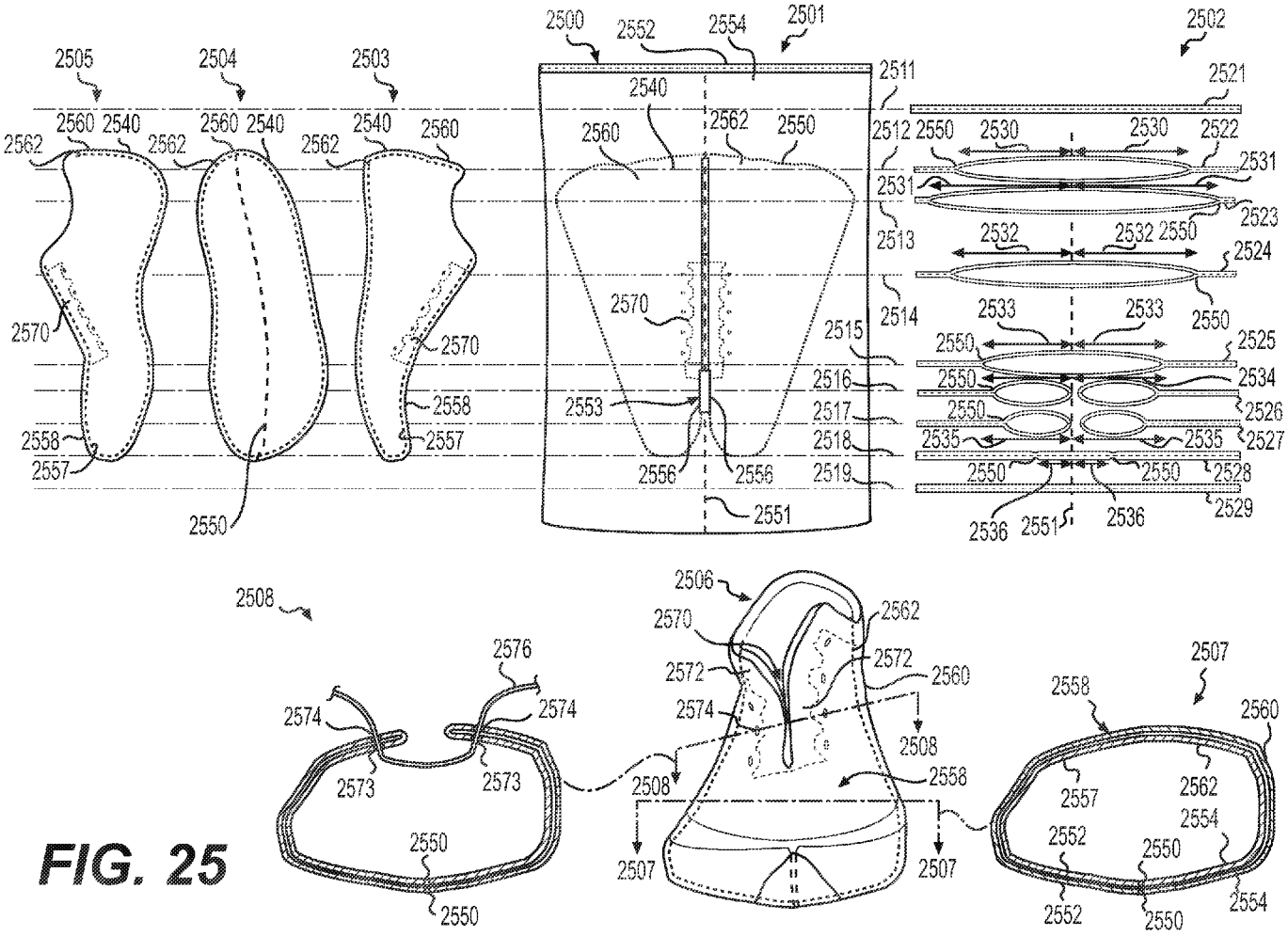
FIG. 25 schematically maps features of another embodiment of a knitted component of a knitted textile element to a seamless bootie or textile upper formed from the knitted component, including a seamless knitted dynamic fit component using continuous closure structure.

FIG. 25 schematically maps features of an embodiment of a knitted component 2540 of a knitted textile element 2500 to a seamless bootie or textile upper formed from the knitted component. In some embodiments, knitted component 2540 may include a knitted dynamic fit midsole component using continuous closure structure.

In FIG. 25, reference number 2501 identifies a figure of knitted textile element 2500 (hereafter referred to as reference figure 2501) and includes a sequence of section lines 2511-2519 that schematically map various features and characteristics of knitted component 2540 of knitted textile element 2500 across corresponding figures at reference numbers 2502, 2503, 2504, and 2505 (hereafter referred to as reference figures 2502, 2503, 2504, and 2505). Reference figure 2502 illustrates a sequence of cross-sectional views 2521 to 2529 associated with knitted component 2540 of knitted textile element 2500 taken along section lines 2511 to 2519; reference figure 2503 illustrates a medial side view of knitted component 2540; reference figure 2504 illustrates a bottom plan view of knitted component 2540; and reference figure 2505 illustrates a lateral side view of knitted component 2540. Reference number 2506 is a figure that illustrates a front isometric view of knitted component 2540 (hereafter reference figure 2506); reference number 2507 is a figure that illustrates a cross-sectional view of forefoot portion 2558 taken along section lines 2507-2507 of reference figure 2506 (hereafter reference figure 2507); and reference number 2508 is a figure that illustrates a cross-sectional view of forefoot portion 2558 of knitted component 2540 taken along section line 2508-2508 of reference figure 2506 (hereafter reference figure 2508).

Similar to knitted textile element 2100 in FIG. 21 and knitted textile element 2400 in FIG. 24, knitted textile element 2500 includes a first knit layer 2552 and a second knit layer 2554 that overlays first knit layer 2552, and knitted textile element 2500 is of unitary warp knit configuration. Referring to reference figure 2501, in this embodiment first knit layer 2552 is continuous with second knit layer 2554 along a common edge 2556 of a common opening 2553 that runs in a direction of manufacture or knitting process. It will be appreciated that knitted textile element 2500 may have a generally tubular configuration similar to knitted textile elements 200 and 2100 in FIGS. 2 and 21 or a generally flat two-layer configuration similar to knitted textile elements 2300 and 2400 in FIGS. 23 and 24. For purposes of brevity, and because various features and portion of a knitted textile element having a generally tubular configuration (e.g., FIGS. 2 to 8 and 21) correspond to and are interchangeable with features and portions of a knitted textile element having a generally flat two-layer construction (e.g., FIGS. 23 and 24), knitted textile element 2500 will be described with respect to a generally flat two-layer configuration.

Section line 2511 passes through knitted textile element 2500 above knitted component 2540, outside a peripheral boundary of knitted component 2540 defined by interlayer knit stitch line 2550. Accordingly, mapping section line 2511 in reference figure 2501 to reference figure 2502 presents a cross-section of knitted component 2500 in the form of a flat two-layer structure 2521 having no features associated with knitted component 2540. Likewise, reference figures 2503, 2504, and 2505 present no features associated with knitted component 2540 along section line 2511.

Section line 2512 passes through a rear heel portion of knitted component 2540. Mapping section line 2512 in reference figure 2501 to reference figure 2502 presents a cross-section of knitted textile element 2500 in the form of a generally flat two-layer structure 2522 having a pair of opposing nodes where interlayer knit stitch line 2550 interconnects first knit layer 2552 and second knit layer 2554 at a distance 2530 from a center line 2551 associated with common edge 2556 of knitted textile element 2500. It will be appreciated that, in some embodiments common edge 2556 of knitted component 2540 may function in a manner similar to common edge 210 of FIG. 2, common edge 2156 of FIG. 21, and common edge 2456 in that common edge 2556 may provide a continuous knitted layer common to first knit layer 2552 and second knit layer 2554 across a continuous surface of a forefoot portion 2558 of a knitted component 2540 of knitted textile element 2500.

Section line 2513 passes through a heel portion of knitted component 2540. Mapping section line 2513 in reference figure 2501 to reference figure 2502 presents a cross-section of knitted textile element 2500 in the form of a generally flat two-layer structure 2523 having a pair of opposing nodes where interlayer knit stitch line 2550 interconnects first knit layer 2552 and second knit layer 2554 at a distance 2531 from center line 2551.

Section line 2514 passes through a portion of a closure structure 2570 proximal to an ankle opening of knitted component 2540. Mapping section line 2514 in reference figure 2501 to reference figure 2502 presents a cross-section of knitted textile element 2500 in the form of a generally flat two-layer structure 2524 having a pair of opposing nodes where interlayer knit stitch line 2550 interconnects first knit layer 2552 and second knit layer 2554 at a distance 2532 from center line 2551.

Section line 2515 passes through a portion of closure structure 2570 proximal to forefoot portion 2558 of knitted component 2540. Mapping section line 2515 in reference figure 2501 to reference figure 2502 presents a cross-section of knitted textile element 2500 in the form of a generally flat two-layer structure 2525 having a pair of opposing nodes where interlayer knit stitch line 2550 interconnects first knit layer 2552 and second knit layer 2554 at a distance 2533 from center line 2551.

Section line 2516 passes through a forefoot portion 2558 of knitted component 2540. Mapping section line 2516 in reference figure 2501 to reference figure 2502 presents a cross-section of knitted textile element 2500 in the form of a generally flat two-layer structure 2526 having a pair of common edge portions 2556 and a pair of opposing nodes where interlayer knit stitch line 2550 interconnects first knit layer 2552 and second knit layer 2554 at a distance 2534 from center line 2551.

Section line 2517 also passes through forefoot portion 2558 of knitted component 2540. Mapping section line 2517 in reference figure 2501 to reference figure 2502 presents a cross-section of knitted textile element 2500 in the form of a generally flat two-layer structure 2527 having a pair of common edge portions 2556 and, and a pair of opposing nodes where interlayer knit stitch line 2550 interconnects first knit layer 2552 and second knit layer 2554 at a distance 2535 from center line 2551.

Section line 2518 touches and extends tangentially to forefoot portion 2558 of knitted component 2540. Mapping section line 2518 in reference figure 2501 to reference figure 2502 presents a cross-section of knitted textile element 2500 in the form of a generally flat two-layer structure 2528 having a pair of opposing nodes where interlayer knit stitch line 2550 interconnects first knit layer 2552 and second knit layer 2554 at a distance 2536 from center line 2551 (shown as a pair of opposing pinch portions in two-layer structure 2528 of reference figure 2502).

Section line 2519 passes through knitted textile element 2500 below knitted component 2540, outside a peripheral boundary of knitted component 2540 defined by interlayer knit stitch line 2550. Accordingly, mapping section line 2519 in reference figure 2501 to reference figure 2502 presents a cross-section of knitted component 2500 in the form of a flat two-layer structure 2529 having no features associated with knitted component 2540. Likewise, reference figures 2503, 2504, and 2505 present no features associated with knitted component 2540 along section line 2519.

Knitted component 2540 may be removed from knitted textile element 2500 by any known or later developed removing or separating process. For example, in some embodiments knitted component 2540 may be removed or separated from textile element 2500 by separating knitted textile element 2500 along interlayer knit stitch line 2550 of knitted component 2540 using a separating process, such as a cutting process, as discussed above with respect to FIGS. 2 to 8.

Post removal, knitted component 2540 may be manipulated and/or stretched to form a seamless bootie or textile upper, as generally shown in reference figures 2503 to 2508.

FIGS. 26 to 30 schematically illustrate an optional inversion process for a knitted component 2540 of FIG. 25, post removal, for folding or tucking in a second or secondary (e.g., inner) knitted component 2562 within a first or primary (e.g., outer) knitted component 2560.

Figure 26:
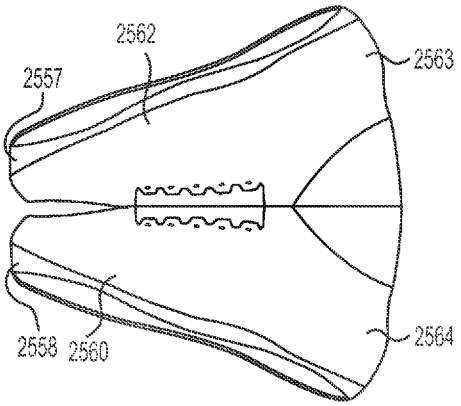
FIG. 26 schematically illustrates the knitted component of FIG. 25 in an initial post removal state.

FIG. 26 illustrates knitted component 2540 in an initial post removal state. FIG. 26 illustrates secondary (inner) knitted component 2562 disposed above primary (outer) knitted component 2562 prior to inversion process.

Figure 27:
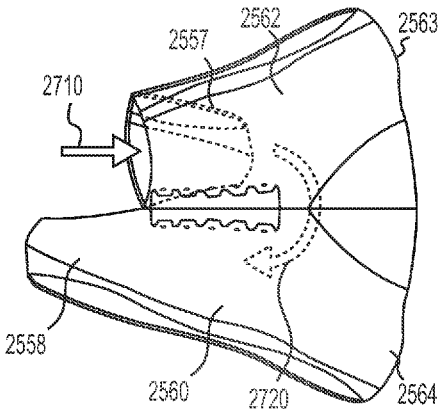
FIG. 27 schematically illustrates the knitted component of FIG. 26 with a toe portion of the inner knitted component portion inverted.

FIG. 27 illustrates knitted component 2540 with forefoot portion 2557 of secondary (inner) knitted component 2562 being pressed in a direction of arrow 2710 into a void formed between first knit layer 2552 and second knit layer 2554 of secondary (inner) knitted component 2562. As shown in FIG. 27, forefoot portion 2557 of secondary (inner) knitted component 2562 is then further pushed in, down, and back around in a direction of dashed arrow 2720 to tuck forefoot portion 2557 of secondary (inner) knitted component 2562 (shown in phantom) into a void formed between first knit layer 2552 and second knit layer 2554 of primary (outer) knitted component 2560 at forefoot portion 2558 of primary (outer) knitted component 2560.

Figure 28:
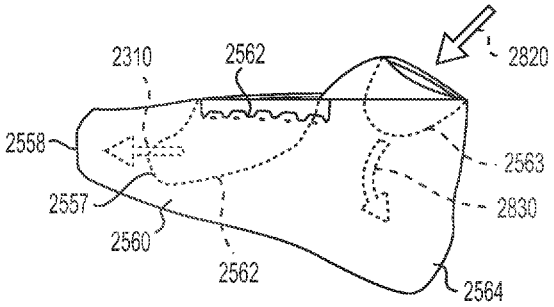
FIG. 28 schematically illustrates the knitted component of FIG. 27 with an inverted toe portion of the inner knitted component portion protruding through an ankle opening of an outer knitted component portion and a heel portion of the inner knitted component portion partially protruding through the ankle opening.

FIG. 28 illustrates forefoot portion 2557 of secondary (inner) knitted component 2562 (shown in phantom) being pushed further in a direction of dashed arrow 2810 and tucked further into forefoot portion 2558 of first (inner) knitted component 2560. FIG. 28 further shows heel portion 2563 of secondary (inner) knitted component 2562 being pushed in a direction of arrow 2820 into a void formed between first knit layer 2552 and second knit layer 2554 of primary (outer) knitted component 2560. Heel portion 2563 of secondary (inner) knitted component 2562 is then pushed further in a direction of dashed arrow 2830 into the void formed between first knit layer 2552 and second knit layer 254 at the heel portion 2564 of primary (outer) knitted component 2560.

Figure 29:
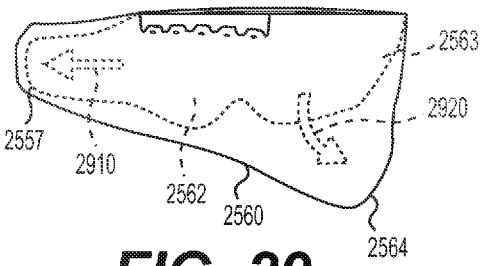
FIG. 29 schematically illustrates the knitted component of FIG. 28 with inverted toe, instep, and heel portions of the inner knitted component portion protruding through the ankle opening of the outer knitted component portion.

FIG. 29 illustrates forefoot portion 2557 of secondary (inner) knitted component 2562 being pushed further in a direction of dashed arrow 2910 to substantially tuck forefoot portion 2557 of secondary (inner) knitted portion 2562 into the void formed between first knit layer 2552 and second knit layer 2554 of forefoot portion 2558 of primary forefoot portion 2558 of primary (outer) knitted component 2560. FIG. 29 illustrates heel portion 2563 (shown in phantom) further being pushed in a direction of dashed arrow 2920 to substantially tuck heel portion 2563 of secondary (inner) knitted portion 2562 into heel portion 2564 of primary (outer) knitted component 2560.

Figure 30:
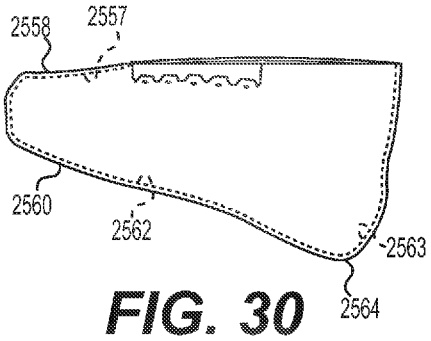
FIG. 30 schematically illustrates the knitted component of FIGS. 26 to 29 fully inverted or turned inside out, i.e., by folding an inner knitted component portion within another knitted component portion.

FIG. 30 illustrates secondary (inner) knitted component 2562 (shown in phantom) fully inverted, folded, or tucked into primary (outer) knitted component 2560. With this configuration, knitted component 2562 and knitted component 2560 may form a bootie-in-a-bootie configuration of a textile upper for an article of footwear. In some embodiments, a size and configuration of secondary (inner) knitted component 2562 may be substantially the same as a size and configuration of primary (outer) knitted component 2560. It will be appreciated, however, that in some embodiments a size of secondary (inner) knitted component 2562 may be made slightly less than a size of primary (outer) knitted component 2560 (e.g., for tolerance fit). In some embodiments, primary (outer) knitted component 2560 may be stretched more than secondary (inner) knitted component 2562. Those skilled in the art readily will be able to select a sizing and configuration suitable for a desired seamless bootie or textile upper.

Dimensions of knitted textile element 2500 and knitted component 2540 may be selected to provide desired sizing and/or custom fit and performance characteristics in a seamless bootie or textile upper formed from knitted component 2540, as generally described above with respect to knitted component 2100 in FIG. 21 and knitted component 2400 in figure 2400. For example, dimensions 2531-2536 may be selected to provide a desired sizing and/or custom fit. Those skilled in the art readily will be able to select dimensions for knitted component 2540 suitable to provide a desired sizing and/or custom fit of a seamless bootie or textile upper formed from knitted component 2540.

Reference figures 2503 to 2505 illustrate a seamless bootie or textile upper formed from knitted component 2540, including primary (outer) knitted component 2560 and secondary (inner) knitted component 2562, in a medial profile view, a bottom profile view, and a lateral profile view.

Reference figure 2506 illustrates a seamless bootie or textile upper formed from knitted component 2540 in a front profile view. Reference figure 2507 is a cross sectional view of the seamless bootie or textile upper taken along section line 2507-2507 of reference figure 2506, and reference figure 2508 is a cross sectional view of the seamless bootie or textile upper taken along section line 2508-2508 of reference figure 2506.

As shown in reference figure 2507, in some embodiments a seamless bootie or textile upper formed from knitted component 2540 may include two contiguous, continuous layers at forefoot portion 2557, 2558. That is, each of primary or outer knitted component 2560 and secondary or inner knitted component 2562 may include a continuous knitted layer formed by first knit layer 2552, first knit layer 2554, and interlayer knit stitch line 2550. In some embodiments, these two layers may be contiguous. In some embodiments, a sizing of secondary (inner) knitted component 2562 may be made smaller to facilitate custom fitting by dynamic fit.

In some embodiments, knitted component 2540 may include a closure system 2570, including closure members 2572, eyelets 2573 in secondary (inner) knitted component 2562, eyelets 2574 in primary (outer) knitted component 2560, and lacing 2576. In some embodiments, as shown in reference figure 2508, eyelets 2573 of secondary (inner) knitted component 2562 and eyelets 2574 of primary (outer) knitted component 2560 may be aligned or configure in registration with common lacing 2576. In some embodiments, by controlling a relative sizing of secondary (inner) knitted component 2562, a sizing of primary (outer) knitted component 2560, and optionally attachment of primary (outer) knitted component 2560 to a sole structure (see, e.g., sole structure of FIG. 1), secondary (inner) knitted structure 2562 may provide a dynamic fit for a user's foot using common lacing 2576.

Dynamic Fit Instep and Heel Features

Figure 31:
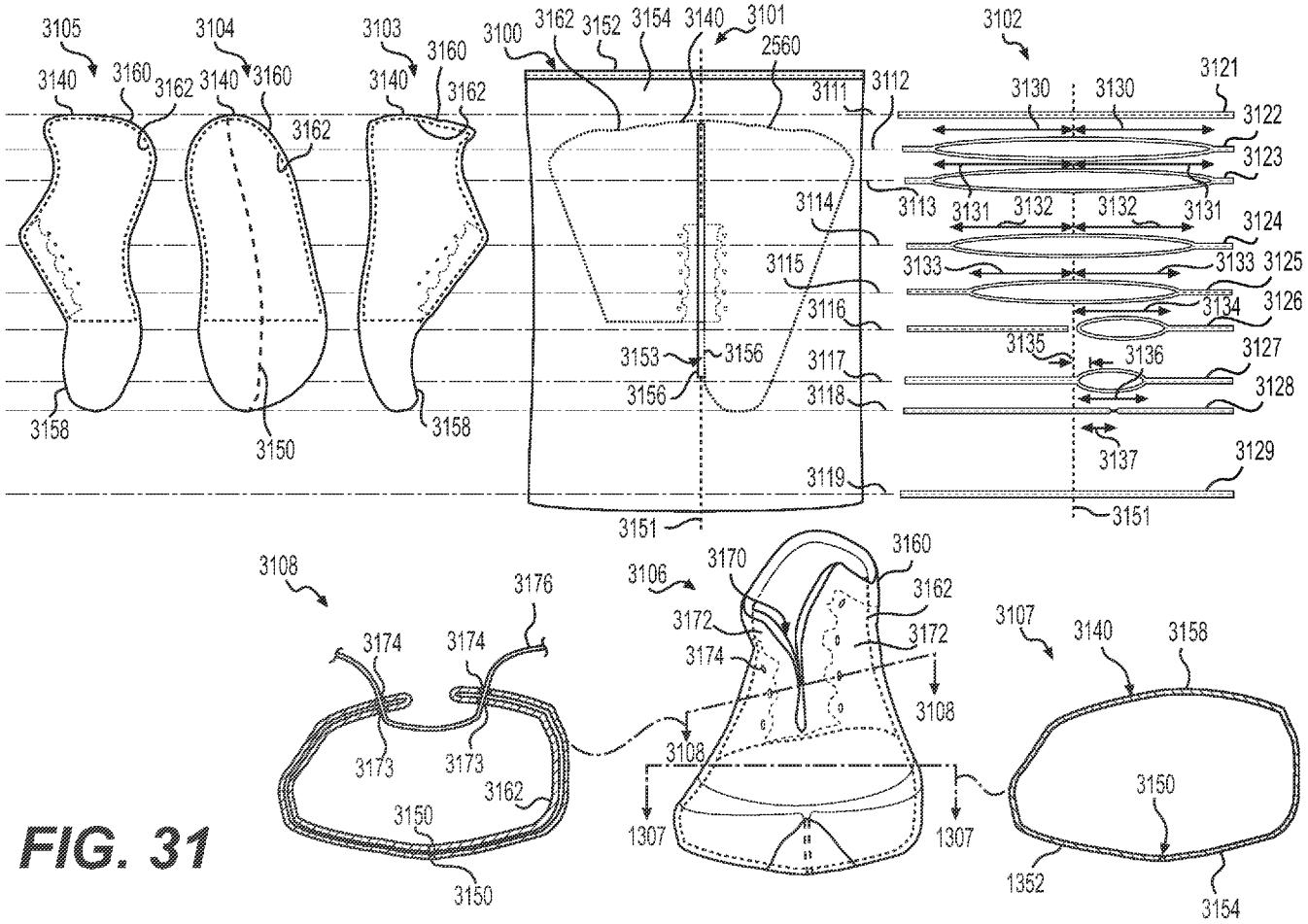
FIG. 31 schematically maps features of a knitted component of a knitted textile element to an embodiment of a seamless bootie or textile upper formed from the knitted component, including another seamless knitted dynamic fit midsole component using continuous closure structure.

FIG. 31 schematically maps features of another embodiment of a knitted component 3140 of a knitted textile element 3100 to a seamless bootie or textile upper formed from the knitted component. In some embodiments, knitted component 3140 of knitted textile element 3100 may include a knitted dynamic fit component using continuous closure structure.

In FIG. 31, reference number 3101 identifies a figure of knitted textile element 3100 (hereafter referred to as reference figure 3101) and includes a sequence of section lines 3111-3119 that schematically map various features and characteristics of knitted component 3140 of knitted textile element 3100 across corresponding figures at reference numbers 3102, 3103, 3104, and 3105 (hereafter referred to as reference figures 3102, 3103, 3104, and 3105). Reference figure 3102 illustrates a sequence of cross-sectional views 3121 to 3129 associated with knitted component 3140 of knitted textile element 3100 taken along section lines 3111 to 3119; reference figure 3103 illustrates a medial side view of knitted component 3140 post removal and inversion process; reference figure 3104 illustrates a bottom plan view of knitted component 3140 post removal and inversion process; and reference figure 3105 illustrates a lateral side view of knitted component 3140 post removal and inversion process. Reference number 3106 is a figure that illustrates a front isometric view of knitted component 3140 (hereafter reference figure 3106) post removal and inversion process; reference number 3107 is a figure that illustrates a cross-sectional view of forefoot portion 3158 taken along section lines 3107-3107 of reference figure 3106 (hereafter reference figure 3107); and reference number 3108 is a figure that illustrates a cross-sectional view of forefoot portion 3158 of the knitted component 3140 taken along section line 3108-3108 of reference figure 3106 (hereafter reference figure 3108).

Similar to knitted textile element 2500 in FIG. 25 knitted textile element 3100 includes a first knit layer 3152 and a second knit layer 3154 that overlays first knit layer 2552, and knitted textile element 3100 is of unitary warp knit configuration. Referring to reference figure 3101, in some embodiments first knit layer 3152 may be continuous with second knit layer 3154 along a common edge 3156 of a common opening 3153 that runs in a direction of manufacture or knitting process. It will be appreciated that in some embodiments knitted textile element 3100 may have a generally tubular configuration similar to knitted textile elements 200 and 2100 in FIGS. 2 and 21, and in some embodiments knitted textile element 3100 may have a generally flat two-layer configuration similar to knitted textile elements 2300 and 2400 in FIGS. 23 and 24. For purposes of brevity, knitted textile element 3100 will be described with respect to a generally flat two-layer configuration. Those skilled in the art readily will appreciate correspondence and interchangeability of various features and portions between a generally tubular structure (e.g., as shown in FIGS. 2 and 21) and a generally flat two-layer structure (e.g., as shown in FIGS. 23 and 24).

Section line 3111 passes through knitted textile element 3100 above knitted component 3140, outside a peripheral boundary of knitted component 3140 defined by interlayer knit stitch line 3150. Accordingly, mapping section line 3111 in reference figure 3101 to reference figure 3102 presents a cross-section of knitted component 3100 in the form of a flat two-layer structure 3121 having no features associated with knitted component 3140. Likewise, reference figures 3103, 3104, and 3105 present no features associated with knitted component 3140 along section line 3111.

Section line 3112 passes through a rear heel portion of knitted component 3140. Mapping section line 3112 in reference figure 3101 to reference figure 3102 presents a cross-section of knitted textile element 3100 in the form of a generally flat two-layer structure 3122 having a pair of opposing nodes where interlayer knit stitch line 3150 interconnects first knit layer 3152 and second knit layer 3154 at a distance 3130 from a center line 3151 associated with common edge 3156 of knitted textile element 3100. It will be appreciated that, in some embodiments common edge 3156 of knitted component 3140 may function in a manner similar to common edge 210 of FIG. 2, common edge 2156 of FIG. 21, common edge 2456 in FIG. 24, and common edge 2556 in FIG. 25, in that common edge 3156 may provide a continuous knitted layer common to first knit layer 3152 and second knit layer 3154 across a continuous surface of forefoot portion 3158 of knitted component 3140 of knitted textile element 3100.

Section line 3113 passes through a heel portion of knitted component 3140. Mapping section line 3113 in reference figure 3101 to reference figure 3102 presents a cross-section of knitted textile element 3100 in the form of a generally flat two-layer structure 3123 having a pair of opposing nodes where interlayer knit stitch line 3150 interconnects first knit layer 3152 and second knit layer 3154 at a distance 3131 from center line 3151.

Section line 3114 passes through a portion of a closure structure 3170 proximal to an ankle opening of knitted component 3140. Mapping section line 3114 in reference figure 3101 to reference figure 3102 presents a cross-section of knitted textile element 3100 in the form of a generally flat two-layer structure 3124 having a pair of opposing nodes where interlayer knit stitch line 3150 interconnects first knit layer 3152 and second knit layer 3154 at a distance 3132 from center line 3151.

Section line 3115 passes through a portion of closure structure 3170 proximal to forefoot portion 3158 of knitted component 3140. Mapping section line 3115 in reference figure 3101 to reference figure 3102 presents a cross-section of knitted textile element 3100 in the form of a generally flat two-layer structure 3125 having a pair of opposing nodes where interlayer knit stitch line 3150 interconnects first knit layer 3152 and second knit layer 3154 at a distance 3133 from center line 3151.

Section line 3116 passes through a forefoot portion 3158 of knitted component 3140. Mapping section line 3116 in reference figure 3101 to reference figure 3102 presents a cross-section of knitted textile element 3100 in the form of a generally flat two-layer structure 3126 having a common edge portion 3156 and a node where interlayer knit stitch line 3150 interconnects first knit layer 3152 and second knit layer 3154 at a distance 3134 from center line 3151.

Section line 3117 passes through forefoot portion 3158 of knitted component 3140. Mapping section line 3117 in reference figure 3101 to reference figure 3102 presents a cross-section of knitted textile element 3100 in the form of a generally flat two-layer structure 3127 having a first node where interlayer knit stitch line 3150 interconnects first knit layer 3152 and second knit layer 3154 at a distance 3135 from center line 3151, and a second node where interlayer knit line 3150 interconnects first knit layer 3152 and second knit layer 3154 at a distance 3136 from the first node.

Section line 3118 touches and extends tangentially to forefoot portion 3158 of knitted component 3140. Mapping section line 3118 in reference figure 3101 to reference figure 3102 presents a cross-section of knitted textile element 3100 in the form of a generally flat two-layer structure 3128 having a single node where interlayer knit stitch line 3150 interconnects first knit layer 3152 and second knit layer 3154 at a distance 3137 from center line 1351 (shown as a pinch in two-layer structure 3128 of reference figure 3102).

Section line 3119 passes through knitted textile element 3100 below knitted component 3140, outside a peripheral boundary of knitted component 3140 defined by interlayer knit stitch line 3150. Accordingly, mapping section line 3119 in reference figure 3101 to reference figure 3102 presents a cross-section of knitted component 3100 in the form of a flat two-layer structure 3129 having no features associated with knitted component 3140. Likewise, reference figures 3103, 3104, and 3105 present no features associated with knitted component 3140 along section line 3119.

Knitted component 3140 may be removed from knitted textile element 3100 by any known or later developed removing or separating process. In some embodiments, knitted component 3140 may be removed or separated from textile element 3100 by separating knitted textile element 3100 along interlayer knit stitch line 3150 of knitted component 3140 using a separating process, such as a cutting process, as discussed above with respect to FIGS. 2 to 8.

Post removal, knitted component 3140 may be manipulated and/or stretched to form a seamless bootie or textile upper, as generally shown in reference figures 3103-3108.

Post removal, knitted component 340 optionally may be inverted or tucked-in in a manner similar to FIGS. 26 to 30.

Dimensions of knitted textile element 3100 and knitted component 3140 may be selected to provide desired sizing and/or custom fit and performance characteristics in a seamless bootie or textile upper formed from knitted component 3140, as generally described above with respect to knitted component 2100 in FIG. 21 and knitted component 2400 in figure 2400. For example, dimensions 3131-3137 may be selected to provide a desired sizing and/or custom fit. Those skilled in the art readily will be able to select dimensions for knitted component 3140 suitable to provide a desired sizing and/or custom fit of a seamless bootie or textile upper formed from knitted component 3140.

Reference figures 3103 to 3105 illustrate a seamless bootie or textile upper formed from knitted component 3140, including primary or outer knitted component 3160 and secondary or inner knitted component 3162, in a medial profile view, a bottom profile view, and a lateral profile view.

Reference figure 3106 illustrates a seamless bootie or textile upper formed from knitted component 3140 in a front profile view. Reference figure 3107 is a cross sectional view of the seamless bootie or textile upper taken along section line 3107-3107 of reference figure 3106, and reference figure 3108 is a cross sectional view of the seamless bootie or textile upper taken along section line 3108-3108 of reference figure 3106.

As shown in reference figure 3107, in some embodiments a seamless bootie or textile upper formed from knitted component 3140 may include a continuous knitted layer at forefoot portion 2558. That is, primary (outer) knitted component 3160 may include a continuous knitted layer formed by first knit layer 3152, second knit layer 3154, and interlayer knit stitch line 3150.

In some embodiments, knitted component 3140 may include a closure system 3170, including closure members 3172, eyelets 3173 in secondary (inner) knitted component 3162, eyelets 3174 in primary (outer) knitted component 3160, and lacing 3176. In some embodiments, as shown in reference figure 3108, eyelets 3173 of secondary (inner) knitted component 3162 and eyelets 3174 of primary (outer) knitted component 3160 may be aligned or configured in registration with common lacing 3176. In some embodiments, by controlling a relative sizing of secondary (inner) knitted component 3162, a sizing of primary (outer) knitted component 3160, and optionally attachment of primary (outer) knitted component 3160 to a sole structure (see, e.g., sole structure of FIG. 1), secondary (inner) knitted structure 3162 may provide a dynamic fit for a user's foot using common lacing 3176.

Dynamic Fit Instep Features

Figure 32:
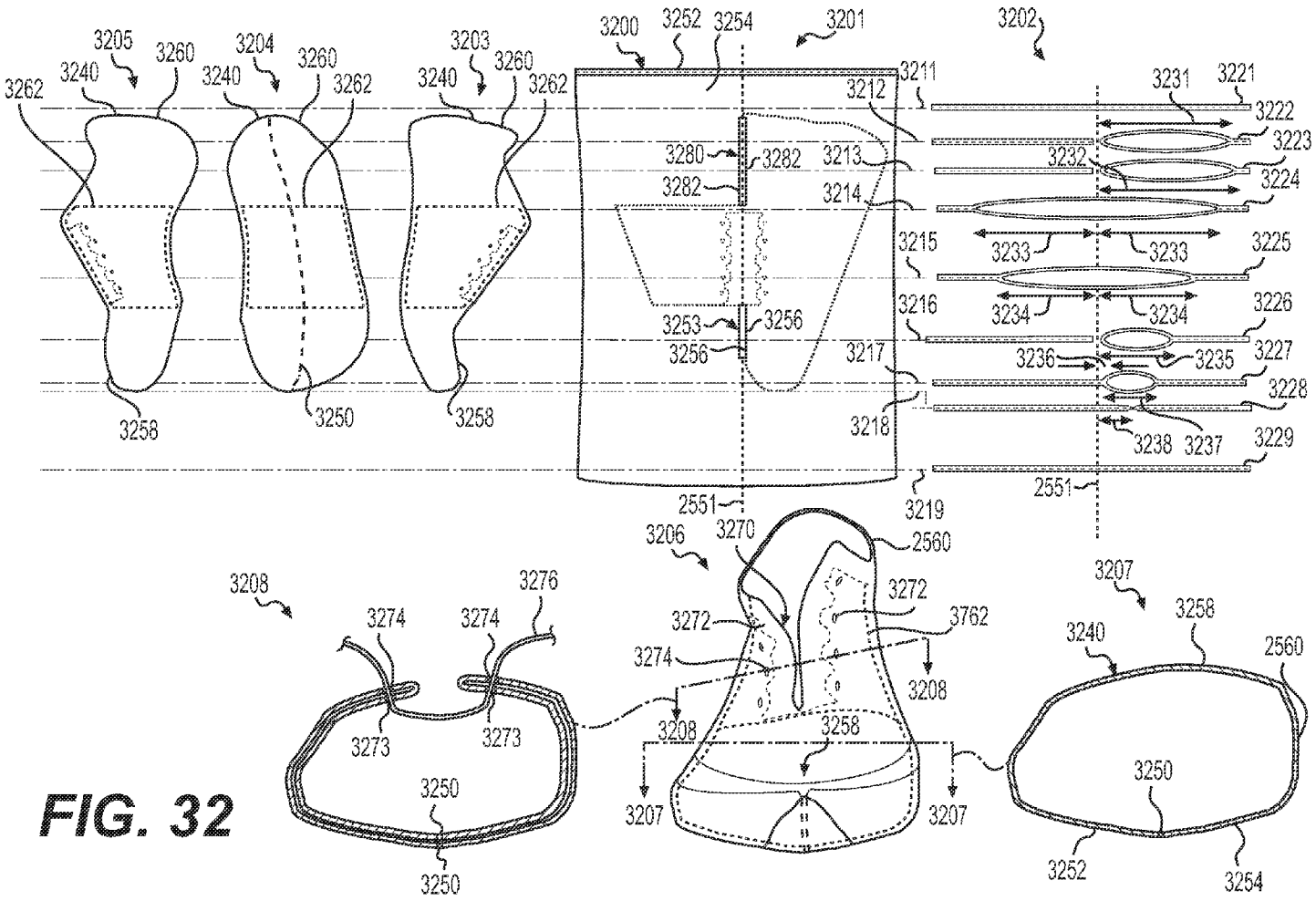
FIG. 32 schematically maps features of another embodiment of a knitted component of a knitted textile element to a seamless bootie or textile upper formed from the knitted component, including another seamless knitted dynamic fit component using continuous closure structure.

FIG. 32 schematically maps features of another embodiment of a knitted component 3240 of a knitted textile element 3200 to a seamless bootie or textile upper formed from the knitted component. In some embodiments, knitted component 3240 of knitted textile element 3200 may include a knitted dynamic fit midsole component using continuous closure structure.

In FIG. 32, reference number 3201 identifies a figure of knitted textile element 3200 (hereafter referred to as reference figure 3201) and includes a sequence of section lines 3211-3219 that schematically map various features and characteristics of knitted component 3240 of knitted textile element 3200 across corresponding figures at reference numbers 3202, 3203, 3204, and 3205 (hereafter referred to as reference figures 3202, 3203, 3204, and 3205). Reference figure 3202 illustrates a sequence of cross-sectional views 3221 to 3229 associated with knitted component 3240 of knitted textile element 3200 taken along section lines 3211 to 3219. Reference figure 3203 illustrates a medial side view of knitted component 3240 post removal and tucked-in; reference figure 3204 illustrates a bottom plan view of knitted component 3240 post removal and tucked-in; and reference FIG. 205 illustrates a lateral side view of knitted component 3240 post removal and tucked-in. Reference number 3206 is a figure that illustrates a front isometric view of knitted component 3240 (hereafter reference figure 3206); reference number 3207 is a figure that illustrates a cross-sectional view of forefoot portion 3258 taken along section line 3207-3207 of reference figure 3206 (hereafter reference figure 3207); and reference number 3208 is a figure that illustrates a cross-sectional view of forefoot portion 3258 of the knitted component 3240 taken along section line 3208-3208 of reference figure 3206 (hereafter reference figure 3208).

Similar to knitted textile element 2500 in FIG. 25 knitted textile element 3200 includes a first knit layer 3252 and a second knit layer 3254 that overlays first knit layer 2252, and knitted textile element 3200 is of unitary warp knit configuration. Referring to reference figure 3201, in some embodiments first knit layer 3252 may be continuous with second knit layer 3254 along a common edge 3256 of a common opening 3253 that runs in a direction of manufacture or knitting process. In some embodiments, first knit layer 3252 may be continuous with second knit layer 3254 along a common edge 3280 of a common opening 3282 that runs in a direction of manufacture or knitting process. It will be appreciated that in some embodiments knitted textile element 3200 may have a generally tubular configuration similar to knitted textile elements 200 and 2100 in FIGS. 2 and 21, and in some embodiments knitted textile element 3200 may have a generally flat two-layer configuration similar to knitted textile elements 2300 and 2400 in FIGS. 23 and 24. For purposes of brevity, knitted textile element 3200 will be described with respect to a generally flat two-layer configuration. Those skilled in the art readily will appreciate correspondence and interchangeability of various features and portions between a generally tubular structure (e.g., as shown in FIGS. 2 and 21) and a generally flat two-layer structure (e.g., as shown in FIGS. 23 and 24).

Section line 3211 passes through knitted textile element 3200 above knitted component 3240, outside a peripheral boundary of knitted component 3240 defined by interlayer knit stitch line 3250. Accordingly, mapping section line 3211 in reference figure 3201 to reference figure 3202 presents a cross-section of knitted component 3200 in the form of a flat two-layer structure 3221 having no features associated with knitted component 3240. Likewise, reference figures 3203, 3204, and 3205 present no features associated with knitted component 3240 along section line 3211.

Section line 3212 passes through a rear heel portion of knitted component 3240. Mapping section line 3212 in reference figure 3201 to reference figure 3202 presents a cross-section of knitted textile element 3200 in the form of a generally flat two-layer structure 3222 having a common edge 3280 and a node where interlayer knit stitch line 3250 interconnects first knit layer 3252 and second knit layer 3254 at a distance 3231 from a center line 3251 associated with common edge 3280 of knitted textile element 3200. It will be appreciated that, in some embodiments common edge 3280 of knitted component 3240 may function in a manner similar to common edge 210 of FIG. 2, common edge 2156 of FIG. 21, common edge 2456 in FIG. 24, and common edge 2556 in FIG. 25, in that common edge 3280 may provide a continuous knitted layer common to first knit layer 3252 and second knit layer 3254 suitable for separating and forming an ankle opening for knitted component 3240 of knitted textile element 3200.

Section line 3213 passes through a heel portion of knitted component 3240. Mapping section line 3213 in reference figure 3201 to reference figure 3202 presents a cross-section of knitted textile element 3200 in the form of a generally flat two-layer structure 3223 having a common edge 3280 and a node where interlayer knit stitch line 3250 interconnects first knit layer 3252 and second knit layer 3254 at a distance 3232 from a center line 3251 associated with common edge 3280 of knitted textile element 3200.

Section line 3214 passes through a portion of a closure structure 3270 proximal to an ankle opening of knitted component 3240. Mapping section line 3214 in reference figure 3201 to reference figure 3202 presents a cross-section of knitted textile element 3200 in the form of a generally flat two-layer structure 3224 having a pair of opposing nodes where interlayer knit stitch line 3250 interconnects first knit layer 3252 and second knit layer 3254 at a distance 3233 from center line 3251.

Section line 3115 passes through a portion of closure structure 3270 proximal to forefoot portion 3258 of knitted component 3240. Mapping section line 3215 in reference figure 3201 to reference figure 3202 presents a cross-section of knitted textile element 3200 in the form of a generally flat two-layer structure 3225 having a pair of opposing nodes where interlayer knit stitch line 3250 interconnects first knit layer 3252 and second knit layer 3254 at a distance 3234 from center line 3251.

Section line 3216 passes through a forefoot portion 3258 of knitted component 3240. Mapping section line 3216 in reference figure 3201 to reference figure 3202 presents a cross-section of knitted textile element 3200 in the form of a generally flat two-layer structure 3226 having a common edge portion 3256 and a node where interlayer knit stitch line 3250 interconnects first knit layer 3252 and second knit layer 3254 at a distance 3235 from center line 3251.

Section line 3217 passes through forefoot portion 3258 of knitted component 3240. Mapping section line 3217 in reference figure 3201 to reference figure 3202 presents a cross-section of knitted textile element 3200 in the form of a generally flat two-layer structure 3227 having a first node where interlayer knit stitch line 3250 interconnects first knit layer 3252 and second knit layer 3254 at a distance 3236 from center line 3251, and a node where interlayer knit line 3250 interconnects first knit layer 3252 and second knit layer 3254 at a distance 3237 from the first node.

Section line 3218 touches and extends tangentially to forefoot portion 3258 of knitted component 3240. Mapping section line 3218 in reference figure 3201 to reference figure 3202 presents a cross-section of knitted textile element 3200 in the form of a generally flat two-layer structure 3228 having a single node where interlayer knit stitch line 3250 interconnects first knit layer 3252 and second knit layer 3254 at a distance 3238 from center line 3251 (shown as a pinch in two-layer structure 3228 of reference figure 3202).

Section line 3219 passes through knitted textile element 3200 below knitted component 3240, outside a peripheral boundary of knitted component 3240 defined by interlayer knit stitch line 3250. Accordingly, mapping section line 3219 in reference figure 3201 to reference figure 3202 presents a cross-section of knitted component 3200 in the form of a flat two-layer structure 3229 having no features associated with knitted component 3240. Likewise, reference figures 3203, 3204, and 3205 present no features associated with knitted component 3240 along section line 3219.

Knitted component 3240 may be removed from knitted textile element 3200 by any known or later developed removing or separating process. In some embodiments, knitted component 3240 may be removed or separated from textile element 3200 by separating knitted textile element 3200 along interlayer knit stitch line 3250 of knitted component 3240 using a separating process, such as a cutting process, as discussed above with respect to FIGS. 2 to 8. Knitted component 3240 further may be separated along common edge 3280 of common opening 3282 by any known or later developed separating process to form an ankle opening. For example, in some embodiments common edge 3280 may be provided with one or more knitted indicating portions, and knitted component 3240 may be separated along the knitted indicating portions to form an ankle opening.

Post removal, knitted component 3240 may be manipulated and/or stretched to form a seamless bootie or textile upper, as generally shown in reference figures 3203-3208.

Post removal, knitted component 3240 optionally may be inverted or tucked-in in a manner similar to FIGS. 26 to 30.

Dimensions of knitted textile element 3200 and knitted component 3240 may be selected to provide desired sizing and/or custom fit and performance characteristics in a seamless bootie or textile upper formed from knitted component 3240, as generally described above with respect to knitted component 2100 in FIG. 21 and knitted component 2400 in figure 2400. For example, dimensions 3231-3238 may be selected to provide a desired sizing and/or custom fit. Those skilled in the art readily will be able to select dimensions for knitted component 3240 suitable to provide a desired sizing and/or custom fit of a seamless bootie or textile upper formed from knitted component 3240.

Reference figures 3203 to 3205 illustrate a seamless bootie or textile upper formed from knitted component 3240, including primary or outer knitted component 3260 and secondary or inner knitted component 3262, in a medial profile view, a bottom profile view, and a lateral profile view.

Reference figure 3206 illustrates a seamless bootie or textile upper formed from knitted component 3240 in a front profile view, post removal and tucked-in. Reference figure 3207 is a cross sectional view of the seamless bootie or textile upper taken along section line 3207-3207 of reference figure 3206, and reference figure 3208 is a cross sectional view of the seamless bootie or textile upper taken along section line 3208-3208 of reference figure 3206.

As shown in reference figure 3207, in some embodiments a seamless bootie or textile upper formed from knitted component 3240 may include a continuous knitted layer at forefoot portion 3258. That is, primary (outer) knitted component 3260 may include a continuous knitted layer formed by first knit layer 3252, second knit layer 3254, and interlayer knit stitch line 3250.

In some embodiments, knitted component 3240 may include a closure system 3270, including closure members 3272, eyelets 3273 in secondary (inner) knitted component 3262, eyelets 3274 in primary (outer) knitted component 3260, and lacing 3276. In some embodiments, as shown in reference figure 3208, eyelets 3273 of secondary (inner) knitted component 3262 and eyelets 3274 of primary (outer) knitted component 3260 may be aligned or configured in registration with common lacing 3276. In some embodiments, by controlling a relative sizing of secondary (inner) knitted component 3262, a sizing of primary (outer) knitted component 3260, and optionally attachment of primary (outer) knitted component 3260 to a sole structure (see, e.g., sole structure of FIG. 1), secondary (inner) knitted structure 3262 may provide a dynamic fit for a user's foot using common lacing 3276.

Figure 33:
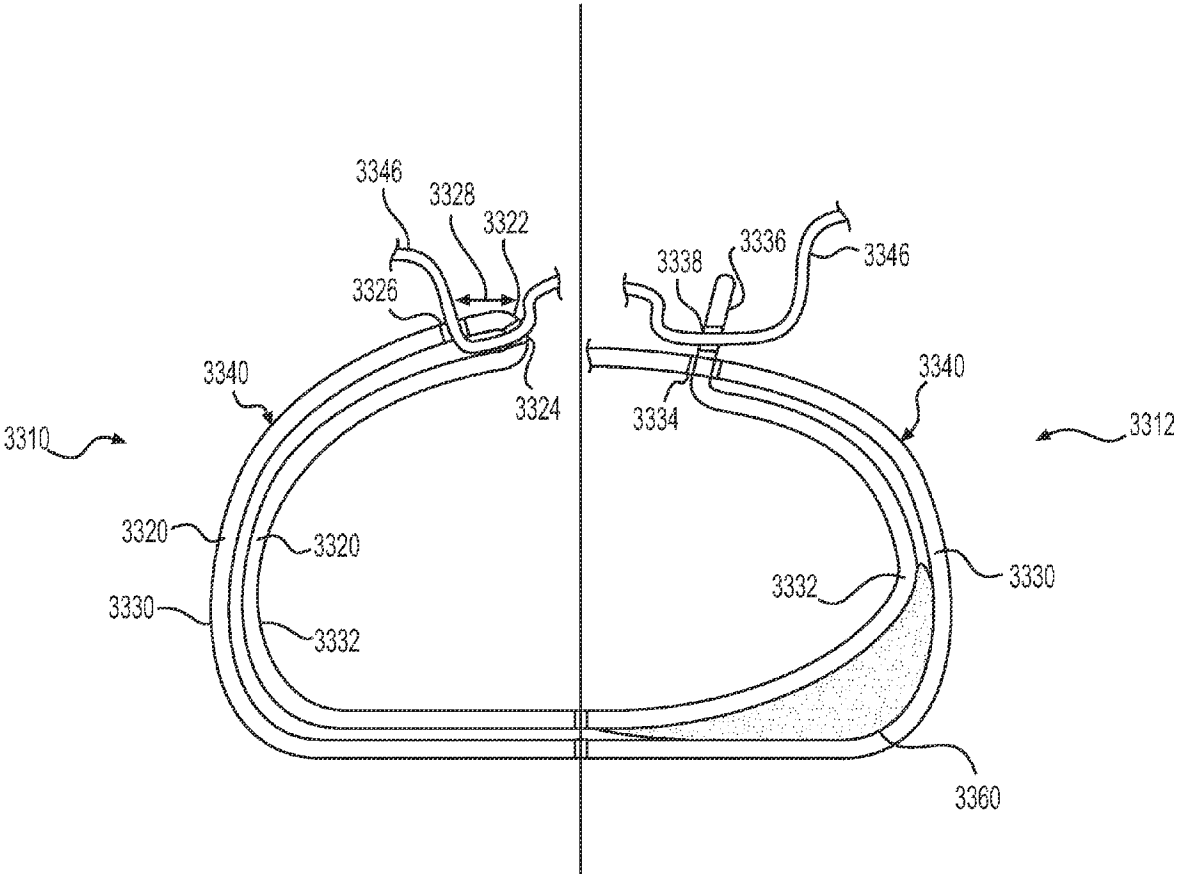
FIG. 33 is a schematic cross sectional view illustrating exemplary closure, tensioning, and/or dynamic fit structures.

FIG. 33 is a schematic cross sectional view illustrating additional embodiments of closure, tensioning, and/or dynamic fit structures for articles of footwear incorporating a knitted component. In some embodiments, structures illustrated in FIG. 33 may correspond to embodiments of knitted components illustrated in FIG. 25, FIG. 31, or FIG. 32. In some embodiments, structures illustrated in FIG. 33 may correspond to other embodiments of seamless booties or textile uppers.

In some embodiments, as shown on the left or medial side 3310 of FIG. 33, a knitted component 3340 may include a single knit layer 3320 that is folded back on itself at a common edge 3322 (e.g., tucked in) to form a continuous, double wall structure of a seamless bootie or textile upper. In some embodiments, single knit layer 3322 may be provided with a first eyelet (hole) 3324 formed proximate edge 3322 and a second eyelet (hole) 3326 formed at a distance 3328 from edge 3322. In some embodiments, second eyelet 3326 may be formed in exposed outer layer 3330, as shown in FIG. 33. In some embodiments, second eyelet 3326 may be formed in interior layer 3332. Distance 3328 may vary based on various factors, including an overall configuration of a closure, tensioning, or dynamic fit configuration of the article of footwear. Those skilled in the art readily will be able to select a configuration of first eyelet 3324 and second eyelet 3326 suitable for a desired closure, tensioning, or dynamic fit configuration or system of the seamless bootie or textile upper.

In some embodiments, as shown on the right or lateral side 3312 of FIG. 33, knitted component 3340 may include an exposed first knit layer 3330 and an interior second knit layer 3332. In some embodiments, first knit layer 3330 and second knit layer 3332 may be arranged substantially in parallel with one another to form a double walled structure of a seamless bootie or textile upper. In some embodiments, one of the first knit layer 3330 and the second knit layer 3332 may be provided with an opening (e.g., a hole or slot) through which a closure member (e.g., a tab, finger, ribbon, or other closure structure) of the other one of the first layer and the second layer may be fed. In some embodiments, the closure member may be provided with an eyelet (hole) for receiving lacing or other tensioning structure (e.g., cabling) of a closure or tensioning system. For example, as shown in FIG. 33, in some embodiments exposed first knit layer 3330 may be provided with slot 3334 for receiving a tab or finger component 3336 of interior second knit layer 3332, and interior second knit layer further may be provided with an eyelet (hole) 3338 for receiving lacing 3346. In this case, lacing 3346 may be provided on the exposed exterior side of knitted component 3340 of the seamless bootie or textile upper. In some embodiments, however, the interior knit layer may be provided with an opening (e.g., slot or hole) for receiving a closure member (e.g., a tab or finger component) of the exposed exterior knit layer, and the closure member of the exposed exterior knit layer may be provided with an eyelet for receiving lacing or other tensioning structure located on an interior side of the double walled seamless bootie or textile upper. Those skilled in the art readily will be able to select closure, tensioning, and/or dynamic fit structure and configuration suitable for a desired application.

As also shown in FIG. 33 (i.e., lateral side 3312), in some embodiments an insert member 3360 may be disposed in a pocket formed between first knit layer 3330 and second knit layer 3332. For example, insert member 3360 may be an arch support located in a midfoot region of a knitted component.

Gusseted Tongue Features

Figure 34:
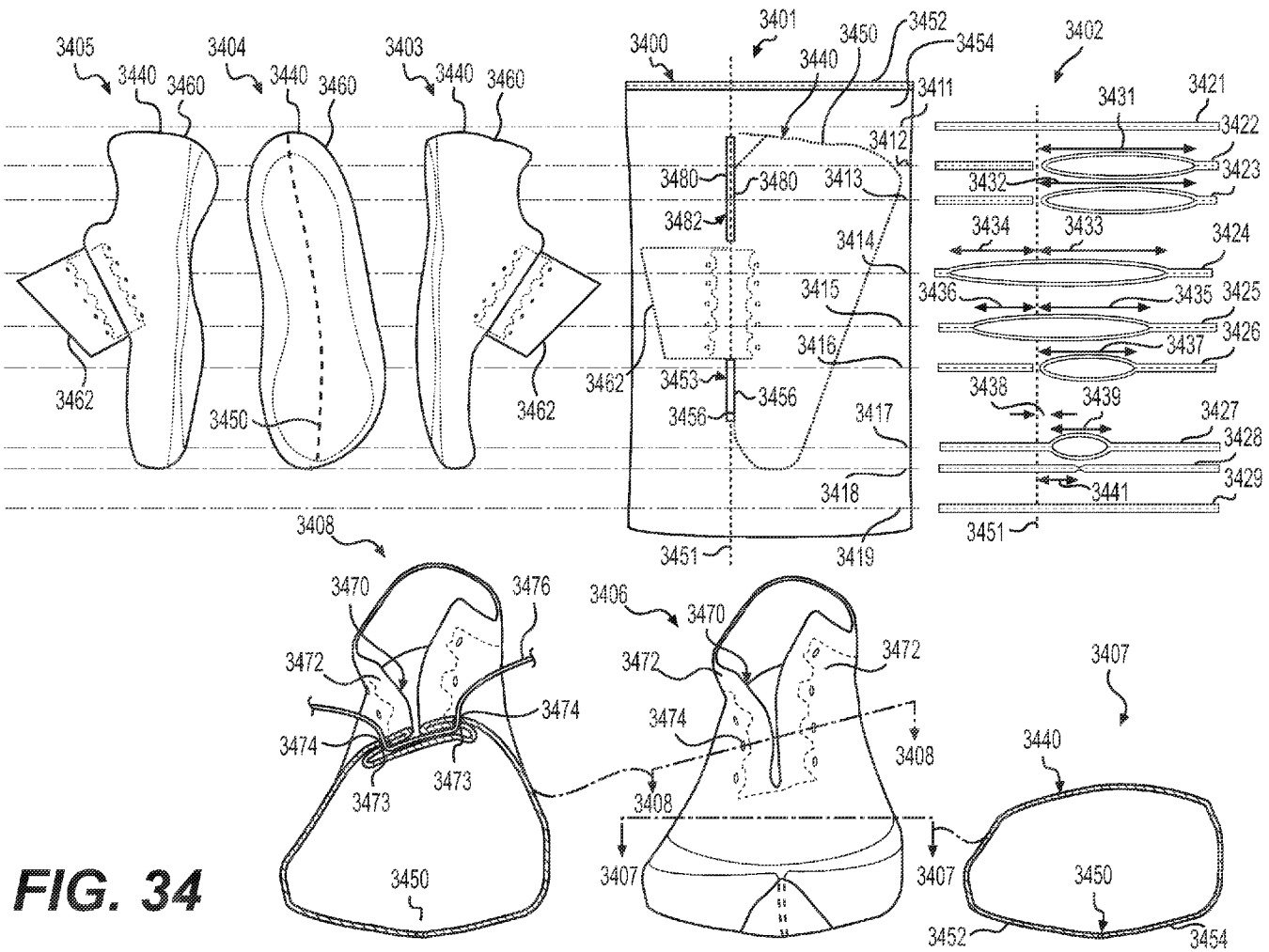
FIG. 34 schematically maps features of another embodiment of a knitted component of a knitted textile element to a seamless bootie or textile upper formed from the knitted component, including a seamless knitted tongue component using continuous closure structure.

FIG. 34 schematically maps features of another embodiment of a knitted component 3440 of a knitted textile element 3400 to a seamless bootie or textile upper formed from the knitted component including a tucked-in portion. In some embodiments, knitted component 3440 of knitted textile element 3400 may include a knitted gusseted tongue component using continuous closure structure.

In FIG. 34, reference number 3401 identifies a figure of knitted textile element 3400 (hereafter referred to as reference figure 3401) and includes a sequence of section lines 3411-3419 that schematically map various features and characteristics of knitted component 3440 of knitted textile element 3400 across corresponding figures at reference numbers 3402, 3403, 3404, and 3405 (hereafter referred to as reference figures 3402, 3403, 3404, and 3405). Reference figure 3402 illustrates a sequence of cross-sectional views 3421 to 3429 associated with knitted component 3440 of knitted textile element 3400 taken along section lines 3411 to 3419. Reference figure 3403 illustrates a medial side view of knitted component 3440 post removal and tucked-in; reference figure 3404 illustrates a bottom plan view of knitted component 3440 post removal and tucked-in; and reference figure 3405 illustrates a lateral side view of knitted component 3440 post removal and tucked-in. Reference number 3406 is a figure that illustrates a front isometric view of knitted component 3440 (hereafter reference figure 3406) post removal and tucked-in; reference number 3407 is a figure that illustrates a cross-sectional view of forefoot portion 3458 taken along section line 3407-3407 of reference figure 3406 (hereafter reference figure 3407); and reference number 3408 is a figure that illustrates a cross-sectional view of forefoot portion 3458 of the knitted component 3440 taken along section line 3408-3408 of reference figure 3406 (hereafter reference figure 3408).

Similar to knitted textile element 2500 in FIG. 25 knitted textile element 3400 includes a first knit layer 3452 and a second knit layer 3454 that overlays first knit layer 3452, and knitted textile element 3400 is of unitary warp knit configuration. Referring to reference figure 3401, in some embodiments first knit layer 3452 may be continuous with second knit layer 3454 along a common edge 3456 of a common opening 3453 that runs in a direction of manufacture or knitting process. In some embodiments, first knit layer 3452 may be continuous with second knit layer 3454 along a common edge 3480 of a common opening 3482 that runs in a direction of manufacture or knitting process. It will be appreciated that in some embodiments knitted textile element 3400 may have a generally tubular configuration similar to knitted textile elements 200 and 2100 in FIGS. 2 and 21, and in some embodiments knitted textile element 3400 may have a generally flat two-layer configuration similar to knitted textile elements 2300 and 2400 in FIGS. 23 and 24. For purposes of brevity, knitted textile element 3400 will be described with respect to a generally flat two-layer configuration. Those skilled in the art readily will appreciate correspondence and interchangeability of various features and portions between a generally tubular structure (e.g., as shown in FIGS. 2 and 21) and a generally flat two-layer structure (e.g., as shown in FIGS. 23 and 24).

Section line 3411 passes through knitted textile element 3400 above knitted component 3440, outside a peripheral boundary of knitted component 3440 defined by interlayer knit stitch line 3450. Accordingly, mapping section line 3411 in reference figure 3401 to reference figure 3402 presents a cross-section of knitted component 3400 in the form of a flat two-layer structure 3421 having no features associated with knitted component 3440. Likewise, reference figures 3403, 3404, and 3405 present no features associated with knitted component 3440 along section line 3411.

Section line 3412 passes through a rear heel portion of knitted component 3440. Mapping section line 3412 in reference figure 3401 to reference figure 3402 presents a cross-section of knitted textile element 3400 in the form of a generally flat two-layer structure 3422 having a common edge 3480 and a node where interlayer knit stitch line 3450 interconnects first knit layer 3452 and second knit layer 3454 at a distance 3431 from a center line 3451 associated with common edge 3480 of knitted textile element 3400. It will be appreciated that, in some embodiments common edge 3480 of knitted component 3440 may function in a manner similar to common edge 210 of FIG. 2, common edge 2156 of FIG. 21, common edge 2456 in FIG. 24, and common edge 2556 in FIG. 25, in that common edge 3480 may provide a continuous knitted layer common to first knit layer 3452 and second knit layer 3454 suitable for separating and forming an ankle opening for knitted component 3440 of knitted textile element 3400.

Section line 3413 passes through a heel portion of knitted component 3440. Mapping section line 3413 in reference figure 3401 to reference figure 3402 presents a cross-section of knitted textile element 3400 in the form of a generally flat two-layer structure 3423 having a common edge 3480 and a node where interlayer knit stitch line 3450 interconnects first knit layer 3452 and second knit layer 3454 at a distance 3432 from a center line 3451 associated with common edge 3480 of knitted textile element 3400.

Section line 3414 passes through a portion of a closure structure 3470 proximal to an ankle opening of knitted component 3440. Mapping section line 3414 in reference figure 3401 to reference figure 3402 presents a cross-section of knitted textile element 3400 in the form of a generally flat two-layer structure 3424 having a pair of asymmetrically arranged opposing nodes where interlayer knit stitch line 3450 interconnects first knit layer 3452 and second knit layer 3454 at a distance 3433 on one side of center line 3451, corresponding to a body of a seamless bootie or textile upper 3460, and at a distance 3434 on the other side of center line 3451, corresponding to a gusseted tongue portion 3462 of the seamless bootie or textile upper 3460.

Section line 3415 passes through a portion of closure structure 3470 proximal to forefoot portion 3458 of knitted component 3440. Mapping section line 3415 in reference figure 3401 to reference figure 3402 presents a cross-section of knitted textile element 3400 in the form of a generally flat two-layer structure 3425 having a pair of asymmetrically arranged opposing nodes where interlayer knit stitch line 3450 interconnects first knit layer 3452 and second knit layer 3454 at a first distance 3435 on one side of center line 3451, corresponding to the body of the seamless bootie or textile upper 3460, and at a distance 3436 on the other side of center line 3451, corresponding to the gusseted tongue portion 3462 of the seamless bootie or textile upper 3460.

Section line 3416 passes through a forefoot portion 3458 of knitted component 3440. Mapping section line 3416 in reference figure 3401 to reference figure 3402 presents a cross-section of knitted textile element 3400 in the form of a generally flat two-layer structure 3426 having a common edge portion 3456 and a node where interlayer knit stitch line 3450 interconnects first knit layer 3452 and second knit layer 3454 at a distance 3437 from center line 3451.

Section line 3417 passes through forefoot portion 3458 of knitted component 3440. Mapping section line 3417 in reference figure 3401 to reference figure 3402 presents a cross-section of knitted textile element 3400 in the form of a generally flat two-layer structure 3427 having a first node where interlayer knit stitch line 3450 interconnects first knit layer 3452 and second knit layer 3454 at a distance 3438 from center line 3451, and a second node where interlayer knit line 3450 interconnects first knit layer 3452 and second knit layer 3454 at a distance 3439 from the first node.

Section line 3418 touches and extends tangentially to forefoot portion 3458 of knitted component 3440. Mapping section line 3418 in reference figure 3401 to reference figure 3402 presents a cross-section of knitted textile element 3400 in the form of a generally flat two-layer structure 3428 having a single node where interlayer knit stitch line 3450 interconnects first knit layer 3452 and second knit layer 3454 at a distance 3441 from center line 3451 (shown as a pinch in two-layer structure 3428 of reference figure 3402).

Section line 3419 passes through knitted textile element 3400 below knitted component 3440, outside a peripheral boundary of knitted component 3440 defined by interlayer knit stitch line 3450. Accordingly, mapping section line 3419 in reference figure 3401 to reference figure 3402 presents a cross-section of knitted component 3400 in the form of a flat two-layer structure 3429 having no features associated with knitted component 3440. Likewise, reference figures 3403, 3404, and 3405 present no features associated with knitted component 3440 along section line 3419.

Knitted component 3440 may be removed from knitted textile element 3400 by any known or later developed removing or separating process. In some embodiments, knitted component 3440 may be removed or separated from textile element 3400 by separating knitted textile element 3400 along interlayer knit stitch line 3450 of knitted component 3440 using a separating process, such as a cutting process, as described above with respect to FIGS. 2 to 8. Knitted component 3440 further may be separated along common edge 3480 of common opening 3482 by any known or later developed separating process to form an ankle opening. For example, in some embodiments common edge 3480 may be provided with one or more knitted indicating portions, and knitted component 3440 may be separated along the knitted indicating portions to form an ankle opening.

Post removal, knitted component 3440 may be manipulated and/or stretched to form a seamless bootie or textile upper, as generally shown in reference figures 3203-3208.

Post removal, knitted component 3240 may be inverted or tucked-in in a manner similar to FIGS. 26 to 30.

Dimensions of knitted textile element 3400 and knitted component 3440 may be selected to provide desired sizing and/or custom fit and performance characteristics in a seamless bootie or textile upper formed from knitted component 3440, as generally described above with respect to knitted component 2100 in FIG. 21 and knitted component 2400 in figure 2400. For example, dimensions 3431-3139 and 3441 may be selected to provide a desired sizing and/or custom fit. Those skilled in the art readily will be able to select dimensions for knitted component 3440 suitable to provide a desired sizing and/or custom fit of a seamless bootie or textile upper formed from knitted component 3440.

Reference figures 3403 to 3405 illustrate a seamless bootie or textile upper formed from knitted component 3440, post removal and tucked-in, including knitted bootie component 3460 and knitted gusseted tongue component 3462, in a medial profile view, a bottom profile view, and a lateral profile view.

Reference figure 3406 illustrates a seamless bootie or textile upper formed from knitted component 3440 in a front profile view, post removal and tucked-in. Reference figure 3407 is a cross sectional view of the seamless bootie or textile upper taken along section line 3407-3407 of reference figure 3406, and reference figure 3408 is a cross sectional view of the seamless bootie or textile upper taken along section line 3408-3408 of reference figure 3406.

As shown in reference figure 3407, in some embodiments a seamless bootie or textile upper formed from knitted component 3440 may include a continuous knitted layer at forefoot portion 3458. That is, knitted bootie component 3260 may include a continuous knitted layer formed by first knit layer 3452, second knit layer 3454, and interlayer knit stitch line 3450.

In some embodiments, knitted component 3440 may include a closure system 3470, including closure members 3472, eyelets 3473 in knitted gusseted tongue component 3262, eyelets 3274 in knitted bootie component 3460, and lacing 3476. In some embodiments, as shown in reference figure 3408, eyelets 3473 of knitted gusseted tongue component 3462 and eyelets 3474 of knitted component 3460 may be aligned with common lacing 3476.

Gusseted Tongue with Tab Features

Figure 35:
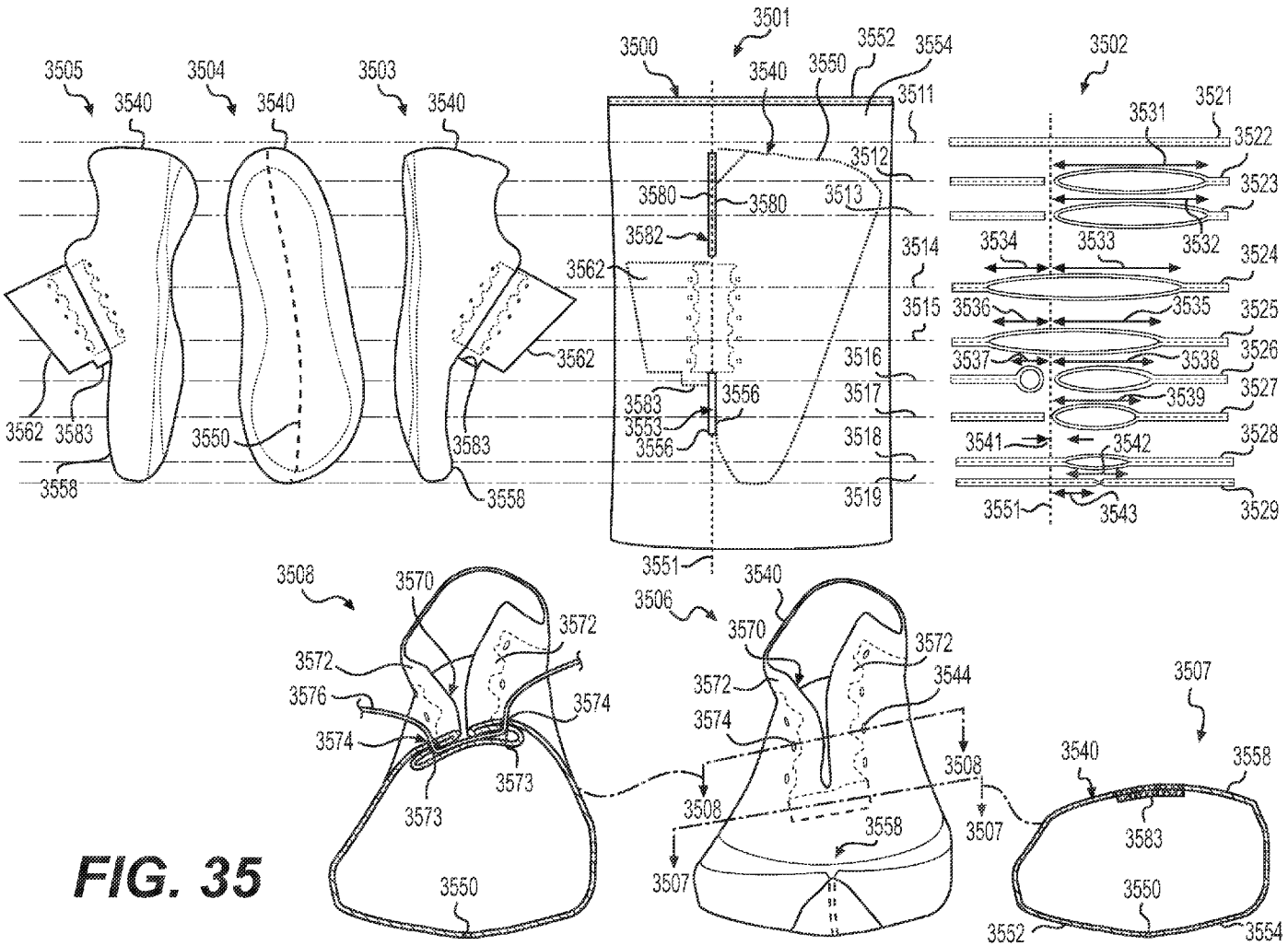
FIG. 35 schematically maps features of another embodiment of a knitted component of a knitted textile element to a seamless bootie or textile upper formed from the knitted component, including a seamless knitted tongue component using continuous closure structure.

FIG. 35 schematically maps features of another embodiment of a knitted component 3540 of a knitted textile element 3500 to a seamless bootie or textile upper formed from the knitted component, including a tucked-in portion. In some embodiments, knitted component 3540 of knitted textile element 3500 may include a knitted gusseted tongue component with tab, using continuous closure structure.

In FIG. 35, reference number 3501 identifies a figure of knitted textile element 3500 (hereafter referred to as reference figure 3501) and includes a sequence of section lines 3511-3519 that schematically map various features and characteristics of knitted component 3540 of knitted textile element 3500 across corresponding figures at reference numbers 3502, 3503, 3504, and 3505 (hereafter referred to as reference figures 3502, 3503, 3504, and 3505). Reference figure 3502 illustrates a sequence of cross-sectional views 3521 to 3529 associated with knitted component 3540 of knitted textile element 3500 taken along section lines 3511 to 3519. Reference figure 3503 illustrates a medial side view of knitted component 3540 post removal and tucked-in; reference figure 3504 illustrates a bottom plan view of knitted component 3540 post removal and tucked-in; and reference figure 3505 illustrates a lateral side view of knitted component 3540 post removal and tucked-in. Reference number 3506 is a figure that illustrates a front isometric view of knitted component 3540 (hereafter reference figure 3506); reference number 3507 is a figure that illustrates a cross-sectional view of forefoot portion 3558 taken along section line 3507-3507 of reference figure 3506 (hereafter reference figure 3507); and reference number 3508 is a figure that illustrates a cross-sectional view of forefoot portion 3558 of the knitted component 3540 taken along section line 3508-3508 of reference figure 3506 (hereafter reference figure 3508).

Similar to knitted textile element 2500 in FIG. 25 knitted textile element 3500 includes a first knit layer 3552 and a second knit layer 3554 that overlays first knit layer 3552, and knitted textile element 3500 is of unitary warp knit configuration. Referring to reference figure 3501, in some embodiments first knit layer 3552 may be continuous with second knit layer 3554 along a common edge 3556 of a common opening 3553 that runs in a direction of manufacture or knitting process. In some embodiments, first knit layer 3552 may be continuous with second knit layer 3554 along a common edge 3580 of a common opening 3582 that runs in a direction of manufacture or knitting process. It will be appreciated that in some embodiments knitted textile element 3500 may have a generally tubular configuration similar to knitted textile elements 200 and 2100 in FIGS. 2 and 21, and in some embodiments knitted textile element 3500 may have a generally flat two-layer configuration similar to knitted textile elements 2300 and 2400 in FIGS. 23 and 24. For purposes of brevity, knitted textile element 3500 will be described with respect to a generally flat two-layer configuration. Those skilled in the art readily will appreciate correspondence and interchangeability of various features and portions between a generally tubular structure (e.g., as shown in FIGS. 2 and 21) and a generally flat two-layer structure (e.g., as shown in FIGS. 23 and 24).

Section line 3511 passes through knitted textile element 3500 above knitted component 3540, outside a peripheral boundary of knitted component 3540 defined by interlayer knit stitch line 3550. Accordingly, mapping section line 3511 in reference figure 3501 to reference figure 3502 presents a cross-section of knitted component 3500 in the form of a flat two-layer structure 3521 having no features associated with knitted component 3540. Likewise, reference figures 3503, 3504, and 3505 present no features associated with knitted component 3540 along section line 3511.

Section line 3512 passes through a rear heel portion of knitted component 3540. Mapping section line 3512 in reference figure 3501 to reference figure 3502 presents a cross-section of knitted textile element 3500 in the form of a generally flat two-layer structure 3522 having a common edge 3580 and a node where interlayer knit stitch line 3550 interconnects first knit layer 3552 and second knit layer 3554 at a distance 3531 from a center line 3551 associated with common edge 3580 of knitted textile element 3500. It will be appreciated that, in some embodiments common edge 3580 of knitted component 3540 may function in a manner similar to common edge 210 of FIG. 2, common edge 2156 of FIG. 21, common edge 2456 in FIG. 24, and common edge 2556 in FIG. 25, in that common edge 3580 may provide a continuous knitted layer common to first knit layer 3552 and second knit layer 3554 suitable for separating and forming an ankle opening for knitted component 3540 of knitted textile element 3500.

Section line 3513 passes through a heel portion of knitted component 3540. Mapping section line 3513 in reference figure 3501 to reference figure 3502 presents a cross-section of knitted textile element 3500 in the form of a generally flat two-layer structure 3523 having a common edge 3580 and a node where interlayer knit stitch line 3550 interconnects first knit layer 3552 and second knit layer 3554 at a distance 3532 from a center line 3551 associated with common edge 3580 of knitted textile element 3500.

Section line 3514 passes through a portion of a closure structure 3570 proximal to an ankle opening of knitted component 3540. Mapping section line 3514 in reference figure 3501 to reference figure 3502 presents a cross-section of knitted textile element 3500 in the form of a generally flat two-layer structure 3524 having a pair of asymmetrically arranged opposing nodes where interlayer knit stitch line 3550 interconnects first knit layer 3552 and second knit layer 3554 at a distance 3533 on one side of center line 3551, corresponding to a body of a seamless bootie or component 3560, and at a distance 3534 on the other side of center line 3551, corresponding to a gusseted tongue portion 3562 of the knitted bootie component 3560.

Section line 3515 passes through a portion of closure structure 3570 proximal to forefoot portion 3558 of knitted component 3540. Mapping section line 3515 in reference figure 3501 to reference figure 3502 presents a cross-section of knitted textile element 3500 in the form of a generally flat two-layer structure 3525 having a pair of asymmetrically arranged opposing nodes where interlayer knit stitch line 3550 interconnects first knit layer 3552 and second knit layer 3554 at a first distance 3535 on one side of center line 3551, corresponding to the body of the seamless knitted bootie component 3560, and at a distance 3536 on the other side of center line 3551, corresponding to the gusseted tongue portion 3562 of the knitted bootie component 3560.

Section line 3516 passes through a forefoot portion 3558 of knitted component 3540. Mapping section line 3516 in reference figure 3501 to reference figure 3502 presents a cross-section of knitted textile element 3500 in the form of a generally flat two-layer structure 3526 having a common edge portion 3556 and a node where interlayer knit stitch line 3550 interconnects first knit layer 3552 and second knit layer 3554 at a distance 3538 on one side of center line 3551 corresponding to the body of a knitted bootie component 3560. Two-layer structure 3526 further includes common edge 3556 and a node where interlayer knit stitch line 3550 interconnects first knit layer 3552 and second knit layer 3554 at a distance 3537 on the other side of center line 3551, corresponding to a tab on gusseted tongue 3562.

Section line 3517 passes through forefoot portion 3558 of knitted component 3540. Mapping section line 3517 in reference figure 3501 to reference figure 3502 presents a cross-section of knitted textile element 3500 in the form of a generally flat two-layer structure 3527 having a common edge 3556 and a node where interlayer knit stitch line 3550 interconnects first knit layer 3552 and second knit layer 3554 at a distance 3539 from center line 3551.

Section line 3518 passes through forefoot portion 3558 of knitted component 3540. Mapping section line 3518 in reference figure 3501 to reference figure 3502 presents a cross-section of knitted textile element 3500 in the form of a generally flat two-layer structure 3528 having a node where interlayer knit stitch line 3550 interconnects first knit layer 3552 and second knit layer 3554 at a distance 3538 from center line 3551, and a second node where interlayer knit line 3550 interconnects first knit layer 3552 and second knit layer 3554 at a distance 3539 from center line 3451.

Section line 3519 touches and extends tangentially to forefoot portion 3558 of knitted component 3540. Mapping section line 3519 in reference figure 3501 to reference figure 3502 presents a cross-section of knitted textile element 3500 in the form of a generally flat two-layer structure 3529 having a single node where interlayer knit stitch line 3550 interconnects first knit layer 3552 and second knit layer 3554 at a distance 3541 from center line 3451 (shown as a pinch in two-layer structure 3529 of reference figure 3402).

Knitted component 3540 may be removed from knitted textile element 3500 by any known or later developed removing or separating process. In some embodiments, knitted component 3540 may be removed or separated from textile element 3500 by separating knitted textile element 3500 along interlayer knit stitch line 3550 of knitted component 3540 using a separating process, such as a cutting process, as described above with respect to FIGS. 2 to 8. Knitted component 3540 further may be separated along common edge 3580 of common opening 3582 by any known or later developed separating process to form an ankle opening. For example, in some embodiments common edge 3580 may be provided with one or more knitted indicating portions, and knitted component 3540 may be separated along the knitted indicating portions to form an ankle opening.

Post removal, knitted component 3540 may be manipulated and/or stretched to form a seamless bootie or textile upper, as generally shown in reference figures 3503-3508.

Post removal, knitted component 3540 may be inverted or tucked-in in a manner similar to FIGS. 26 to 30.

Dimensions of knitted textile element 3500 and knitted component 3540 may be selected to provide desired sizing and/or custom fit and performance characteristics in a seamless bootie or textile upper formed from knitted component 3540, as generally described above with respect to knitted component 2100 in FIG. 21 and knitted component 2400 in figure 2400. For example, dimensions 3531-3539 and 3541 may be selected to provide a desired sizing and/or custom fit. Those skilled in the art readily will be able to select dimensions for knitted component 3440 suitable to provide a desired sizing and/or custom fit of a seamless bootie or textile upper formed from knitted component 3540.

Reference figures 3503 to 3505 illustrate a seamless bootie or textile upper formed from knitted component 3540, including knitted bootie component 3560 and knitted gusseted tongue component 3562, in a medial profile view, a bottom profile view, and a lateral profile view post removal and tucked-in.

Reference figure 3506 illustrates a seamless bootie or textile upper formed from knitted component 3540 in a front profile view post removal and tucked-in. Reference figure 3507 is a cross sectional view of the seamless bootie or textile upper taken along section line 3507-3507 of reference figure 3506, and reference figure 3508 is a cross sectional view of the seamless bootie or textile upper taken along section line 3508-3508 of reference figure 3506.

As shown in reference figure 3507, in some embodiments a seamless bootie or textile upper formed from knitted component 3540 may include a continuous knitted layer at forefoot portion 3558. That is, knitted bootie component 3560 may include a continuous knitted layer formed by first knit layer 3552, second knit layer 3554, and interlayer knit stitch line 3550.

As shown in reference figure 3507, in come embodiments tab component 3583 of gusseted tongue 3562 may be tucked-in on an interior of seamless bootie or textile upper 3540 at forefoot portion 3558. In some embodiments, tab component 3583 may be attached to forefoot portion 3558, e.g., by bonding, stitching, or another attachment process.

In some embodiments, knitted component 3540 may include a closure system 3570, including tucked-in tongue portion 3562, closure members 3572, eyelets 3573 in knitted gusseted tongue component 3562, eyelets 3574 in knitted bootie component 3560, and lacing 3576. As shown in reference figure 3508, in some embodiments tongue component 3562 may be folded and tucked-in. In some embodiments, as shown in reference figure 3508, tongue component 3562 may be tucked-in and folded so that eyelets 3573 of knitted gusseted tongue component 3562 and eyelets 3574 of knitted component 3560 may be aligned or configured in registration with common lacing 3576. In this manner, tongue component 3562 may be located between lacing 3562 and a foot disposed in the seamless bootie or textile upper.

Seamless Bootie with Wrap-Around Portions Article of Footwear Configurations

This section generally describes embodiments and methods for knitting a knitted textile element including a knitted component having wrap-around portions for incorporating into a textile upper for an article of footwear. Specifically, this section generally describes embodiments and methods for knitting a knitted textile element including a first knitted component portion that is configured to form a seamless bootie or textile upper and a second knitted component portion that is configured to be wrapped around at least a portion of the seamless bootie or textile upper (i.e., the first knitted component portion), where the wrap-around portion (i.e., the second knitted component portion) is seamlessly associated with the first knit layer and/or the second knit layer of the first knitted component portion at the interlayer knit stitch line of the first knitted component portion. In some embodiments a wrap-around portion may form a dynamic fit structure of the article of footwear. In some embodiments, a wrap-around portion may include a pocket formed by the first knit layer and/or the second knit layer for receiving an insert member. In some embodiments, a wrap-around portion may cooperate with one of the first knit layer and the second knit layer of the seamless bootie or textile upper (i.e., the first knitted component portion) to form a pocket for receiving an insert member. For example, in some embodiments an insert member may include a toe cup at a forefoot portion of the article, a heel cup at a heel portion of the article, an arch support at an instep portion of the article, a padded layer for a tongue, and/or another insert member.

FIGS. 36 to 49 illustrate embodiments of a seamless bootie or textile upper including wrap around spline structures. Embodiments illustrated in FIGS. 36 to 49 are similar in that each includes a seamless bootie or textile upper of unitary warp knit construction, including a wrap-around portion that is continuous with the bootie at a spline of the bootie, i.e., at an interlayer knit stitch line that defines a body of the knitted bootie. In some embodiments, the wrap around structure may provide a dynamic fit structure.

Figure 36:
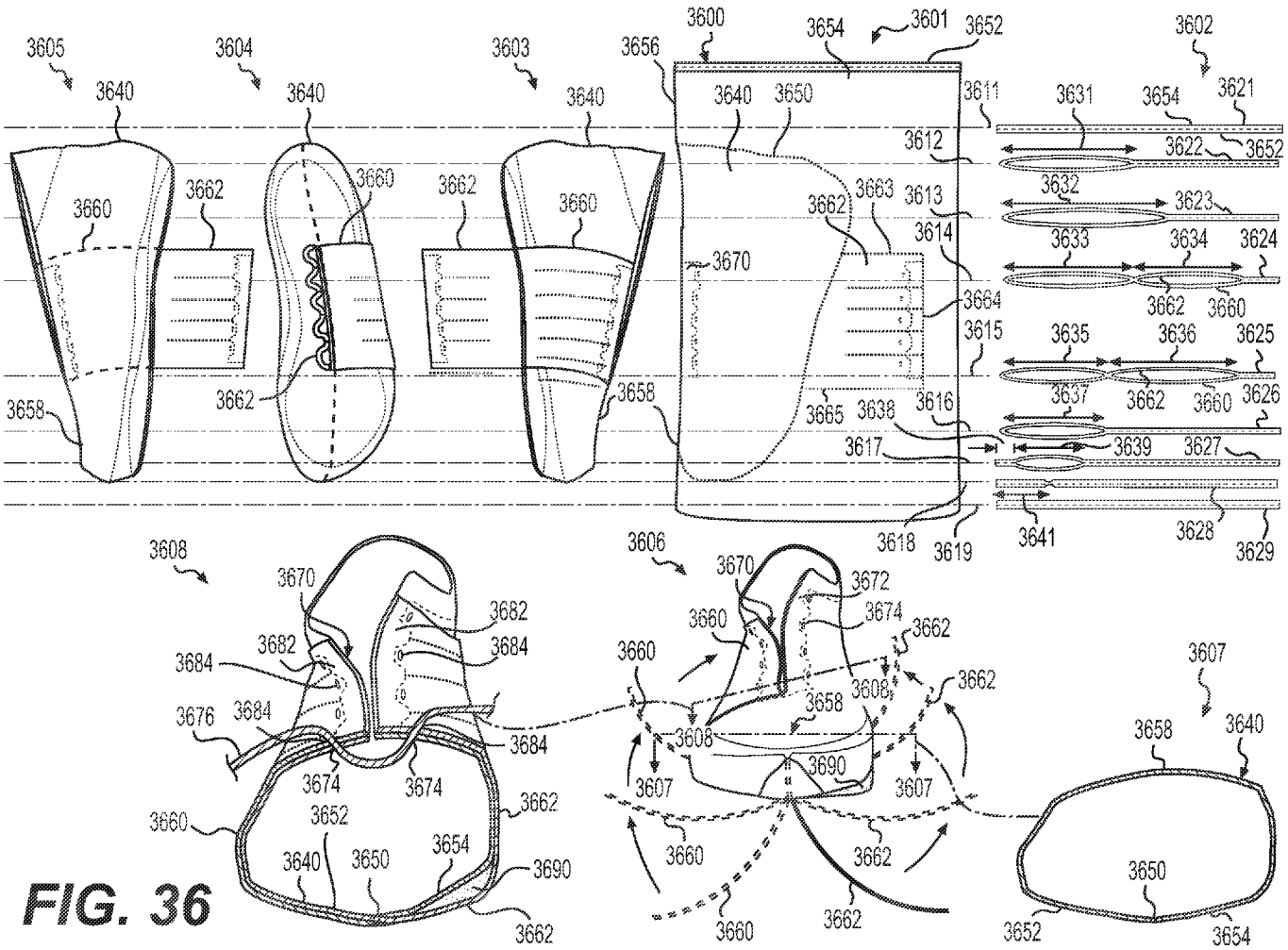
FIG. 36 schematically maps features of another embodiment of a knitted component of a knitted textile element to a seamless bootie or textile upper formed from the knitted component, including a seamless knitted dynamic fit component using a wrap-around structure.

FIG. 36 schematically maps features of an embodiment of a knitted component 3640 of a knitted textile element 3600 to a seamless bootie or textile upper formed from the knitted component. In some embodiments, knitted component 3640 of knitted textile element 3600 may include a knitted dynamic fit component using wrap around structure. In some embodiments, a knitted dynamic fit component may be integrally knitted with a spline of knitted component 3640 formed by interlayer knit stitch line 3650.

In FIG. 36, reference number 3601 identifies a figure of knitted textile element 3600 (hereafter referred to as reference figure 3601) and includes a sequence of section lines 3611-3619 that schematically map various features and characteristics of knitted component 3640 of knitted textile element 3600 across corresponding figures at reference numbers 3602, 3603, 3604, and 3605 (hereafter referred to as reference figures 3602, 3603, 3604, and 3605). Reference figure 3602 illustrates a sequence of cross-sectional views 3621 to 3629 associated with knitted component 3640 of knitted textile element 3600 taken along section lines 3611 to 3619, pre-removal. Reference figure 3603 illustrates a medial side view of knitted component 3640, post removal with partial wrap-around; reference figure 3604 illustrates a bottom plan view of knitted component 3640, post removal with partial wrap-around; and reference figure 3605 illustrates a lateral side view of knitted component 3640, post removal with partial wrap-around. Reference number 3606 is a figure that illustrates a front isometric view of knitted component 3640 (hereafter reference figure 3606), post removal, and illustrates a wrap-around process; reference number 3607 is a figure that illustrates a cross-sectional view of forefoot portion 3658 taken along section line 3607-3607 of reference figure 3606 (hereafter reference figure 3607); and reference number 3608 is a figure that illustrates a cross-sectional view of forefoot portion 3658 of the knitted component 3640 taken along section line 3608-3608 of reference figure 3606 (hereafter reference figure 3608).

Similar to knitted textile element 2400 in FIG. 24 knitted textile element 3600 includes a first knit layer 3652 and a second knit layer 3654 that overlays first knit layer 3652, and knitted textile element 3600 is of unitary warp knit configuration. Referring to reference figure 3601, in some embodiments first knit layer 3652 may be continuous with second knit layer 3654 along a common edge 3656 that runs in a direction of manufacture or knitting process. It will be appreciated that in some embodiments knitted textile element 3600 may have a generally tubular configuration similar to knitted textile elements 200 and 2100 in FIGS. 2 and 21, and in some embodiments knitted textile element 3600 may have a generally flat two-layer configuration similar to knitted textile elements 2300 and 2400 in FIGS. 23 and 24. For purposes of brevity, knitted textile element 3600 will be described with respect to a generally flat two-layer configuration. Those skilled in the art readily will appreciate correspondence and interchangeability of various features and portions between a generally tubular structure (e.g., as shown in FIGS. 2 and 21) and a generally flat two-layer structure (e.g., as shown in FIGS. 23 and 24).

Section line 3611 passes through knitted textile element 3600 above knitted component 3640, outside a peripheral boundary of knitted component 3640 defined by interlayer knit stitch line 3650. Accordingly, mapping section line 3611 in reference figure 3601 to reference figure 3602 presents a cross-section of knitted component 3600 in the form of a flat two-layer structure 3621 having no features associated with knitted component 3640. Likewise, reference figures 3603, 3604, and 3605 present no features associated with knitted component 3640 along section line 3611.

Section line 3612 passes through a rear heel portion of knitted component 3640. Mapping section line 3612 in reference figure 3601 to reference figure 3602 presents a cross-section of knitted textile element 3600 in the form of a generally flat two-layer structure 3622 having a node where interlayer knit stitch line 3650 interconnects first knit layer 3652 and second knit layer 3654 at a distance 3631 from common edge 3656 of knitted textile element 3600. It will be appreciated that, in some embodiments common edge 3656 of knitted component 3640 may function in a manner similar to common edge 210 of FIG. 2, common edge 2156 of FIG. 21, and common edge 2456 in FIG. 24, in that common edge 3656 may provide a continuous knitted layer common to first knit layer 3652 and second knit layer 3654 suitable for separating and forming an ankle opening for knitted component 3640 of knitted textile element 3600.

Section line 3613 passes through a heel portion of knitted component 3640. Mapping section line 3613 in reference figure 3601 to reference figure 3602 presents a cross-section of knitted textile element 3600 in the form of a generally flat two-layer structure 3623 having a node where interlayer knit stitch line 3650 interconnects first knit layer 3652 and second knit layer 3654 at a distance 3632 from common edge 3656 of knitted textile element 3600.

Section line 3614 passes through a portion of a closure structure 3670 proximal to an ankle opening of knitted component 3640. Mapping section line 3614 in reference figure 3601 to reference figure 3602 presents a cross-section of knitted textile element 3600 in the form of a generally flat two-layer structure 3624 having a first node where interlayer knit stitch line 3650 interconnects first knit layer 3652 and second knit layer 3654 at a distance 3633 from common edge 3656, corresponding to a body of the seamless bootie or textile upper 3640, and a second node where interlayer knit stitch line 3650 interconnects first knit layer 3652 and second knit layer 3654 at a distance 3634 from the first node, corresponding to a distal end of a dynamic fit component 3660 of the first knit layer 3652, and a dynamic fit component 3462 of the second knit layer 3654 of the seamless bootie or textile upper 3640.

Section line 3615 passes through a portion of closure structure 3670 proximal to forefoot portion 3658 of knitted component 3640. Mapping section line 3615 in reference figure 3601 to reference figure 3602 presents a cross-section of knitted textile element 3600 in the form of a generally flat two-layer structure 3625 having a first node where interlayer knit stitch line 3650 interconnects first knit layer 3652 and second knit layer 3654 at a distance 3635 from common edge 3656, corresponding to seamless bootie or textile upper 3640, and a second node where interlayer knit stitch 3650 interconnects first knit layer 3652 and second knit layer 3654 at a distance 3636 from the first node, corresponding to a distal end of the dynamic fit component 3660 of the first knit layer 3652, and the dynamic fit component 3662 of the second knit layer 3654 of seamless bootie or textile upper 3640.

Section line 3616 passes through a forefoot portion 3658 of knitted component 3640. Mapping section line 3616 in reference figure 3601 to reference figure 3602 presents a cross-section of knitted textile element 3600 in the form of a generally flat two-layer structure 3626 having a node where interlayer knit stitch line 3650 interconnects first knit layer 3652 and second knit layer 3654 at a distance 3637 from common edge 3656.

Section line 3617 passes through forefoot portion 3658 of knitted component 3640. Mapping section line 3617 in reference figure 3601 to reference figure 3602 presents a cross-section of knitted textile element 3600 in the form of a generally flat two-layer structure 3627 having a first node where interlayer knit stitch line 3650 interconnects first knit layer 3652 and second knit layer 3654 at a distance 3638 from common edge 3656, and a second node where interlayer knit line 3650 interconnects first knit layer 3652 and second knit layer 3654 at a distance 3639 from the first node.

Section line 3618 touches and extends tangentially to forefoot portion 3658 of knitted component 3640. Mapping section line 3618 in reference figure 3601 to reference figure 3602 presents a cross-section of knitted textile element 3600 in the form of a generally flat two-layer structure 3628 having a single node where interlayer knit stitch line 3650 interconnects first knit layer 3652 and second knit layer 3654 at a distance 3641 from common edge 3656 (shown as a pinch in two-layer structure 3628 of reference figure 3602).

Section line 3619 passes through knitted textile element 3600 below knitted component 3640, outside a peripheral boundary of knitted component 3640 defined by interlayer knit stitch line 3650. Accordingly, mapping section line 3619 in reference figure 3601 to reference figure 3602 presents a cross-section of knitted component 3600 in the form of a flat two-layer structure 3629 having no features associated with knitted component 3640. Likewise, reference figures 3603, 3604, and 3605 present no features associated with knitted component 3640 along section line 3619.

Knitted component 3640, including dynamic fit components 3660 and 3662, may be removed from knitted textile element 3600 by any known or later developed removing or separating process. In some embodiments, knitted component 3640 may be removed or separated from textile element 3600 by separating knitted textile element 3600 along interlayer knit stitch line 3650 of knitted component 3640 using a separating process, such as a cutting process, as described above with respect to FIGS. 2 to 8. In this case, knitted component 3640 is removed by separating knitted textile element 3600 around a periphery of knitted component 3640, including dynamic fit components 3660 and 3662. Knitted component 3640 further may be separated along common edge 3656 by any known or later developed separating process to form an ankle opening. For example, in some embodiments common edge 3656 may be provided with one or more knitted indicating portions, and knitted component 3640 may be separated along the knitted indicating portions to form an ankle opening. In some embodiments, knitted component 3640 may be separated along common edge 3656 using a separating process, such as a cutting process, as described above with respect to FIGS. 2 to 8.

Dynamic fit components 3660 and 3662 similarly may be separated along peripheral lines 3663, 3664, and 3665 of interlayer knit stitch line 3650 to form first dynamic fit component 3660 on the medial side of knitted component 3640 and second dynamic fit component 3662 on the lateral side of the knitted component 3640.

Post removal, knitted component 3640 may be manipulated and/or stretched to form a seamless bootie or textile upper, as generally shown in reference figures 3603-3608.

Post removal, knitted component 3640 optionally may be inverted or turned inside out in a manner similar to FIGS. 26 to 30 (see, e.g., FIGS. 37 to 45 below).

Dimensions of knitted textile element 3600 and knitted component 3640 may be selected to provide desired sizing and/or custom fit and performance characteristics in a seamless bootie or textile upper formed from knitted component 3640, as generally described above with respect to knitted component 2100 in FIG. 21 and knitted component 2400 in figure 2400. For example, dimensions 3631-3139 and 3641 may be selected to provide a desired sizing and/or custom fit. In some embodiments, dimensions 3634 and 3636 of dynamic fit components 3660 and 3662 may be selected to provide a custom dynamic fit. Those skilled in the art readily will be able to select dimensions for knitted component 3640 suitable to provide a desired sizing and/or custom fit, including dynamic fit, of a seamless bootie or textile upper formed from knitted component 3640.

Reference figures 3603 to 3605 illustrate a seamless bootie or textile upper formed from knitted component 3640, including dynamic fit components 3660 and 3662, in a medial profile view, a bottom profile view, and a lateral profile view post removal. For purposes of description, in reference figures 3603, 3604, and 3605, dynamic fit component 3660 is shown wrapped around the medial side of knitted component 3640, and dynamic fit component 3662 is shown fully extended in its original post removal state.

Reference figure 3606 illustrates a seamless bootie or textile upper formed from knitted component 3640 in a front profile view post removal. Reference figure 3607 is a cross sectional view of the seamless bootie or textile upper taken along section line 3607-3607 of reference figure 3606, and reference figure 3608 is a cross sectional view of the seamless bootie or textile upper taken along section line 3608-3608 of reference figure 3606, post removal and wrap around.

As shown in reference figure 3606, knitted dynamic fit component 3660 may be wrapped up around the medial side of knitted component 3640, and knitted dynamic fit component 3662 may be wrapped up around the lateral side of knitted component 3640.

As shown in reference figure 3607, in some embodiments a seamless bootie or textile upper formed from knitted component 3640 may include a continuous knitted layer at forefoot portion 3658. That is, seamless bootie or textile upper 3640 may include a continuous knitted layer formed by first knit layer 3652, second knit layer 3654, and interlayer knit stitch line 3650.

In some embodiments, knitted component 3640 may include a closure system 3670. In some embodiments, closure system 3670 may include closure members 3672, eyelets 3674, and lacing 3676.

In some embodiments, knitted dynamic fit components 3660 and 3662 may be wrapped up around knitted component 3640 so that distal ends of dynamic fit components 3660 and 3662 correspond with closure system 3670. In some embodiments, knitted dynamic fit components 3660 and 3662 may include at least one closure member 3682, and at least one eyelet 3684. In some embodiments, dynamic fit components 3660 and 3662 may be wrapped up around knitted component 3640 so that at least one closure member 3682 and eyelet 3684 of dynamic fit component 3660 and/or at least one closure member 3682 and eyelet 3683 of dynamic fit component 3662 are aligned in registration with at least one closure member 3672 and eyelet 3674 of seamless bootie or textile upper 3640. As shown in reference figure 3608, in some embodiments multiple closure members 3672, 3682 and eyelets 3674, 3684 of closure system 3670 and dynamic fit components 3660 and 3662 may be arranged in registration. In this case, it will be appreciated that closure system 3670 and a dynamic fit system including dynamic fit components 3660 and 3662 may use common lacing 3676, as shown in reference figure 3608. In some embodiments, dynamic fit components 3660 and 3662 may use different lacing than closure system 3670. In some embodiments, knitted component 3640 may include a dynamic fit system including dynamic fit components 3660 and 3662, and not include any closure system. Those skilled in the art readily will be able to select a dynamic fit system or combination of dynamic fit system and closure system suitable for a desired article of footwear.

In some embodiments, as shown in reference figures 3606 and 3608, a seamless bootie or textile upper formed from knitted component 3640 may include an insert member 3690. In some embodiments, insert member may be inserted into a pocket formed between first knit layer 3652 and second knit layer 3654 of knitted component 3640. For example, as shown in reference figures 3606 and 3608, in some embodiments insert member 3690 may be an arch support located in a midfoot region of knitted component 3640.

Figure 39:
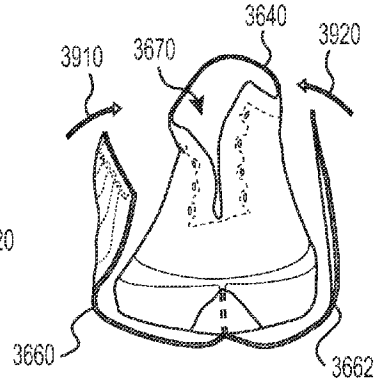
FIG. 39 is a front view of the knitted component of FIG. 38 schematically illustrating dynamic fit components partially wrapped around respective medial and lateral sides of the knitted component.
Figure 38:
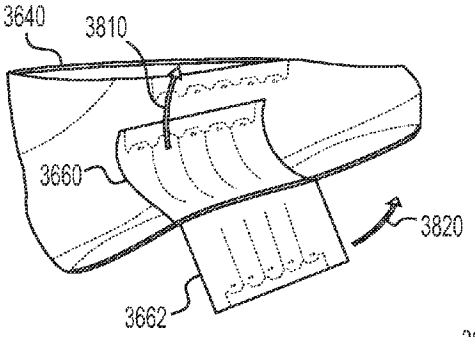
FIG. 38 illustrates the knitted component of FIG. 37 with dynamic fit components partially wrapped around respective medial and lateral sides of the knitted component.
Figure 41:
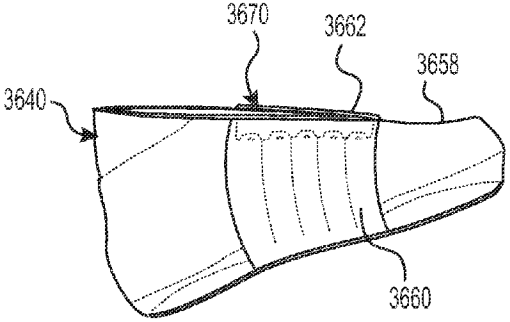
FIG. 41 is a side view of the knitted component of FIG. 40 schematically illustrating dynamic fit components fully wrapped around medial and lateral sides of the knitted component FIG. 42 schematically illustrates the knitted component of FIG. 41 with a toe portion partially inverted.
Figure 37:
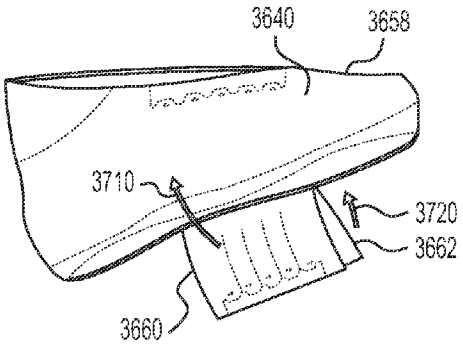
FIG. 37 schematically illustrates the knitted component of FIG. 36 in an initial post removal state.
Figure 40:
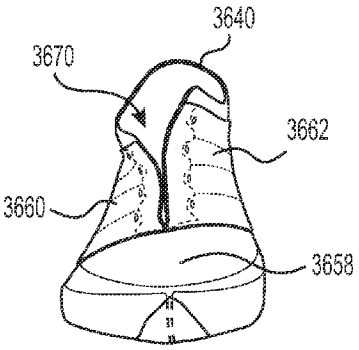
FIG. 40 is a front view of the knitted component of FIG. 39 schematically illustrating dynamic fit components fully wrapped around medial and lateral sides of the knitted component.
Figure 43:
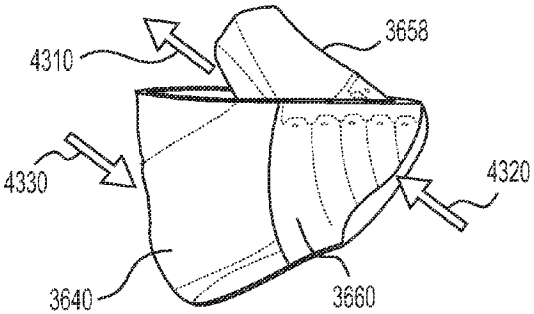
FIG. 43 schematically illustrates the knitted component of FIG. 42 with an inverted toe portion protruding through an ankle opening of the knitted component.
Figure 45:
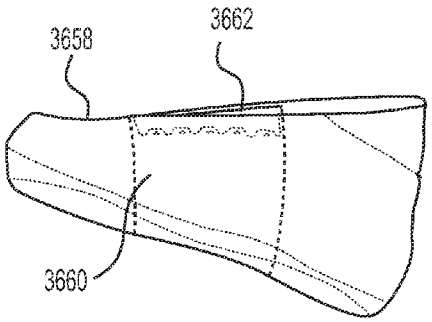
FIG. 45 schematically illustrates the knitted component of FIGS. 37 to 44 fully inverted or turned inside out.
Figure 42:
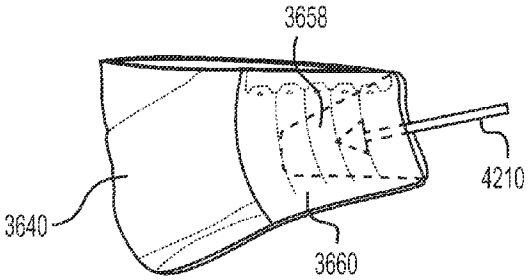
Figure 44:
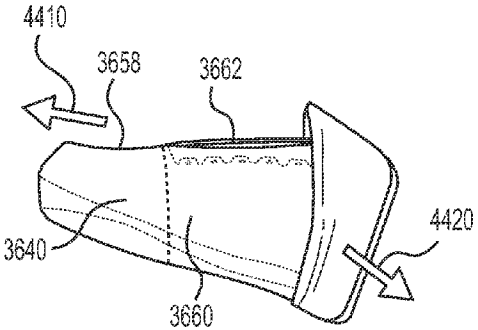
FIG. 44 schematically illustrates the knitted component of FIG. 43 with inverted toe and instep portions protruding through the ankle opening.

FIGS. 37 to 45 schematically illustrate an optional inversion process for folding or turning inside-out a knitted component of FIG. 36, post removal. FIG. 37 illustrates the knitted component 3640 of FIG. 36 in an initial post removal state. As shown in FIG. 37, in some embodiments dynamic fit component 3660 may be wrapped around the lateral side of seamless bootie 3640, in a direction of arrow 3720, and dynamic fit component 3662 may be wrapped around the medial side of seamless bootie 3640, in a direction of arrow 3710. FIG. 38 illustrates knitted component 3640 with dynamic fit component portions 3660 and 3662 partially wrapped around respective medial and lateral sides of the knitted seamless bootie in a direction of arrows 3810 and 3820, respectively, and FIG. 39 is a front view illustrating dynamic fit components 3660 and 3662 substantially wrapped around respective medial and lateral sides of the knitted component 3640 in a direction of arrows 3910 and 3920, respectively. FIG. 40 is a front view illustrating dynamic fit components 3660 and 3662 fully wrapped around medial and lateral sides of the knitted component 3640 and overlaying closure structure 3670 of seamless bootie 3640. FIG. 41 is a side view illustrating dynamic fit components 3660 and 3662 fully wrapped around medial and lateral sides of knitted component 3640 and overlaying closure structure 3670 of seamless bootie 3640. FIG. 42 illustrates the knitted component 3640 with a forefoot portion 3658 partially inverted. Specifically, forefoot portion 3658 is pushed in a direction of arrow 4210 into an interior of knitted component (seamless bootie) 3640. FIG. 43 illustrates the knitted component with forefoot portion 3658 being pushed in further in a direction of arrow 4320 and pulled out through the ankle opening of the knitted component (seamless bootie) 3640 in a direction of arrow 4310, while heel portion of seamless bootie 3640 is pushed in a direction of arrow 4330. FIG. 44 illustrates the knitted component 3640 with forefoot portion 3658 substantially pulled through the ankle opening in a direction of arrow 4410, while the heel portion of seamless bootie 3640 is inverted by pushing in a direction of arrow 4420, and FIG. 45 illustrates the knitted component fully inverted or turned inside out.

Figures 46, 47, 48:
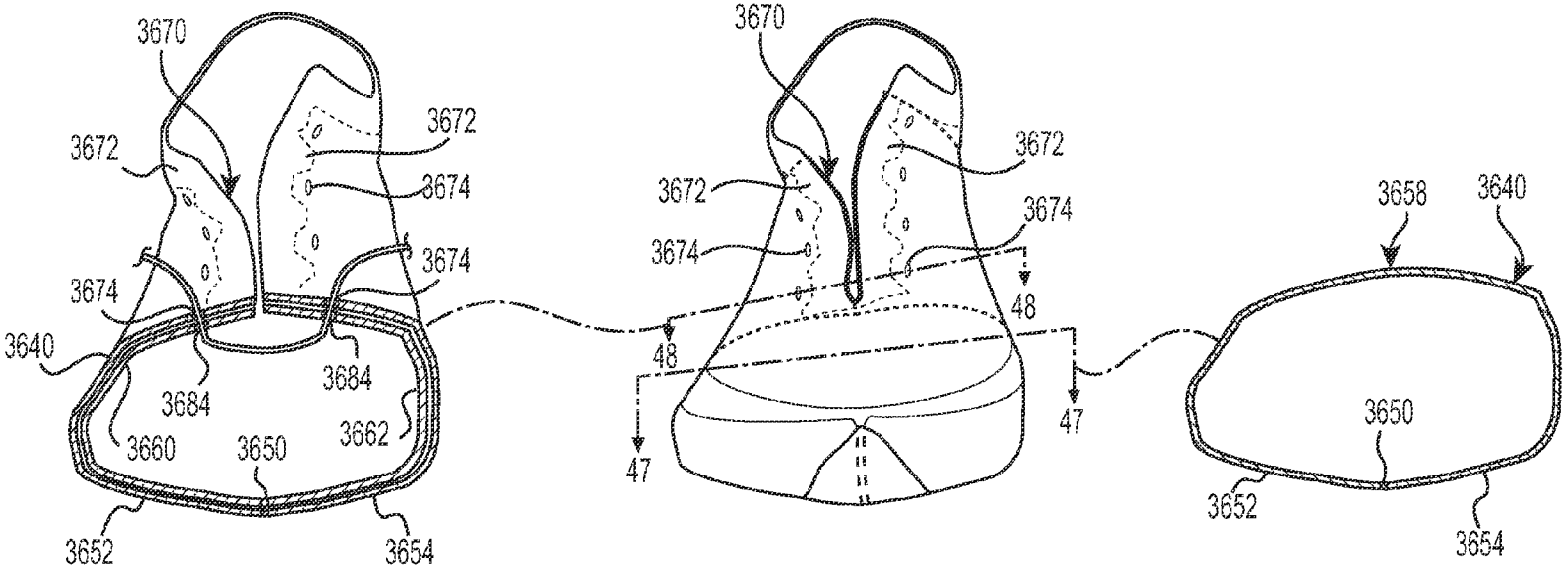
FIG. 46 is a schematic front isometric view of a seamless bootie or textile upper incorporating a knitted component of FIG. 36, post inversion process of FIGS. 36 to 45.
FIG. 47 is a cross-sectional view of the textile upper of FIG. 46 taken along section lines 47-47.
FIG. 48 is a cross-sectional view of the textile upper of FIG. 46 taken along section line 48-48.

FIG. 46 is a schematic front isometric view of a seamless bootie or textile upper incorporating a knitted component 3640, post removal and turned inside-out, as shown in FIGS. 36-45. FIG. 47 is a cross-sectional view of the seamless bootie or textile upper of FIG. 46 taken along section lines 47-47. FIG. 48 is a cross-sectional view of the seamless bootie or textile upper of FIG. 46 taken along section lines 48-48.

It will be appreciated that the structure and features of seamless bootie or textile upper 3640 in FIGS. 46 to 48 are substantially similar to the structure and features of FIG. 36, except that in FIGS. 46 to 48 dynamic fit components 3660 and 3662 are located in the interior of the seamless bootie 3640.

Figure 49:
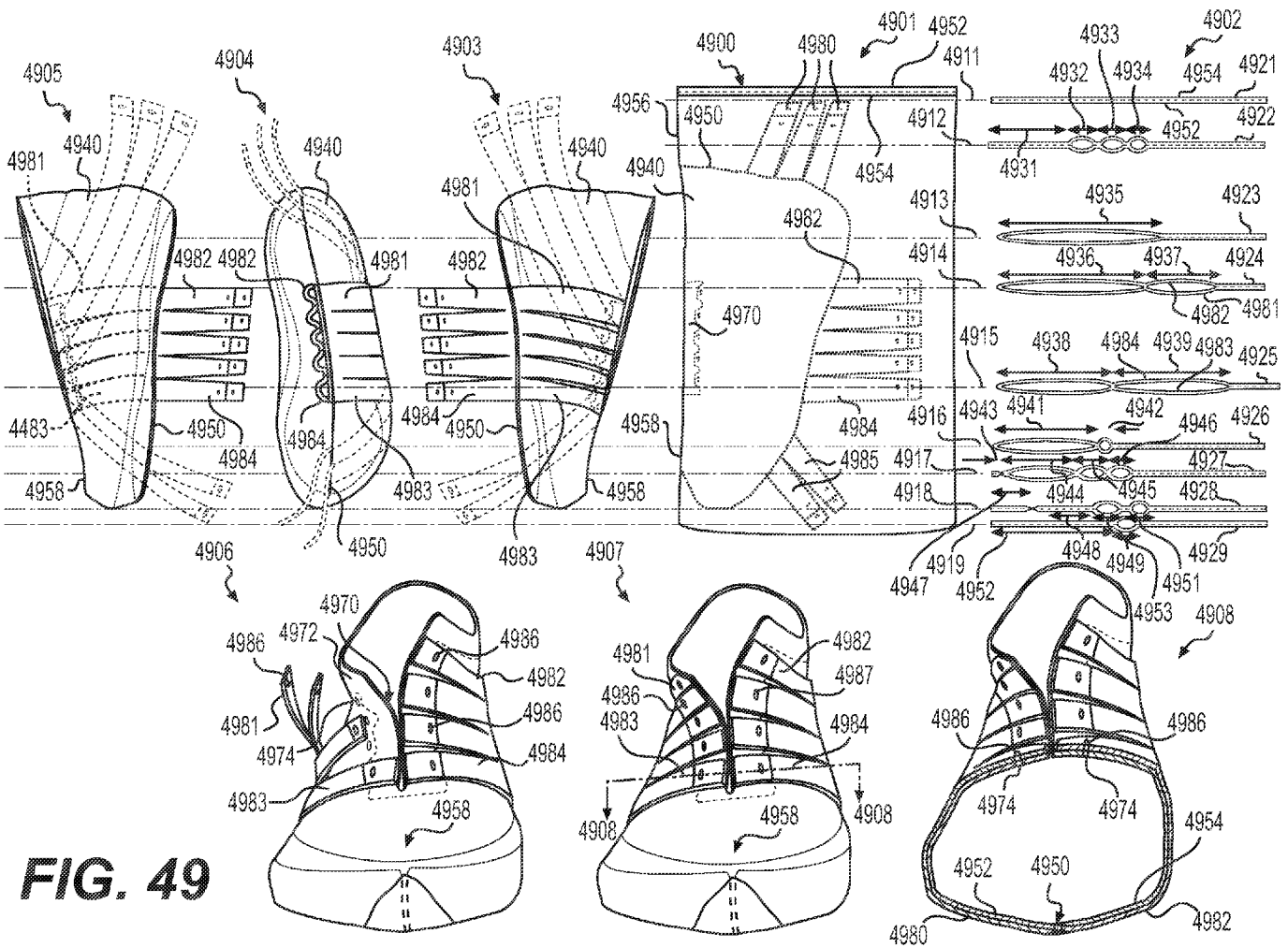
FIG. 49 schematically maps features of another embodiment of a knitted component of a knitted textile element to a seamless bootie or textile upper formed from the knitted component, including seamless knitted dynamic fit finger components using wrap-around structures.
Figure 50:
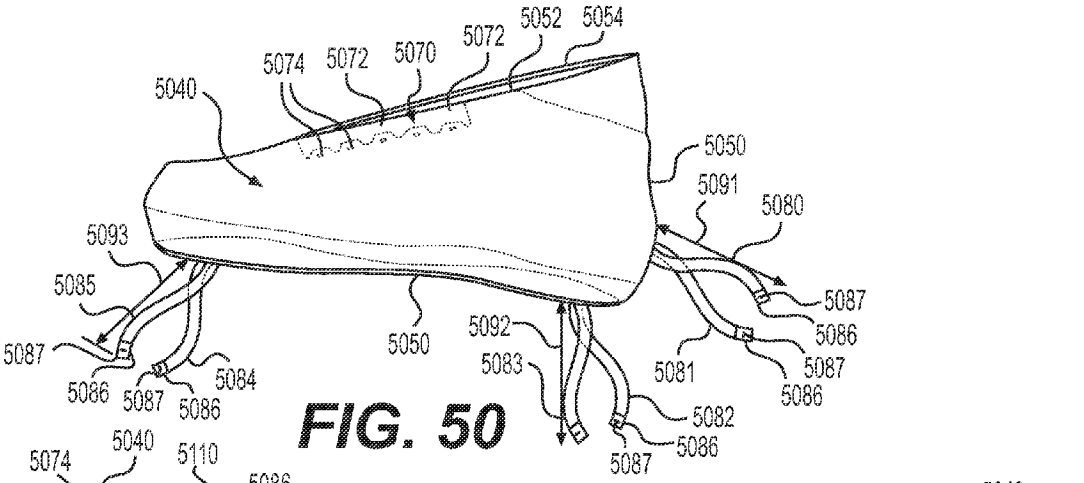
FIG. 50 schematically illustrates another embodiment of a knitted component of FIG. 49 in an initial post removal state.
Figure 52:
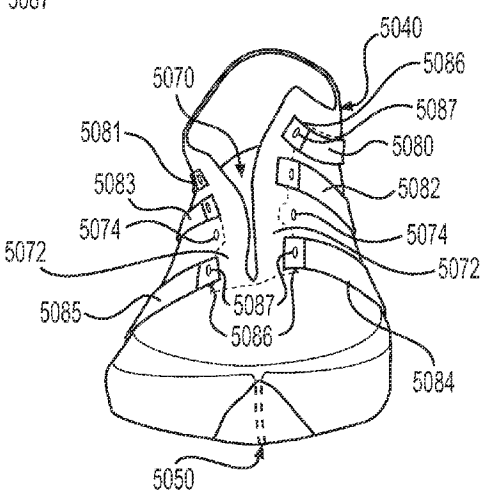
FIG. 52 schematically illustrates a seamless bootie or textile upper of FIG. 51, with knitted dynamic fit finger components fully wrapped around medial and lateral sides of the seamless bootie.
Figure 51:
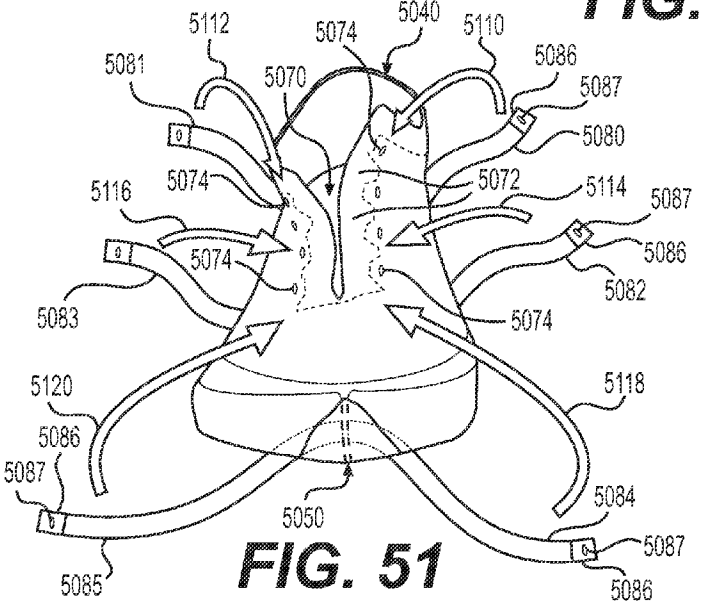
FIG. 51 schematically illustrates a seamless bootie or textile upper formed from the knitted component of FIG. 50, with knitted dynamic fit finger components partially wrapped around medial and lateral sides of the seamless bootie.

FIG. 49 schematically maps features of another embodiment of a knitted component 4940 of a knitted textile element 4900 to a seamless bootie or textile upper formed from the knitted component. In some embodiments, knitted component 4940 of knitted textile element 4900 may include at least one knitted dynamic fit finger components or wrap around portions. In some embodiments, at least one knitted dynamic fit component may be integrally knitted with a spline of knitted component 4940 formed by interlayer knit stitch line 4950. In some embodiments, at least one knitted dynamic fit finger component or portion 4980 optionally may be provided at a heel region of the seamless bootie 4940. In some embodiments, at least one knitted dynamic fit finger component or portion (e.g., 4981, 4982, 4983, and 4984) optionally may be provided at a midfoot region of seamless bootie 4940. In some embodiments, at least one knitted dynamic fit finger component or portion 4985 optionally may be provided at a forefoot region of the seamless bootie 4940. For simplicity of description, although reference figures 4901 to 4905 illustrate embodiments including pairs of optional dynamic fit finger components or portions 4980 and 4985 at the heel region and forefoot region of seamless bootie 4940, reference figures 4906-4908 of FIG. 49 illustrate embodiments including only five pairs of optional dynamic fit finger components or portions located at a midfoot region of seamless bootie 4940, including details of dynamic fit finger components or portions 4981, 4982, 4983, and 4984. FIGS. 50 to 52 illustrate embodiments including details of optional pairs of dynamic fit finger components or portions located at the heel region and forefoot region of a seamless bootie.

In FIG. 49, reference number 4901 identifies a figure of knitted textile element 4900 (hereafter referred to as reference figure 4901) and includes a sequence of section lines 4911 to 4919 that schematically map various features and characteristics of knitted component 4940 of knitted textile element 4900 across corresponding figures at reference numbers 4902, 4903, 4904, and 4905 (hereafter referred to as reference figures 4902, 4903, 4904, and 4905). Reference figure 4902 illustrates a sequence of cross-sectional views 4921 to 4929 associated with knitted component 4940 of knitted textile element 4900 taken along section lines 4911 to 4919, pre-removal. Reference figure 4903 illustrates a medial side view of knitted component 4940, post removal with partial wrap around; reference figure 4904 illustrates a bottom plan view of knitted component 4940, post removal with partial wrap around; and reference figure 4905 illustrates a lateral side view of knitted component 4940, post removal with partial wrap around. Reference number 4906 is a figure that illustrates a front isometric view of knitted component 4940 (hereafter reference figure 4906), post removal with partial wrap around, and illustrating a wrap-around process; reference number 4907 is a figure that illustrates a front isomeric view of a knitted component 4940 with full wrap-around (hereafter reference figure 4907); and reference number 4908 is a figure that illustrates a cross-sectional view of forefoot portion 4958 of the knitted component 4940 taken along section line 4908-4908 of reference figure 4907 (hereafter reference figure 4908).

Similar to knitted textile element 2400 in FIG. 24 knitted textile element 4900 includes a first knit layer 4952 and a second knit layer 4954 that overlays first knit layer 4952, and knitted textile element 4900 is of unitary warp knit configuration. Referring to reference figure 4901, in some embodiments first knit layer 4952 may be continuous with second knit layer 4954 along a common edge 4956 that runs in a direction of manufacture or knitting process. It will be appreciated that in some embodiments knitted textile element 4900 may have a generally tubular configuration similar to knitted textile elements 200 and 2100 in FIGS. 2 and 21, and in some embodiments knitted textile element 4900 may have a generally flat two-layer configuration similar to knitted textile elements 2300 and 2400 in FIGS. 23 and 24. For purposes of brevity, knitted textile element 4900 will be described with respect to a generally flat two-layer configuration. Those skilled in the art readily will appreciate correspondence and interchangeability of various features and portions between a generally tubular structure (e.g., as shown in FIGS. 2 and 21) and a generally flat two-layer structure (e.g., as shown in FIGS. 23 and 24).

Section line 4911 passes through knitted textile element 4900 above knitted component 4940, outside a peripheral boundary of knitted component 4940 defined by interlayer knit stitch line 4950. Accordingly, mapping section line 4911 in reference figure 4901 to reference figure 4902 presents a cross-section of knitted component 4900 in the form of a flat two-layer structure 4921 having no features associated with knitted component 4940. Likewise, reference figures 4903, 4904, and 4905 present no features associated with knitted component 4940 along section line 4911.

Section line 4912 passes above a body of knitted component 4940 and, in some embodiments section line 4912 may pass through three pairs of optional knitted dynamic fit finger components or portions 4980 that extend from a rear heel portion of knitted component 4940. Mapping section line 4912 in reference figure 4901 to reference figure 4902 presents a cross-section of knitted textile element 4900 in the form of a generally flat two-layer structure 4922 having a first node where interlayer knit stitch line 4950 interconnects first knit layer 4952 and second knit layer 4954 at a distance 4931 from common edge 4956 of knitted textile element 4900, a second node where interlayer knit stitch line 4950 interconnects first knit layer 4952 and second knit layer 4954 at a distance 4932 from the first node, a third node where interlayer knit stitch line 4950 interconnects first knit layer 4952 and second knit layer 4954 at a distance 4933 from the second node, and a fourth node where interlayer knit stitch line 4950 interconnects first knit layer 4952 and second knit layer 4954 at a distance 4934 from the third node. In some embodiments, these four nodes define boundaries of three pockets formed between first knit layer 4952 and second knit layer 4954 corresponding to three pairs of optional dynamic fit finger components or portions 4980 that extend from the heel portion of knitted component 4940. It will be appreciated, however, that for simplicity of description these three pairs of optional dynamic fit finger components or portions 4980 are not shown in embodiments of reference figures 4906-4908.

Section line 4913 passes through a rear heel portion of knitted component 4940. Mapping section line 4913 in reference figure 4901 to reference figure 4902 presents a cross-section of knitted textile element 4900 in the form of a generally flat two-layer structure 4923 having a node where interlayer knit stitch line 4950 interconnects first knit layer 4952 and second knit layer 4954 at a distance 4935 from common edge 4956 of knitted textile element 4900. It will be appreciated that, in some embodiments common edge 4956 of knitted component 4940 may function in a manner similar to common edge 210 of FIG. 2, common edge 2156 of FIG. 21, and/or common edge 2456 in FIG. 24, in that common edge 4956 may provide a continuous knitted layer common to first knit layer 4952 and second knit layer 4954 suitable for separating and forming an ankle opening for knitted component 4940 of knitted textile element 4900.

Section line 4914 passes through a portion of a closure structure 4970 proximal to an ankle opening of knitted component 4940. Mapping section line 4914 in reference figure 4901 to reference figure 4902 presents a cross-section of knitted textile element 4900 in the form of a generally flat two-layer structure 4924 having a first node where interlayer knit stitch line 4950 interconnects first knit layer 4952 and second knit layer 4954 at a distance 4936 from common edge 4956, corresponding to a body of seamless bootie or textile upper 4940, and a second node where interlayer knit stitch line 4950 interconnects first knit layer 4952 and second knit layer 4954 at a distance 4937 from the first node, corresponding to a distal end of a first pair of dynamic fit finger components or portions 4981 and 4982 of the seamless bootie or textile upper 4940.

Section line 4915 passes through a portion of closure structure 4970 proximal to forefoot portion 4958 of knitted component 4940. Mapping section line 4915 in reference figure 4901 to reference figure 4902 presents a cross-section of knitted textile element 4900 in the form of a generally flat two-layer structure 4925 having a first node where interlayer knit stitch line 4950 interconnects first knit layer 4952 and second knit layer 4954 at a distance 4938 from common edge 4956, corresponding to a body of seamless bootie or textile upper 4940, and a second node where interlayer knit stitch 4950 interconnects first knit layer 4952 and second knit layer 4954 at a distance 4939 from the first node, corresponding to a distal end of another pair of dynamic fit finger components or portions 4983 and 4984 of seamless bootie or textile upper 4940 that extend from knitted component 4940.

Section line 4916 passes through a forefoot portion 4958 of knitted component 4940. Mapping section line 4916 in reference figure 4901 to reference figure 4902 presents a cross-section of knitted textile element 4900 in the form of a generally flat two-layer structure 4926 having a first node where interlayer knit stitch line 4950 interconnects first knit layer 4952 and second knit layer 4954 at a distance 4941 from common edge 4956, and a second node where interlayer knit stitch line 4950 interconnects first knit layer 4952 and second knit layer 4954 at a distance 4942 from the first node. In some embodiments, these two nodes define boundaries of a pocket formed between first knit layer 4952 and second knit layer 4954 corresponding to another two pairs of optional dynamic fit finger components or portions 4985 that extend from forefoot portion 4958 of knitted component 4940.

Section line 4917 passes through forefoot portion 4958 of knitted component 4940. Mapping section line 4917 in reference figure 4901 to reference figure 4902 presents a cross-section of knitted textile element 4900 in the form of a generally flat two-layer structure 4927 having a first node where interlayer knit stitch line 4950 interconnects first knit layer 4952 and second knit layer 4954 at a distance 4943 from common edge 4956, a second node where interlayer knit line 4950 interconnects first knit layer 4952 and second knit layer 4954 at a distance 4944 from the first node, a third node where interlayer knit line 4950 interconnects first knit layer 4952 and second knit layer 4954 at a distance 4945 from the second node, and a fourth node where interlayer knit line 4950 interconnects first knit layer 4952 and second knit layer 4954 at a distance 4946 from the third node. In some embodiments these second, third, and fourth nodes define boundaries of two pockets formed between first knit layer 4952 and second knit layer 4954 corresponding to two additional pairs of optional dynamic fit finger components or portions 4985 that extend from the forefoot region of knitted component 4940, as illustrated in reference figures 4901 to 4905. It will be appreciated, however, that for simplicity of description these two pairs of optional dynamic fit finger components or portions 4985 are not shown in embodiments of reference figures 4906 to 4908.

Section line 4918 touches and extends tangentially to forefoot portion 4958 of knitted component 4940. Mapping section line 4918 in reference figure 4901 to reference figure 4902 presents a cross-section of knitted textile element 4900 in the form of a generally flat two-layer structure 4928 having a first node where interlayer knit stitch line 4950 interconnects first knit layer 4952 and second knit layer 4954 at a distance 4947 from common edge 4956 (shown as a pinch in two-layer structure 4928 of reference figure 4902), a second node where interlayer knit stitch line 4950 interconnects first knit layer 4952 and second knit layer 4954 at a distance 4948 from the first node, a third node where interlayer knit stitch line 4950 interconnects first knit layer 4952 and second knit layer 4954 at a distance 4949 from the second node, and a fourth node where interlayer knit stitch line 4950 interconnects first knit layer 4952 and second knit layer 4954 at a distance 4951 from the third node. In some embodiments these second, third, and fourth nodes define boundaries of two pockets formed between first knit layer 4952 and second knit layer 4954 corresponding to two additional pairs of optional dynamic fit finger components or portions 4985 that extend from forefoot portion 4958 of knitted component 4940, as illustrated in reference figures 4901 to 4905. It will be appreciated, however, that for simplicity of description these two pairs of optional dynamic fit finger components or portions 4985 are not shown in embodiments of reference figures 4906 to 4908.

Section line 4919 passes below the body of knitted component 4940 and, in some embodiments section line 4914 may pass through one of two additional pairs of optional knitted dynamic fit finger components or portions 4985 that extend from a forefoot region of knitted component 4940. Mapping section line 4919 in reference figure 4901 to reference figure 4902 presents a cross-section of knitted textile element 4900 in the form of a generally flat two-layer structure 4929 having a first node where interlayer knit stitch line 4950 interconnects first knit layer 4952 and second knit layer 4954 at a distance 4952 from common edge 4956 of knitted textile element 4900, and a second node where interlayer knit stitch line 4950 interconnects first knit layer 4952 and second knit layer 4954 at a distance 4953 from the first node. In some embodiments these two nodes define boundaries of a pocket formed between first knit layer 4952 and second knit layer 4954 corresponding to one of two pairs of optional dynamic fit finger components 4985 that extend from the forefoot region of knitted component 4940, as illustrated in reference figures 4901-4905. It will be appreciated, however, that for simplicity of description these two pairs of optional dynamic fit finger components or portions 4985 are not shown in embodiments of reference figures 4906 to 4908.

Knitted component 4940, including any dynamic fit finger components or portions (e.g., dynamic fit finger components or portions 4981, 4982, 4983, and 4984, and/or any optional dynamic fit finger components or portions 4980 and/or 4985), may be removed from knitted textile element 4900 by any known or later developed removing or separating process. In some embodiments, knitted component 4940 may be removed or separated from textile element 4900 by separating knitted textile element 4900 along interlayer knit stitch line 4950 of knitted component 4940 using a separating process, such as a cutting process, as described above with respect to FIGS. 2 to 8. Knitted component 4940 further may be separated along common edge 4956 by any known or later developed separating process to form an ankle opening. For example, in some embodiments common edge 4956 may be provided with one or more knitted indicating portions, and knitted component 4940 may be separated along the knitted indicating portions to form an ankle opening. In some embodiments, knitted component 4940 may be separated along common edge 4956 using a separating process, such as a cutting process, as described above with respect to FIGS. 2 to 8. Dynamic fit finger components or portions may be separated along peripheral lines of the dynamic fit finger components or portions to form pairs of dynamic fit finger components or portions (e.g., pair 4981-4982 and pair 4983-4984), similar to the process with respect to dynamic fit components 3660 and 3662 in FIG. 36. In this case, it will be apparent that there may be one or more pairs of dynamic fit finger components variously extending from the spline (i.e., interlayer knit stitch line 4950) of the seamless bootie or textile upper 4940 along any of the forefoot portion, the midfoot portion, and the heel portion of seamless bootie or textile upper 4940. In some embodiments, a dynamic fit finger component or portion may be formed on only one side of knitted textile element 4900, e.g., in only one of first knit layer 4952 and second knit layer 4954. Those skilled in the art readily will be able to select a number, location, and configuration of one or more dynamic fit finger components or portions or pairs of dynamic fit finger components or portions suitable for desired performance characteristics of a desired article of footwear.

Post removal, knitted component 4940 may be manipulated and/or stretched to form a seamless bootie or textile upper, as generally shown in reference figures 4903 to 4908.

Post removal, knitted component 4940 optionally may be inverted or turned inside out in a manner similar to FIGS. 37 to 45.

Dimensions of knitted textile element 4900 and knitted component 4940 may be selected to provide desired sizing and/or custom fit and performance characteristics in a seamless bootie or textile upper formed from knitted component 4940, as generally described above with respect to knitted component 2100 in FIG. 21 and knitted component 2400 in figure 2400. For example, in some embodiments dimensions 4935, 4936, 4938, 4941, 4943, 4944, and/or 4947 may be selected to provide a desired sizing and/or custom fit for seamless bootie 4940. In some embodiments, dimensions 4937 and 4939 may be selected to provide a custom fit for dynamic fit finger components 4981, 4982, 4983, and/or 4984. Those skilled in the art readily will be able to select dimensions for knitted component 4940 and any dynamic fit finger components suitable to provide a desired sizing and/or custom fit, including dynamic fit, of a seamless bootie or textile upper formed from knitted component 4940.

Reference figures 4903 to 4905 illustrate a seamless bootie or textile upper formed from knitted component 4940, including three pairs of optional dynamic fit finger components 4980 located at a heel region of knitted component 4940, five pairs of optional dynamic fit finger components located at a midfoot region of knitted component 4940 (see, e.g., pair 4981-4982 and pair 4983-4984), and two pairs of optional dynamic fit finger components 4985 located at a forefoot region of knitted component 4940, in a medial profile view, a bottom profile view, and a lateral profile view. For example, for purposes of description, in reference figures 4903, 4904, and 4905 knitted dynamic fit finger components 4981 and 4983 for the medial side of knitted component 4940 are shown fully wrapped around the medial side of knitted component 4940, and knitted dynamic fit finger components 4982 and 4984 for the lateral side of knitted component 4940 are shown fully extended in their original post removal state.

Reference figure 4906 illustrates a seamless bootie or textile upper formed from knitted component 4940 in a front profile view with five pairs of optional dynamic fit finger components in the midfoot region of knitted component 4940, e.g., where knitted dynamic fit finger components or portions 4982 and 4984 are wrapped up fully on the medial side of knitted component 4940, and knitted dynamic fit finger components 4981 and 4983 are wrapped up only partially on the lateral side of knitted component 4940.

Reference figure 4907 illustrates a seamless bootie or textile upper formed from knitted component 4940 in a front profile view with five pairs of optional knitted dynamic fit finger components (including pair 4981-4982 and pair 4983-4984) wrapped up fully on both the medial side of knitted component 4940 and the lateral side of knitted component 4940.

Reference figure 4908 is a cross sectional view of the seamless bootie or textile upper taken along section line 4908-4908 of reference figure 4907.

As shown in reference figures 4906 and 4907, knitted dynamic fit finger components may be wrapped up around the medial side of knitted component 4940, and knitted dynamic fit finger components may be wrapped up around the lateral side of knitted component 3640.

As shown in reference figures 4906 and 4907, in some embodiments a seamless bootie or textile upper formed from knitted component 4940 may include a continuous knitted layer at forefoot portion 4958. That is, seamless bootie or textile upper 4940 may include a continuous knitted layer formed by first knit layer 4952, second knit layer 4954, and interlayer knit stitch line 4950.

In some embodiments, knitted component 4940 may include a closure system 4970. In some embodiments, closure system may include closure members 4972, knitted holes or eyelets 4974, and lacing 4976.

In some embodiments, a knitted dynamic fit finger component 4981 and/or 4982 may be wrapped up and around knitted component 4940 so that a distal end of knitted dynamic fit finger component 4981 and/or 4982 corresponds with closure system 4970. In some embodiments, distal ends of knitted dynamic fit finger components 4981 and 4982 may include a knitted closure member 4986 and at least one knitted hole or eyelet 4987. In some embodiments, knitted dynamic fit finger components 4981 and 4982 may be wrapped around knitted component 4940 so that at least one closure member 4986 and at least eyelet 4987 of a knitted dynamic fit finger component 4981 and/or at least one closure member 4986 and at least one eyelet 4987 of a knitted dynamic fit finger component 4982 are aligned in registration with at least one closure member 4972 and eyelet 4974 of seamless bootie or textile upper 4940. As shown in reference figure 4908, in some embodiments multiple closure members 4972, 4988 and eyelets 4974, 4987 of closure system 4970 and knitted dynamic fit finger components 4981 and 4982 may be arranged in registration. In this case, it will be appreciated that closure system 4970 and a dynamic fit system including knitted dynamic fit finger components 4981 and 4982 may use common lacing 4976, as shown in reference figure 4908. In some embodiments, knitted dynamic fit finger components 4981 and 4982 may use different lacing or other tensioning structure than closure system 4970. In some embodiments, knitted component 4940 may include a dynamic fit system including knitted dynamic fit finger components 4981 and 4982, and not include any closure system. Those skilled in the art will be able to select a combination of closure system and dynamic fit components suitable for a desired article of footwear.

FIG. 50 illustrates another embodiment of a knitted component 5040 of unitary warp knit construction in a post-removal state or condition. As shown in FIG. 50, in some embodiments knitted component 5040 may include three pairs of optional knitted dynamic fit finger components. A first pair of optional knitted dynamic fit finger components 5080 and 5081 may be located at a rear heel portion of knitted component 5040, where knitted dynamic fit finger component 5080 is formed by a portion of first knit layer 5052 at interlayer knit stitch line 5050, and knitted dynamic fit finger component 5081 is formed by a portion of second knit layer 5054 at interlayer knit stitch line 5050. A second pair of optional dynamic fit finger components 5082 and 5083 may be located at a bottom heel portion of knitted component 5040, where knitted dynamic fit finger component 5082 is formed by a portion of first knit layer 5052 at interlayer knit stitch line 5050, and knitted dynamic fit finger component 5083 is formed by a portion of second knit layer 5054 at interlayer knit stitch line 5050. A third pair of optional dynamic fit finger components 5084 and 5085 may be located at a forefoot portion of knitted component 5040, where knitted dynamic fit finger component 5084 is formed by a portion of first knit layer 5052 at interlayer knit stitch line 5050, and knitted dynamic fit finger component 5085 is formed by a portion of second knit layer 5054 at interlayer knit stitch line 5050. In some embodiments, knitted component 5040 may include a knitted closure structure 5070. In some embodiments, knitted closure structure may include a plurality of knitted closure members 5072 and a plurality of knitted holes or eyelets 5074.

In some embodiments, knitted component 5040 may be removed from a knitted textile element. For example, in some embodiments knitted component 5040 generally may correspond to knitted component 4940 of knitted textile element 4900 in FIG. 49. In some embodiments, knitted component 5040 may be removed from a knitted textile element by a separating process, such as by a cutting process.

Post removal, knitted component 5040 optionally may be inverted or turned inside out in a manner similar to FIGS. 37 to 45.

Dimensions of knitted component 5040 may be selected to provide desired sizing and/or custom fit and performance characteristics in a seamless bootie or textile upper formed from knitted component 5040, as generally described above with respect to knitted component 2100 in FIG. 21 and knitted component 2400 in figure 2400. For example, in some embodiments dimensions 5091 corresponding to a length of optional dynamic fit finger components 5080 and 5081 located in the rear heel region of knitted component 5040, 5092 corresponding to a length of optional dynamic fit finger components 5082 and 5083 located in a bottom heel region of knitted component 5040, and 5093 corresponding to a length of optional dynamic fit finger components 5084 and 5085 located in a forefoot region of knitted component 5040 may be selected to provide a desired sizing and/or custom fit for seamless bootie 5040. Those skilled in the art readily will be able to select dimensions for knitted component 5040 and any dynamic fit finger components suitable to provide a desired sizing and/or custom fit, including dynamic fit, of a seamless bootie or textile upper formed from knitted component 5040.

FIG. 51 illustrates a seamless bootie or textile upper formed from knitted component 5040 of FIG. 50 in a front profile view, where optional knitted dynamic fit finger components or portions 5080, 5082, and 4984 are partially wrapped up on the medial side of knitted component 5040, and optional knitted dynamic fit finger components 5081, 5083, and 5085 are partially wrapped up on the lateral side of knitted component 5040. As shown in FIG. 51, knitted dynamic fit finger component 5080 may be wrapped up around the medial rear heel portion of knitted component 5040 in a direction of arrow 5110, and dynamic fit finger component 5081 may be wrapped up around the lateral rear heel portion of knitted component 5040 in a direction of arrow 5112. Similarly, knitted dynamic fit finger component 5082 may be wrapped up around the medial bottom heel portion of knitted component 5040 in a direction of arrow 5114, and dynamic fit finger component 5083 may be wrapped up around the lateral bottom heel portion of knitted component 5040 in a direction of arrow 5116. Similarly, knitted dynamic fit finger component 5084 may be wrapped up around the medial forefoot portion of knitted component 5040 in a direction of arrow 5118, and dynamic fit finger component 5085 may be wrapped up around the lateral forefoot portion of knitted component 5040 in a direction of arrow 5120.

Reference figure 5007 illustrates a seamless bootie or textile upper formed from knitted component 5040 in a front profile view with three pairs of optional knitted dynamic fit finger components (i.e., pair 5080-5081, pair 5082-5083, and pair 5084-5085) fully wrapped up on both the medial side of knitted component 4940 and the lateral side of knitted component 4940.

In some embodiments, knitted dynamic fit finger components 5080, 5081, 5082, 5083, 5084, 5085 may be wrapped up and around knitted component 5040 so that a distal end of knitted dynamic fit finger components 5080, 5081, 5082, 5083, 5084, 5085 corresponds with closure system 5070. In some embodiments, distal ends of knitted dynamic fit finger components 5080, 5081, 5082, 5083, 5084, 5085 may include a knitted closure member 5086 and at least one knitted hole or eyelet 5087. In some embodiments, knitted dynamic fit finger components 5080, 5081, 5082, 5083, 5084, 5085 may be wrapped up and around knitted component 5040 so that at least one closure member 5086 and at least eyelet 5087 of at least one knitted dynamic fit finger component 5080, 5081, 5082, 5083, 5084, 5085 are aligned in registration with at least one closure member 5072 and eyelet 5074 of seamless bootie or textile upper 5040. As shown in FIG. 52, in some embodiments multiple closure members 5074, 5086 and eyelets 5074, 5087 of closure system 5070 and knitted dynamic fit finger components 5080, 5081, 5082, 5083, 5084, 5085 may be arranged in registration. In this case, it will be appreciated that closure system 5070 and a dynamic fit system including knitted dynamic fit finger components 5080, 5081, 5082, 5083, 5084, 5085 may use common lacing. In some embodiments, knitted dynamic fit finger components 5080, 5081, 5082, 5083, 5084, 5085 may use different lacing or other tensioning structure than closure system 5070. In some embodiments, knitted component 5040 may include a dynamic fit system including knitted dynamic fit finger components 5080, 5081, 5082, 5083, 5084, 5085 and not include any closure system. Those skilled in the art will be able to select a combination of closure system and dynamic fit components suitable for a desired article of footwear.

The present description of embodiments is directed to articles of footwear that may include methods and structures for providing closure, tensioning, and/or dynamic fit. Commonly owned U.S. patent application Ser. No. 13/939,208, filed Jul. 11, 2013, by Tiffany Beers, titled "Article With Closed Instep Portion Having Variable Volume" (PLG 51-2970), discloses methods and structures for providing closure, tensioning, and/or dynamic fit for articles of footwear, the disclosure of which is incorporated herein in its entirety. Those skilled in the art readily will be able to select closure, tensioning, and/or dynamic fit structure suitable for use with embodiments of a desired seamless bootie or textile upper as disclosed and claimed herein.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article of footwear, comprising:

a knitted component of unitary warp knit construction, the knitted component comprising:

a first knit layer including a first portion that forms a medial side of a first knitted component portion configured as a seamless bootie and a second portion that is continuous with the first portion and forms a medial side of a second knitted component portion;

a second knit layer including a first portion that forms a lateral side of the first knitted component portion configured as the seamless bootie and a second portion that is continuous with the first portion and forms a lateral side of the second knitted component portion, the first portion of the second knit layer being continuous with the first portion of the first knit layer across a continuous upper forefoot portion of the seamless bootie;

a first interlayer knit stitch line that interconnects the medial side of the first knitted component portion configured as the seamless bootie and the lateral side of the first knitted component portion configured as the seamless bootie and extends generally along a central line of a heel portion, a bottom portion, and a front toe portion of the seamless bootie; and a second interlayer knit stitch line that interconnects the medial side of the first knit layer of the second knitted component portion and the lateral side of the second knit layer of the second knitted component portion.

2. The article of footwear according to claim 1, wherein the second portion of the first knit layer and the second portion of the second knit layer form a single continuous layer across an interior upper forefoot portion of the second knitted component portion.

3. The article of footwear according to claim 1, wherein the second interlayer knit stitch line generally extends along a central line of at least one of an interior heel portion, an interior midfoot bottom portion, and an interior front toe portion of the second component portion.

4. The article of footwear according to claim 1, further comprising: at least one knitted indicating portion indicating a separating line of the first knitted component portion configured as the seamless bootie.

5. The article of footwear according to claim 1, wherein the second portion of the first knit layer and the second portion of the second knit layer form a second knitted component portion.

6. The article of footwear according to claim 1, wherein the first portion of the first knit layer and the first portion of the second knit layer include a closure structure for the first knitted component portion.

7. The article of footwear according to claim 6, wherein the closure structure for the first knitted component portion includes a first plurality of knitted holes for receiving a first tensioning element.

8. The article of footwear according to claim 7, wherein at least one knitted hole of the first plurality of knitted holes of the closure structure is configured to align in registration with at least one knitted hole of a second plurality of knitted holes formed in the second knitted component portion, and the at least one hole of the first plurality of knitted holes of the closure structure for the first knitted component portion and the at least one knitted hole of the second plurality of knitted holes formed in the second knitted component portion are configured to receive a common tensioning element.

9. The article of footwear according to claim 1, wherein the second portion of the first knit layer and the second portion of the second knit layer form a gusseted tongue of the seamless bootie.

10. The article of footwear according to claim 9, wherein the gusseted tongue includes a first plurality of knitted holes formed in the second portion of the first knit layer and a second plurality of knitted holes fainted in the second portion of the second knit layer.

11. The article of footwear according to claim 10, wherein the first plurality of knitted holes and the second plurality of knitted holes are configured to align in registration.

* * * * *